US006160347A

United States Patent [19]

Iwasaki et al.

[11] Patent Number: 6,160,347

[45] **Date of Patent: *Dec. 12, 2000**

[54] ELECTRON SOURCE AND IMAGE FORMING APPARATUS AS WELL AS METHOD OF PROVIDING THE SAME WITH MEANS FOR MAINTAINING ACTIVATED STATE THEREOF

[75] Inventors: Tatsuya Iwasaki, Atsugi; Toshikazu Ohnishi, Sagamihara, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/543,897

[22] Filed: Oct. 17, 1995

[30] Foreign Application Priority Data

Oct. 17, 1994 [JP] Japan ..... 6-275544
Oct. 12, 1995 [JP] Japan ..... 7-289172

[51] Int. Cl.[7] ..... H01J 1/30

[52] U.S. Cl. ..... 313/545; 445/6; 445/51; 313/346 R

[58] Field of Search ..... 445/6, 10, 25, 445/14, 24, 2; 313/545

[56] References Cited

U.S. PATENT DOCUMENTS

| | | | |
|---|---|---|---|
| 4,709,185 | 11/1987 | Hoeberechts et al. | 313/346 R |
| 4,722,852 | 2/1988 | Hoeberechts et al. | 427/78 |
| 4,736,135 | 4/1988 | Zwier et al. | 313/546 |
| 4,970,392 | 11/1990 | Oettinger et al. | 250/423 |
| 5,089,292 | 2/1992 | MaCaulay et al. | 427/78 |
| 5,260,610 | 11/1993 | Pedersen et al. | 307/465 |
| 5,414,272 | 5/1995 | Watanabe et al. | 257/10 |
| 5,505,647 | 4/1996 | Sato et al. | 445/25 |
| 5,559,342 | 9/1996 | Tsukamoto et al. | 257/10 |

FOREIGN PATENT DOCUMENTS

| | | | |
|---|---|---|---|
| 0660357 | 6/1995 | European Pat. Off. . | |
| 61-004132 A | 1/1986 | Japan . | |
| 4-132147 | 5/1992 | Japan . | |
| 5-151916 | 6/1993 | Japan . | |
| 6-199594 A | 7/1994 | Japan . | |
| 2946189 | 7/1999 | Japan . | |
| 2-257551 | 10/1999 | Japan . | |
| 569819 | 6/1945 | United Kingdom | 445/14 |
| 2162681 | 5/1986 | United Kingdom . | |

OTHER PUBLICATIONS

M. Hartwell, et al. "Strong Electron Emission From Patterned Tin–Indium Oxide Thin Films", Int'l Electron Devices Meeting,Washington, D.C. 1975, pp. 519–521.

G. Dittmer, "Electrical Conduction And Electron Emission Of Discontinous Thin Films", Philips Forschungslaboratorium Aachen GmbH (Germany), Jul. 4, 1971, Thin Solid Films, 9 –Elsevier Sequoia S.A., Lausanne, Switzerland, pp. 315–328.

Hisashi Araki, et al., "Electroforming and Electron Emission of Carbon Thin Films", Journal of the Vacuum Society of Japan, vol. 26, No. 1, rec'd Sep. 24, 1981, pp. 22–29.

M. I. Elinson, et al, "The Emission of Hot Electrons and the Field Emission of Electrons from Tin Oxide", Radio Engineering and Electronic Physics, Jul. 1965, pp. 1290–1296.

(List continued on next page.)

*Primary Examiner*—Kenneth J. Ramsey
*Attorney, Agent, or Firm*—Fitzpatrick, Cella, Harper & Scinto

[57] ABSTRACT

An electron source comprises one or more electron-emitting devices, especially of surface conduction type, and is provided with means for supplying an activating substance to the device(s). The means comprises preferably a substance source and a heater or electron beam generator for gasifying the substance source. The electron source can be combined with an image-forming member (e.g. fluorescent body) to constitute an image-forming apparatus. The means is used for in situ activation or re-activation of the electron-emitting device(s).

83 Claims, 30 Drawing Sheets

OTHER PUBLICATIONS

C.A. Spindt, et al, "Physical Properties of Thin–Film Field Emission Cathodes With Molybdenum Cones", Journal of Applied Physics, Dec. 1976, No. 12, pp. 5248–5263.
C.A. Mead, "Operation of Tunnel–Emission Devices", Journal of Applied Physics, vol. 32, No. 4, Apr. 1961, pp. 646–652.
R.E. Thomas, et al., "Thermonic Sources for High–Brightness Electron Beams", IEEE Transactions on Electron Devices, vol. 37, No. 3, Mar. 1990, pp. 50–60.
W.P. Dyke, et al., Field Emission::, Advances in Electronics and Electron Academic Press, 1956, pp. 90–185.
K. Kinoshita, "The Experimental Physics Course No. 14: Surface/Fine Particle", Kyorita Publication, Sep. 1, 1986, p. 195, 11.22–26.
C. Hayashi, et al., "Ultrafine Particle Project", Creative Science and Technology, Mita publication, 1988, p. 2, 11.1–4.
"Scanning Tunnelling Microscopic Investigations of Electroformed Planar Metal–insulator–metal Diodes,"to H. Pagnia, N. Sotnik and W. Wirth, Int. J. Electronics, vol. 69, No. 1, 1009–1010 (1990).
"Energy Distribution of Emitted Electrons from Electroformed MIM Structures: The Carbon Island Model," M. Bischoff, H. Pagnia and J. Trickl, Int. J. Electronics, vol. 73, No. 5, 1009–1010, (1992).
"Thin Film Handbook," Committee 131 of Japanese Society for the Promotion of Art and Science, Feb. 1986.
"On the Electron Emission from Evaporated Thin Au Films," M. Bischoff, R. Holzer and H. Pagnia, Physics Letters, vol. 62A, No. 7 (Oct. 3, 1977), pp 512–514.
"The Electroforming Process in MIM Diodes," vol. 85, R. Blessing, H. Pagnia and N. Sotnik, Thin Solid Films, 119–128 (1981).
"Evidence for the Contribution of an Adsorbate to the Voltage–Contolled Negative Resistance of Gold Island Film Diodes," R. Blessing, H. Pagnia and R. Schmitt, Thin Solid Films, vol. 78, 397–401 (1981).
"Water–Influenced Switching in Discontinous Au Film Diodes," R. Muller and H. Pagnia, Materials Letters, vol. 2, No. 4A, 283–285 (Mar. 1984).
"Influence of Organic Molecules on the Current–Voltage Characteristic of Planar MIM Diodes," H. Pagnia, N. Sotnik and H. Strauss, Phy. Stat. Sol., vol. 90, 771–778 (1985).
"Influence of Gas Composition on Regeneration in Metal/Insulator/Metal Diodes," M. Borbonus, H. Pagnia and N. Sotnik, Thin Sold Films, vol. 151, 333–342 (1987).
"Prospects for Metal/non–Metal Microsystems: Sensors, Sources and Switches," H. Pagnia, Int. J. Electronics, vol. 73, No. 5, 819–825 (1992).
"Carbon–nanoslit Model for the Electroforming Process in MIM Structures," M. Bischoff, Int. J. Electronics, vol. 70, No. 3, 491–498 (1991).
Kim et al., "Contour Coding Based on the Decomposition of Line Segments", Pattern Recognition Letters, vol. 11, no. 3, Mar. 1990. pp. 191–195.

ELECTRON SOURCE AND IMAGE FORMING APPARATUS AS WELL AS METHOD OF PROVIDING THE SAME WITH MEANS FOR MAINTAINING ACTIVATED STATE THEREOF

BACKGROUND OF THE INVENTION

1. Field of the Invention

This invention relates to an electron source and an image forming apparatus and, more particularly, it relates to an electron source provided with means for maintaining it in an activated state by suppressing degradation of and restoring the performance thereof and an image forming apparatus comprising such an electron source as well as a method of providing it with such means.

2. Related Background Art

There have been known two types of electron-emitting device: the thermionic cathode type and the cold cathode type. Of these, the cold cathode refers to devices including field emission type (hereinafter referred to as the FE type) devices, metal/insulation layer/metal type (hereinafter referred to as the MIM type) electron-emitting devices and surface conduction electron-emitting devices. Examples of FE type devices include tho se proposed by W. P. Dyke & W. W. Dolan, "Field emission", Advance in Electron Physics, 8, 89 (1956) and C. A. Spindt, "Physical Properties of thinfilm field emission cathodes with molybdenum cones", J. Appl. Phys., 47, 5284 (1976).

Examples of MIM device are disclosed in papers including C. A. Mead, "The tunnel-emission amplifier", J. Appl. Phys., 32, 646 (1961).

Examples of surface conduction electron-emitting device include one proposed by M. I . Elinson, Radio Eng. Electron Phys., 10, 1290 (1965).

A surface conduction electron-emitting device is realized by utilizing the phenomenon that electrons are emitted out of a small thin film formed on a substrate when an electric current is forced to flow in parallel with the film surface. While Elinson proposes the use of $SnO_2$ thin film for a device of this type, the use of Au thin film is proposed in G. Dittmer: "Thin Solid Films", 9, 317 (1972) whereas the use of $In_2O_3/SnO_2$ and that of carbon thin film are discussed respectively in M. Hartwell and C. G. Fonstad: "IEEE Trans. ED Conf.", 519 (1975) and H. Araki et al.: "Vacuum", Vol. 26, No. 1, p.22 (1983).

FIG. 27 of the accompanying drawings schematically illustrates a typical surface conduction electron emitting device proposed by M. Hartwell. In FIG. 27, reference numeral 1 denotes a substrate. Reference numeral 4 denotes an electroconductive thin film normally prepared by producing an H-shaped thin metal oxide film by means of sputtering, part of which eventually makes an electron-emitting region 5 when it is subjected to an electrically energizing process referred to as "energization forming" as described hereinafter. In FIG. 27, the thin horizontal area of the metal oxide film separating a pair of device electrodes has a length L of 0.5 to 1 mm and a width W' of 0.1 mm.

Conventionally, an electron-emitting region 5 is produced in a surface conduction electron-emitting device by subjecting the electroconductive thin film 4 of the device to an electrically energizing preliminary process, which is referred to as "energization forming". In the energization forming process, a constant DC voltage or a slowly rising DC voltage that rises typically at a rate of 1 V/min. is applied to given opposite ends of the electroconductive thin film 4 to partly destroy, deform or transform the film and produce an electron-emitting region 5 which is electrically highly resistive. Thus, the electron-emitting region 5 is part of the electroconductive thin film 4 that typically contains a fissure and fissures therein so that electrons may be emitted from the fissure.

Currently available electron-emitting devices of the type under consideration have room for improvement in terms of performance and efficiency of electron emission in order to realize image forming apparatuses that provide bright and clear images on a stable basis. The efficiency here refers to the ratio of the electric current flowing through the surface conduction electron-emitting device (hereinafter referred to as "device current" or If) to the electric current formed by electrons discharged from the device into vacuum (hereinafter referred to as "emission current" or Ie) when a voltage is applied to the paired device electrodes of the device. An ideal electron-emitting device will show a large emission current relative to a small device current. If an electron-emitting device is rigorously controllable for its electron emitting performance and has an improved efficiency, an image forming apparatus realized by arranging a number of such electron-emitting devices and a fluorescent member for forming images thereon will be able to produce high quality images with a reduced energy consumption rate if the apparatus is made very flat. Then, the drive circuit of such an image forming apparatus can be manufactured at reduced cost because of the low energy consumption rate of the electron-emitting devices of the apparatus.

However, Hartwell's electron-emitting device does not necessarily perform satisfactorily in terms of stable emission of electrons and efficiency and, therefore, it is thought to be very difficult to realize an image forming apparatus that operates stably to produce highly bright images with Hartwell's devices.

As a result of intensive research efforts, the inventors of the present invention discovered that, if a certain voltage is applied to a surface conduction electron-emitting device in an atmosphere that contains organic substances after producing an electron-emitting region therein by energization forming as described above, both If and Ie of the device remarkably increase. This operation of applying a certain voltage is termed "activation".

The above phenomenon of increased If and Ie is attributable to an activated filmy deposit of carbon or a carbon compound produced in the vicinity of the electron-emitting region as a result of the voltage application.

As an electron-emitting device is operated for a long time for electron emission, the deposit in the vicinity of the electron-emitting region may be gradually decomposed and eroded to degrade the electron-emitting performance of the device, although such degradation may be suppressed by selecting appropriate parameters for the activation process. This may be because the crystallinity of the deposit affects the rate of erosion and the crystallinity is by turn affected by the parameters of the activation process. The use of a metal having a high melting point such as tungsten for the deposit is effective for suppressing the erosion of the deposit.

Nevertheless, the performance of a surface conduction electron-emitting device has to be further improved in order to pr event degradation and prolong its service life if it is to be used in an image forming apparatus or a similar application.

In view of the above identified problems and other problems, it is therefore an object of the present invention to provide an improved surface conduction electron-emitting device.

Additionally, the "activation process" requires the use of a large vacuum apparatus provided with equipment for introducing carbon and/or metal compounds into the apparatus. When a large image forming apparatus having a vacuum container (envelope) is subjected to an activation process with such a vacuum apparatus, the latter has to be provided with an exhaust pipe for evacuating the inside of the vacuum container and introducing carbon and/or metal compounds into the vacuum container to make the overall operation rather complicate d and time consumin g to push up the manufacturing cost of the image forming apparatus particularly if such compounds have a large molecular weight. Thus, the present invention is also intended to provide a method that allows the use of a downsized vacuum apparatus and a simplified manufacturing process to bypass the above problems.

SUMMARY OF THE INVENTION

Therefore, it is an object of the present invention to provide a method of suppressing degradation of and restoring the electron emitting performance of an electron source and an image forming apparatus comprising such an electron source.

According to the invention, there is provided an electron source comprising electron-emitting devices, characterized in that it is provided with means for supplying an activating substance to the electron-emitting devices.

According to the invention, there is also provided an image forming apparatus comprising an electron source by turn comprising electron-emitting devices and an image forming member to be irradiated with electron beams from said electron source to form images thereon, characterized in that said image forming apparatus is provided with means for supplying an activating substance to the electron-emitting devices.

According to the invention, there is also provided a method of activating an electron source comprising electron-emitting devices and an activating substance source, characterized in that it comprises a step of gasifying the activating substance from the activating substance source and applying it to the electron-emitting devices.

According to the invention, there is also provided a method of activating an image forming apparatus comprising an electron source by turn comprising electron-emitting devices and an image forming member to be irradiated with electron beams from said electron source to form images thereon, characterized in that it comprises a step of gasifying the activating substance from the activating substance source and applying it to the electron-emitting devices.

DETAILED DESCRIPTION OF THE PREFERRED EMBODIMENTS

The present invention provides a method of suppressing degradation of and restoring the electron emitting performance of an electron source and an image forming apparatus comprising such an electron source. Such a method can be used in the "activation step" in the process of manufacturing an electron source and an image forming apparatus comprising such an electron source to simplify the step. Additionally, such a method can be used for suppressing degradation with time of and temporarily restoring the electron emitting performance of an electron source and the electron-emitting devices of an image forming apparatus.

Now, the present invention will be described by referring to the accompanying drawings that illustrate preferred embodiments of the invention.

Figure 1A:
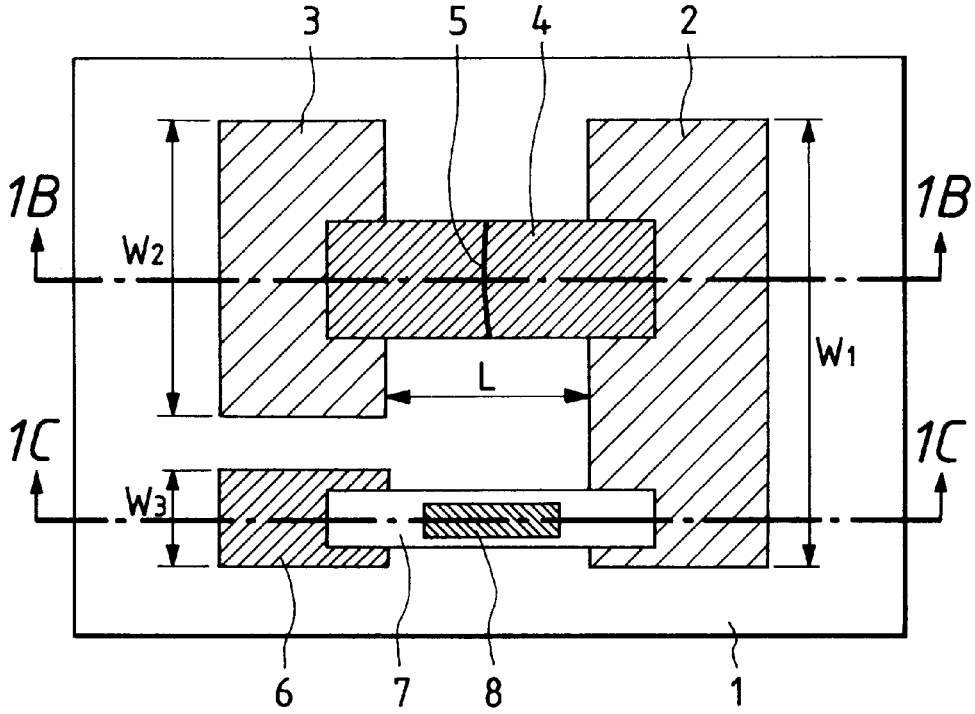
FIGS. 1A through 1C are schematic views of a surface conduction electron-emitting device that can be used for the purpose of the present invention.
Figure 1B:
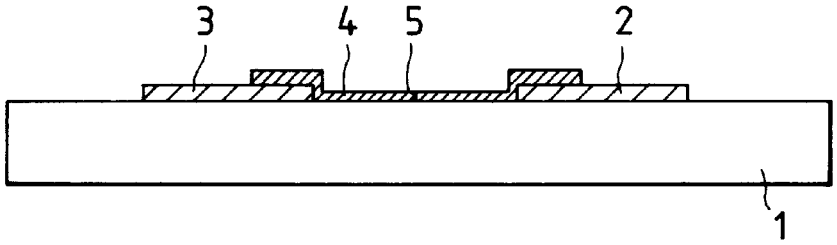
Figure 1C:
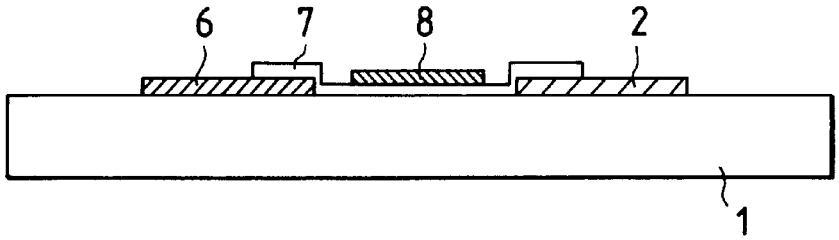

FIGS. 1A through 1C are schematic views of a surface conduction electron-emitting device of an electron source according to the invention, of which FIG. 1A is a plan view and FIGS. 1B and 1C are cross-sectional views taken along lines 1B—1B and 1C—1C respectively.

Referring to FIGS. 1A through 1C, there are shown a substrate 1, a pair of device electrodes 2 and 3, an electroconductive thin film 4, an electron-emitting region 5, a film resistance heater 7 and an activating substance source 8, of which the film resistance heater 7 is arranged between one of the device electrodes, or the electrode 2, and an electrode for supplying an activating substance 6. Note that the device electrodes 2 and 3 and the electroconductive thin film 4 including the electron-emitting region 5 constitute a surface conduction electron-emitting device, while the film resistance heater 7, the activating substance source 8 and the electrodes 2 and 6 constitute an activating substance supply means.

Materials that can be used for the substrate 1 include quartz glass, glass containing impurities such as Na to a reduced concentration level, soda lime glass, glass substrate realized by forming an $SiO_2$ layer on soda lime glass by means of sputtering, ceramic substances such as alumina as well as Si.

While the oppositely arranged device electrodes 2 and 3 and the electrode for supplying an activating substance 6 may be made of any highly conducting material, preferred candidate materials include metals such as Ni, Cr, Au, Mo, W, Pt, Ti, Al, Cu and Pd and their alloys, printable conducting materials made of a metal or a metal oxide selected from Pd, Ag, $RuO_2$, Pd-Ag and glass, transparent conducting materials such as $In_2O_3$—$SnO_2$ and semiconductor materials such as polysilicon.

The distance L separating the device electrodes, the lengths $W_1$ through $W_3$ of the device electrodes and the electrode for supplying an activating substance, the contour of the electroconductive film 4 and other factors for designing a surface conduction electron-emitting device according to the i nvention may be determined depending on the application of the device. The distance L separating the device electrodes 2 and 3 is preferably between several hundred nanometers and several hundred micrometers and, more preferably, between several micrometers and tens of several micrometers.

The lengths $W_1$ and $W_2$ of the device electrodes 2 and 3 is preferably between several micrometers and several hundreds of micrometers depending on the resistance of the electrodes and the electron-emitting characteristics of the device. The film thickness of the device electrodes 2 and 3 is between several tens of nanometers and several micrometers.

A surface conduction electron-emitting device that can be used for the purpose of the present invention may have a configuration other than the one illustrated in FIGS. 1A through 1C and, alternatively, it may be prepared by laying a thin film 4 including an electron-emitting region on a substrate 1 and then a pair of oppositely disposed device electrodes 2 and 3 on the thin film.

The electroconductive thin film 4 is preferably a fine particle film in order to provide excellent electron-emitting characteristics. The thickness of the electroconductive thin film 4 is determined as a function of the step coverage of the electroconductive thin film on the device electrodes 2 and 3, the electric resistance between the device electrodes 2 and 3 and the parameters for the forming operation that will be described later as well as other factors and preferably between one tenth of a nanometer and several hundreds of nanometers and more preferably between one nanometer and fifty nanometers. The electroconductive thin film 4 normally shows a resistance Rs between $10^2$ and $10^7$ Ω. Note that Rs is the resistance defined by R=Rs(1/w), where t, w and 1 are the thickness, the width and the length of the thin film respectively. R is a resistance value measured along the direction of i the length 1.

The electroconductive thin film 4 is made of fine particles of a material selected from metals such as Pd, Pt, Ru, Ag, Au, Ti, In, Cu, Cr, Fe, Zn, Sn, Ta, W and Pb, oxides such as PdO, $SnO_2$, $InO_3$, PbO and $Sb_2O_3$, borides such as $HfB_2$, $ZrB_2$, $LaB_6$, $CeB_6$, $YB_4$ and $GdB_4$, carbides such TiC, ZrC, HfC, TaC, SiC and WC, nitrides such as TIN, ZrN and HfN, semiconductors such as Si and Ge and carbon.

The term a "fine particle film" as used herein refers to a thin film constituted of a large number of fine particles that may be loosely dispersed, tightly arranged or mutually and randomly overlapping (to form an island structure under certain conditions). The diameter of fine particles to be used for the purpose of the present invention is between a tenth of a nanometer and several hundreds of nanometers and preferably between one manometer and twenty nanometers.

Since the term "fine particle" is frequently used herein, it will be described in greater detail below.

A small particle is referred to as a "fine particle" and a particle smaller than a fine particle is referred to as an "ultrafine particle". A particle smaller than an "ultrafine particle" and constituted by several hundred atoms is referred to as a "cluster".

However, these definitions are not rigorous and the scope of each term can vary depending on the particular aspect of the particle to be dealt with. An "ultrafine particle" may be referred to simply as a "fine particle" as in the case of this patent application.

"The Experimental Physics Course No. 14: Surface/Fine Particles (ed., Koreo Kinoshita; Kyoritu Publication, Sep. 1, 1986) describes as follows.

"A fine particle as used herein refers to a particle having a diameter somewhere between 2 to 3 μm and 10 nm and an ultrafine particle as used herein means a particle having a diameter somewhere between 10 nm and 2 to 3 nm. However, these definitions are by no means rigorous and an ultrafine particle may also be referred to simply as a fine particle. Therefore, these definitions are a rule of thumb in any means. A particle constituted of two to several hundred atoms is called a cluster." (Ibid., p.195, 11.22–26)

Additionally, "Hayashi's Ultrafine Particle Project" of the New Technology Development Corporation defines an "ultrafine particle" as follows, employing a smaller lower limit for the particle size.

"The Ultrafine Particle Project (1981–1986) under the Creative Science and Technology Promoting Scheme defines an ultrafine particle as a particle having a diameter between about 1 and 100 nm. This means an ultrafine particle is an agglomerate of about 100 to 108 atoms. From the viewpoint of atom, an ultrafine particle is a huge or ultrahuge particle." (Ultrafine Particle—Creative Science and Technology: ed., Chikara Hayashi, Ryoji Ueda, Akira Tazaki; Mita Publication, 1988, p.2, 11.1–4) A particle smaller than an ultrafine particle formed by several to several hundred atoms is generally called a cluster." (Ibid: p.2, 11.12–13)

Taking the above general definitions into consideration, the term a "fine particle" as used herein refers to an agglomerate of a large number of atoms and/or molecules having a diameter with a lower limit between several times of 0.1 nm and 1 nm and an upper limit of several micrometers.

The electron-emitting region 5 is part of the electroconductive thin film 4 and comprises an electrically highly resistive fissure, although its performance is dependent on the thickness and the material of the electroconductive thin film 4 and the energization forming process which will be described hereinafter. The electron emitting region 5 may contain in the inside fine particles having a diameter between several times of a tenth of a nanometer and several tens of nanometers. The material of such fine particles may be selected from all or part of the materials that can be used to prepare the thin film 4 including the electron emitting region. The electron emitting region 5 and part of the thin film 4 surrounding the electron emitting region 5 may contain carbon and carbon compounds.

If the activating substance is a carbide, the activating substance source is preferably a thin film of a baked or unbaked polymerized compound or a baked or unbaked porous material that has adsorbed an organic compound such as a hydrocarbon compound.

Polymerized compounds that can be used for the purpose of the present invention include polyvinyl acetate, polyvinyl butyral, 3,5-dimethylphenol, polyvinyl chloride. Any of these materials is used after baking at temperature between 200 and 300° C. so that it may produce little gas of the organic compound if it is held in vacuum at room temperature. Examples of carbon compounds that may be used for adsorption include aromatic hydrocarbon compounds and olefinic compounds.

If the activating substance is a metal compound and the activation process is carried out by depositing a high melting point metal such as W or Nb on the electronemitting region, materials that may be used for the activating substance source include metal halides such as fluorides, chlorides, bromides and iodides, metal alkylates such as methylates, ethylates and benzylates, metal β-diketonates such as acetylacetonates, dipivaloylmethanates and hexafluoroacetylacetonates, metal enyl complexes such as allyl complexes and cyclopentadienyl complexes, arene complexes such as benzene complexes, metal carbonyls and metal alkoxides as well as compounds obtained by combining any of such substances. Specific examples include $NbF_5$, $NbC_5$, $Nb(C_5H_5)(CO)_4$, $Nb(C_5H_5)_2Cl_2$, $OsF_4$, $Os(C_3H_7O_2)_3$, $OS(CO)_5$, $OS(CO)_{12}$, $OS(C_5H_5)_2$, $ReF_5$, $ReCl_5$, $Re(CO)_{10}$, $ReCl(CO)_5$, $Re(CH_3)(CO)_5$, $Re(C_5H_5)(CO)_3$, $Ta(C_5H_5)(CO)_4$, $Ta(OC_2H_5)_5$, $Ta(C_5H_5)_2Cl_2$, $Ta(C_5H_5)_2H_3$, $WF_6$, $W(CO)_6$, $W(C_5H_5)_2Cl_2$, $W(C_5H_5)_2H_2$ and $W(CH_3)_6$. Of these, $W(CO)_6$ (tungsten hexacarbonyl) is preferable because it can be used to produce tungsten which is a metal having a high melting point and handled relatively easily.

In the above-described electron-emitting device, the activating substance source 8 is formed on the film resistance heater 7, which is designed to be heated and to evaporate the activating substance of the activating substance source 8 as a voltage is applied to the device electrode 2 and the electrode for supplying an activating substance 6 to cause an electric current to flow through the heater 7. The evaporated substance is eventually fed to and near the electron-emitting region. The film resistance heater 7 may be made of a metal such as Au, Pt or Ni or an electroconductive oxide such as $SnO_2$—$In_2O_3$(ITO). Instead of a thin film, the heater may be realized in the form of a wire.

In the above-described electron-emitting device, one of the device electrodes also operates as an electrode for feeding the film resistance heater with electricity (electrode for supplying an activating substance). Alternatively, however, a pair of electrodes for supplying an activating substance may be arranged independently of the device electrodes. Still alternatively, activating substance source and film resistance heater may be arranged on both lateral sides of the electron-emitting region. The positional arrangement of these components may be appropriately modified so long as the activating substance can be effectively fed to and near the electron-emitting region.

Figure 2:
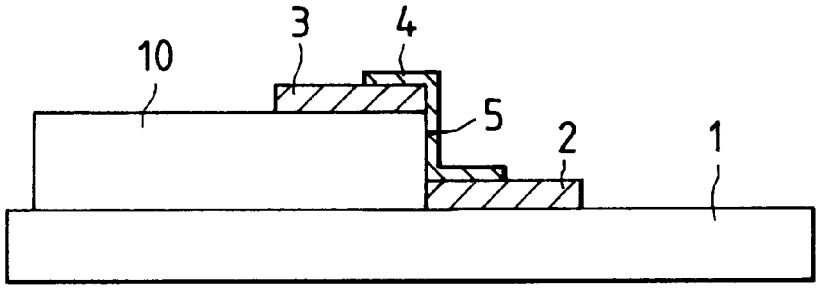
FIG. 2 is a schematic view of another surface conduction electron-emitting device that can be used for the purpose of the present invention.

For the purpose of the invention, step type surface conduction electron-emitting devices each having a profile as illustrated in FIG. 2 may be used in place of devices each having a profile of 1B, which is a sectional view taken along line 1B—1B in FIG. 1A. In FIG. 2, reference numeral 10 denotes a step forming member typically made of an electrically insulating material.

Figure 3:
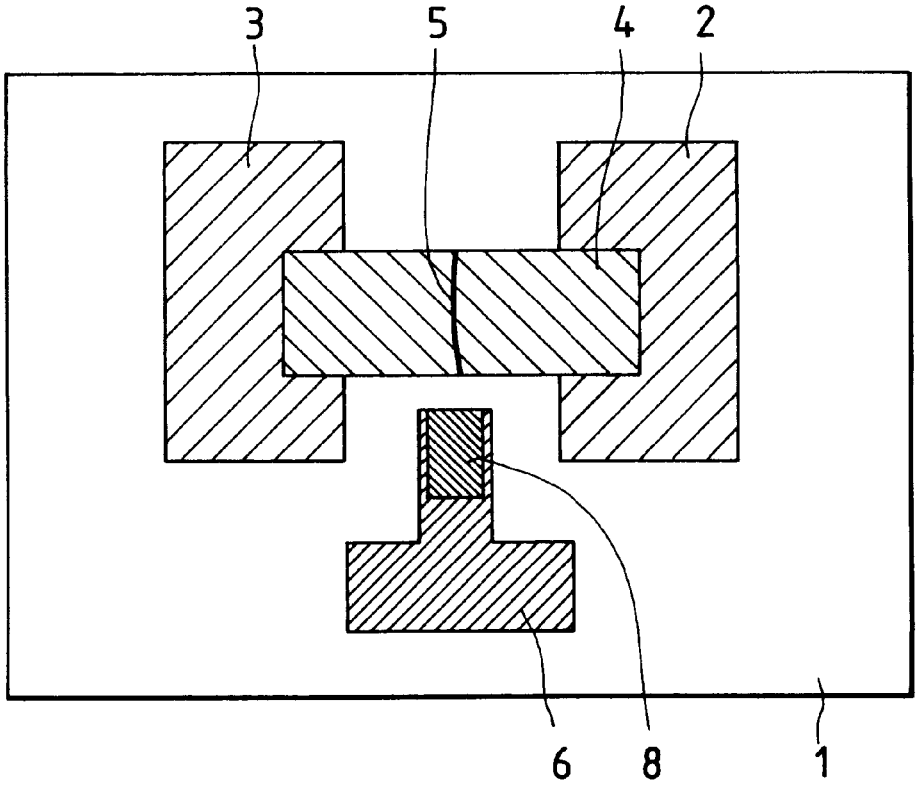
FIG. 3 is a schematic view of still another surface conduction electron-emitting device that can be used for the purpose of the present invention.

The method of supplying an activating substance from the activating substance source according to the invention may be so modified that, in place of passing electric current through and heating the film resistance heater, electron beams emitted from the electron-emitting device may be used to irradiate the activating substance source in order to supply the activating substance to and near the electron-emitting region. FIG. 3 schematically illustrates the arrangement of the electron source for such a modified method. Then, the electrode for supplying an activating substance 6 is subjected to a voltage higher than that of the anode of the corresponding surface conduction electron-emitting device comprising a pair of device electrodes 2 and 3 and an electroconductive thin film 4 including an electron-emitting region 5 so that it may attract electrons emitted from the electron-emitting region 5 and cause them to collide with the activating substance source 8, which is consequently energized and supplies the activating substance to and near the electron-emitting region.

Now, a method of manufacturing a surface conduction electron-emitting device having a configuration as described above will be described by referring to FIGS. 1A through 1C and 4A through 4E.

Figure 4A:
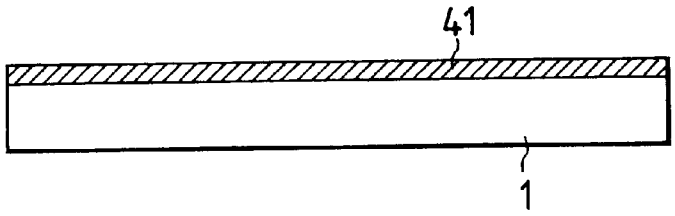
FIGS. 4A through 4E are schematic views of a still another electron-emitting device that can be used for the purpose of the present invention, showing different manufacturing steps.
Figure 4B:
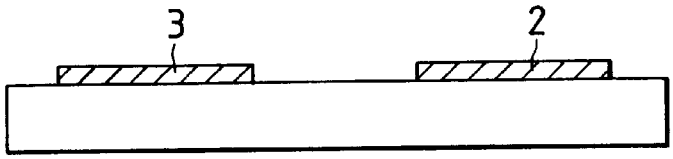
Figure 4C:
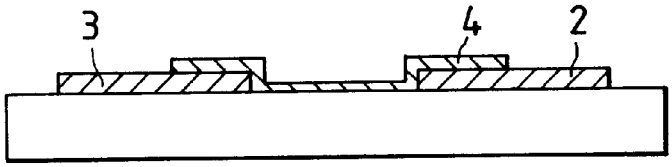
Figure 4D:
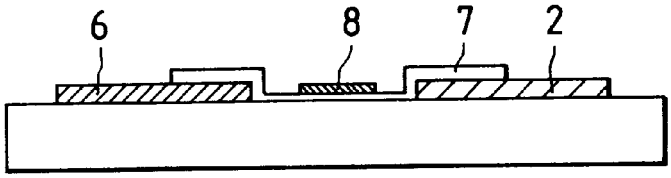
Figure 4E:
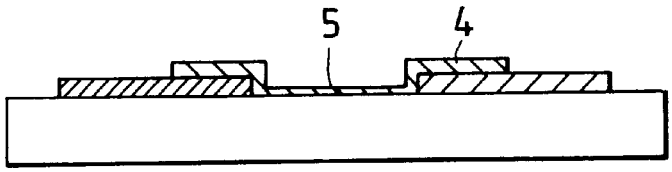

1) After thoroughly cleansing a substrate 1 with detergent and pure water, a material is deposited on the substrate 1 (as shown in FIG. 4A which is a cross-sectional view taken along line 1B—1B in FIG. 1A) by means of vacuum evaporation, sputtering or some other appropriate technique for a pair of device electrodes 2 and 3 and an electrode for supplying an activating substance 6, which are then patterned with photolithography technique or the like (FIG. 4B)

2) An organic metal thin film is formed on the substrate 1 carrying thereon the pair of device electrodes 2 and 3 and an electrode for supplying an activating substance 6 by applying an organic metal solution and leaving the applied solution for a given period of time. The organic metal solution may contain as a principal ingredient any of the metals listed above for the electroconductive thin film 4. Thereafter, the organic metal thin film is heated, baked and subsequently subjected to a patterning operation, using an appropriate technique such as lift-off or etching, to produce an electroconductive thin film 4 (FIG. 4C which is a cross-sectional view also taken along line 1B—1B in FIG. 1A). While an organic metal solution is applied to produce a thin film in the above description, an electroconductive thin film 4 may alternatively be formed by vacuum evaporation, sputtering, chemical vapor deposition, dispersed application, dipping, spinner or some other technique.

3) Then, a film resistance heater 7 and an activating substance source 8 are formed. Any method that may be used for forming an electroconductive thin film 4 may also be used for the film resistance heater 7. Subsequently, the activating substance source 8 is formed thereon and, if necessary, subjected to other processing operations such as baking (FIG. 4D which is a cross-sectional view also taken along line 1C—1C in FIG. 1A).

4) Thereafter, the device electrodes 2 and 3 are subjected to a process referred to as "forming. Here, an energization forming process will be described as a choice for forming. More specifically, voltage is applied between the device electrodes 2 and 3 by means of a power source (not shown) until an electron emitting region (fissures) 5 is produced in a given area of the electroconductive thin film 4 to show a modified structure that is different from that of the electroconductive thin film 4 (FIG. 4E which is a cross-sectional view also taken along line 1B—1B in FIG. 1A). FIGS. 5A through 5D show different pulse voltages that can be used for energization forming.

The voltage to b e used for energization forming preferably has a pulse waveform. A pulse voltage having a constant height or a constant peak voltage may be applied continuously as shown in FIG. 5A or, alternatively, a pulse voltage having an increasing height or an increasing peak voltage may be applied as shown in FIG. 5B.

Figure 5A:
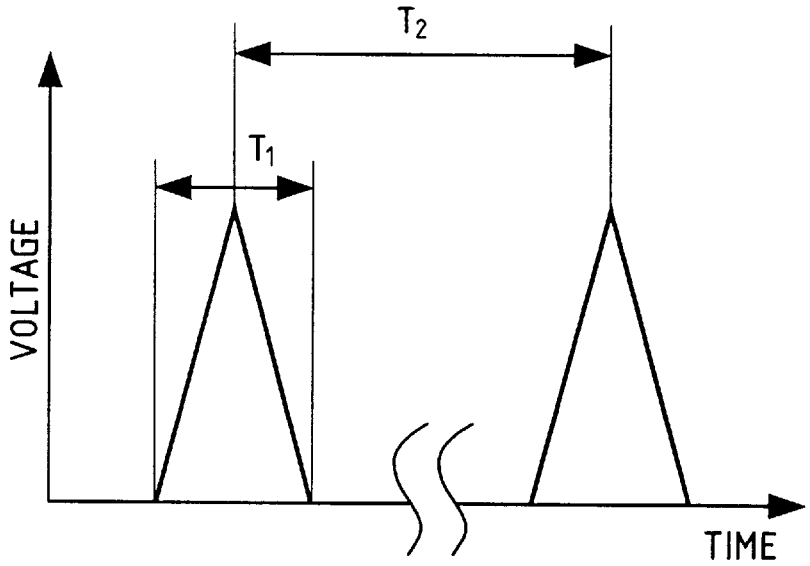
FIGS. 5A through 5D are graphs schematically showing voltage waveforms that can be used for manufacturing and gauging the performance of a surface conduction electron-emitting device, an electron source comprising such devices and an image forming apparatus comprising such an electron source.

In FIG. 5A, the pulse voltage has a pulse width $T_1$ and a pulse interval $T_2$, which are typically between 1 $\mu$sec. and 10 msec. and between 10 $\mu$sec. and 100 msec. respectively. The height of the triangular wave (the peak voltage for the energization forming operation) may be appropriately selected depending on the profile of the surface conduction electron-emitting device. The voltage is typically applied for a period between several seconds and several tens of minutes in vacuum. Note, however, that the pulse waveform is not limited to triangular and a rectangular or some other waveform may alternatively be used.

Figure 5B:
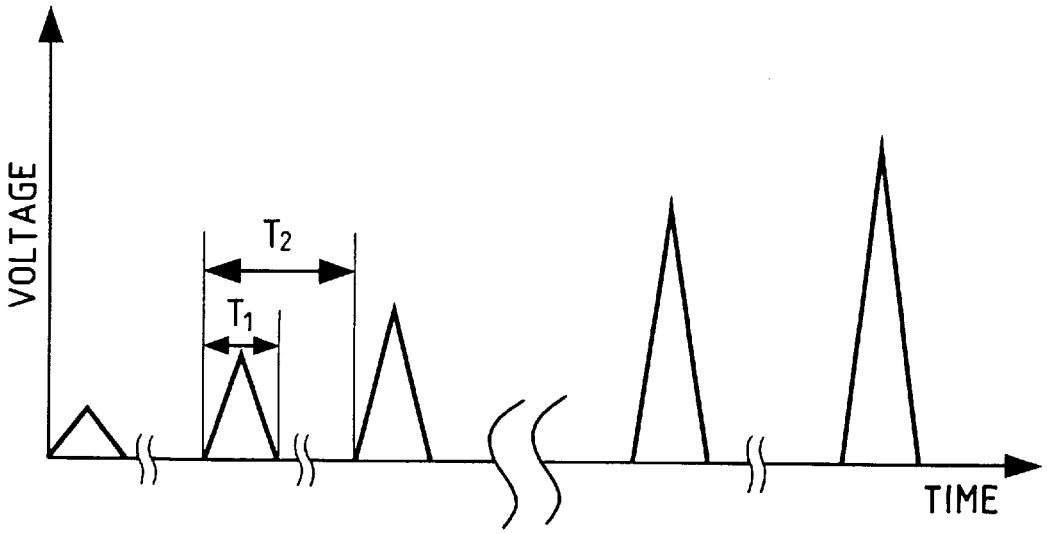

FIG. 5B shows a pulse voltage whose pulse height increases with time. In FIG. 5B, the pulse voltage has a width $T_1$ and a pulse interval $T_2$ that are substantially similar to those of FIG. 5A. The height of the triangular wave (the peak voltage for the energization forming operation) is, however, increased at a rate of, for instance, 0.1V per step.

The energization forming operation will be terminated by measuring the current running through the device electrodes when a pulse voltage that is sufficiently low and does not locally destroy or deform the electroconductive thin film 2, or about 0.1V, is applied to the device between the pulses for the energization forming. Typically, the energization forming operation is terminated when a resistance greater than 1MΩ is observed for the device current running through the electroconductive thin film 4 while applying a pulse voltage of approximately 0.1V to the device electrodes.

5) After the energization forming operation, the electron-emitting device is subjected to an activation process.

In an activation process, a pulse voltage is repeatedly applied to the device in a vacuum chamber, in which a carbon compound or a metal compound (activating substance) exists at a very small concentration. As a result of this process, carbon, a carbon compound or a metal compound is deposited on the electron-emitting region so that device current If and the emission current Ie change remarkably. The activation step is conducted, observing the device current If and the emission current Ie, and terminated when the emission current Ie gets to a saturated level, for instance.

The activating substance may be supplied by passing electric current through the film resistance heater 7 formed in the preceding step and evaporating the activating substance in the activating substance source 8 or by introducing an appropriate substance from a substance feeding device fitted to the vacuum apparatus.

If a carbon compound is used as an activating substance, a component of oil diffusing within the vacuum chamber from an exhaust system equipped with a diffusion pump or a rotary pump involving the use of oil may be utilized. Alternatively, a carbon compound may be introduced into the vacuum chamber after evacuating the inside of the apparatus by means of an ultrahigh vacuum system equipped with an ion pump. Substances that can be suitably used for the purpose of the activation process include aliphatic hydrocarbons such as alkanes, alkenes and alkynes, aromatic hydrocarbons, alcohols, aldehydes, ketones, amines, organic acids such as phenol, carbonic acids and sulfonic acids. Specific examples include saturated hydrocarbons expressed by general formula $C_nH_{2n+2}$ such as methane, ethane and propane, unsaturated hydrocarbons expressed by general formula $C_nH_{2n}$ such as ethylene and propylene, benzene, toluene, methanol, ethanol, formaldehyde, acetaldehyde, acetone, methylethylketone, methylamine, ethylamine, phenol, formic acid, acetic acid and propionic acid.

If a metal compound is used as an activating substance, any of the metal compounds listed above by referring to the activating substance source may be used.

Figure 5C:
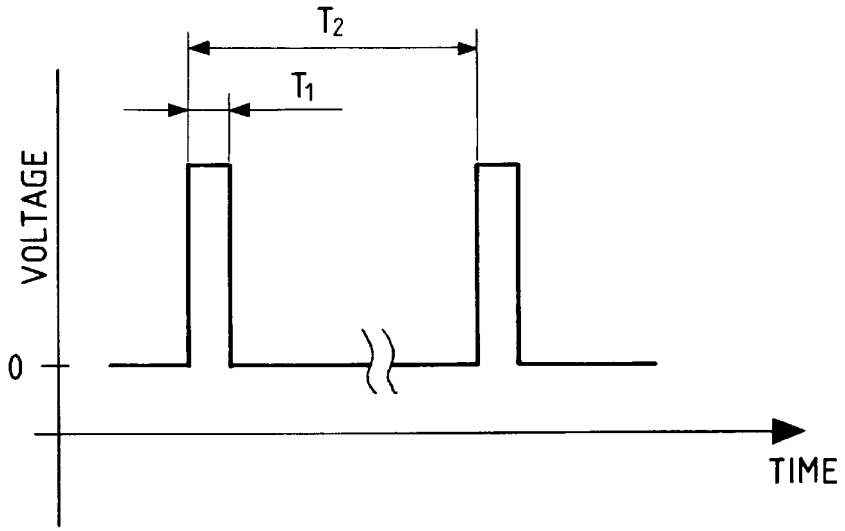
Figure 5D:
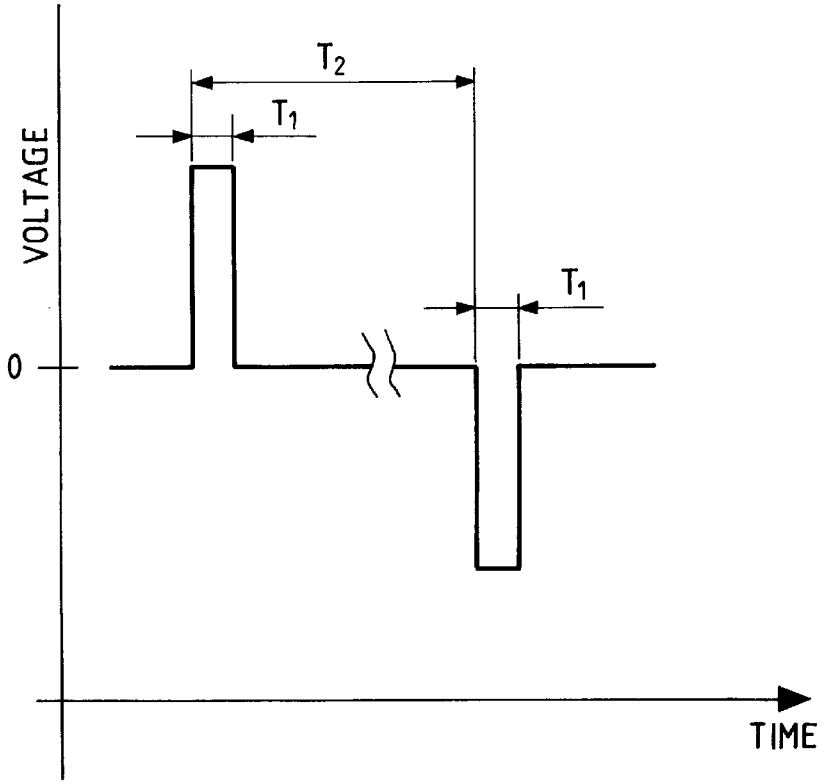

The pulse waveform of the voltage applied to the electron-emitting device in this activation step may be rectangular as shown in FIG. 5C. Alternatively, an alternating rectangular pulse waveform that alternately changes the polarity as shown in FIG. 5D may be used.

6) An electron-emitting device that has been treated in an energization forming process and an activation process is then preferably subjected to a stabilization process. This is a process for removing any activating substance remaining in the vacuum chamber typically through adsorption except the substance existing in the activating substance source 8 arranged on the electron source. The vacuuming and exhausting equipment to be used for this process preferably does not involve the use of oil so that it may not produce any evaporated oil that can adversely affect the performance of the treated device during the process. Thus, the use of asorption pump and an ion pump may be a preferable choice.

The partial pressure of the activating substance in the vacuum chamber is preferably lower than $1\times10^{-6}$ and more preferably lower than $\times10^{-8}$ Pa, in which no carbon or carbon compound is additionally deposited. The vacuum chamber is preferably heated during evacuating so that organic molecules adsorbed by the inner walls of the vacuum chamber and the electron-emitting device(s) in the chamber may also be easily eliminated. While the vacuum chamber is preferably heated to 80 to 250° C. for more than 5 hours in most cases, other heating conditions may alternatively be selected depending on the size and the profile of the vacuum chamber and the configuration of the electron-emitting device(s) in the chamber as well as other considerations. The pressure in the vacuum chamber needs to be made as low as possible and it is preferably lower than $1\times10^{-6}$ Pa and more preferably lower than $1\times10^{-6}$ Pa.

After the stabilization process, the atmosphere for driving the electron-emitting device or the electron source is preferably the same as the one when the stabilization process is completed, although a lower pressure may alternatively be used without damaging the stability of operation of the electron-emitting device or the electron source if the activating substance in the chamber is sufficiently removed.

By using such a vacuum-like atmosphere, the formation of any additional deposit of carbon or a carbon compound can be effectively suppressed and the $H_2O$, $O_2$ and other substances adsorbed to the inner wall surface of the envelope (vacuum chamber) and the outer surface of the substrate can be removed to consequently stabilize the device current If and the emission current Ie.

As described earlier, the carbon, carbon compound or metal deposited on the electron-emitting region can erode to degrade the electron emitting performance of the device but such degradation in the performance of the device can be prevented by passing electric current through the film resistance heater and supplying the activating substance from the activating substance source at a reduced rate in a controlled manner so that the activating substance may not be supplied excessively. Alternatively, the performance of the device may be checked periodically and, if the detected degradation is not negligible, the activating substance may be supplied to the electron-emitting region to recover the performance so that the device may get rid of any practical degradation of performance.

While an electron-emitting device of FIG. 3 is prepared substantially in a manner as described above, the activation step is limited to the technique of introducing an activating substance. With such an electron-emitting device, degradation in the performance of the device may be prevented and a degraded performance of the device may be recovered by feeding part of the electrons emitted from it toward the activating substance source and causing them to collide with the activating substance so that the activating substance may be additionally supplied to the electron-emitting region.

The performance of an electron-emitting device prepared by way of the above processes, to which the present invention is applicable, will be described by referring to FIGS. 6 and 7.

Figure 6:
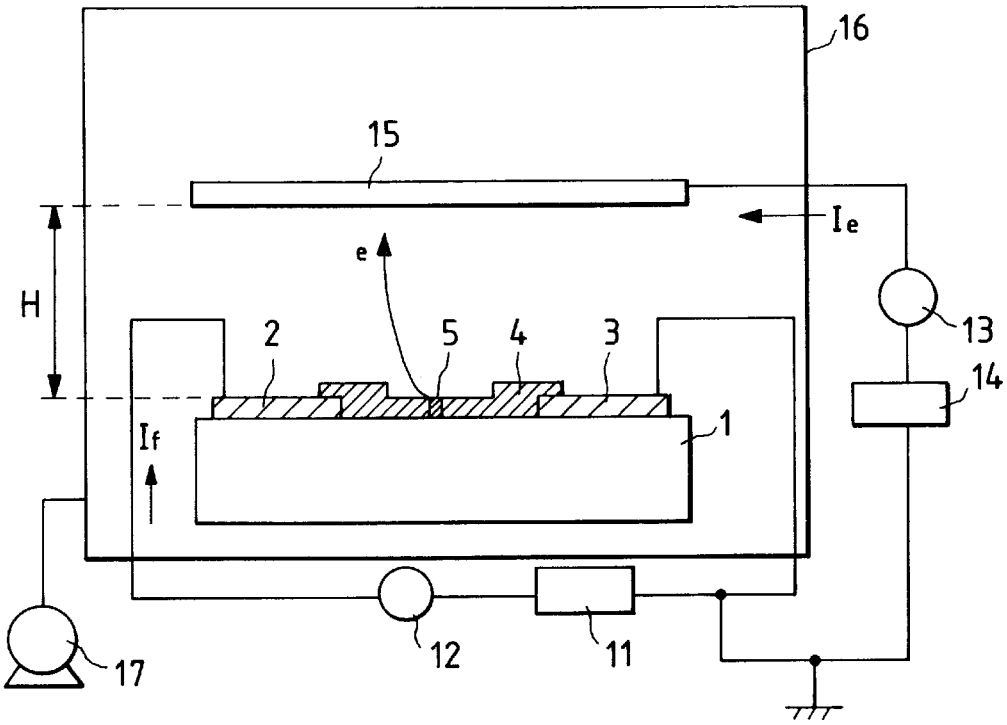
FIG. 6 is a block diagram of a measuring system for determining the electron emitting performance of a surface conduction electron-emitting device.

FIG. 6 is a schematic block diagram of an arrangement of a vacuum treatment equipment that can be used for the above processes. It can also be used as a measuring system for determining the performance of an electron-emitting device of the type under consideration. Referring to FIG. 6, reference numeral 16 denotes a vacuum chamber and reference numeral 17 denotes a vacuum pump. An electron-emitting device is placed in the vacuum chamber 16. The device comprises a substrate 1, a pair of device electrodes 2 and 3, a thin film 4 and an electron-emitting region 5. Otherwise, the measuring system has a power source 11 for applying a device voltage Vf to the device, an ammeter 12 for metering the device current If running through the thin film 4 between the device electrodes 2 and 3, an anode 15 for capturing the emission current Ie produced by electrons emitted from the electron-emitting region of the device, a high voltage source 14 for applying a voltage to the anode 15 of the measuring system and another ammeter 13 for metering the emission current Ie produced by electrons emitted from the electron-emitting region 5 of the device. For determining the performance of the electron-emitting device, a voltage between 1 and 10 kV may be applied to the anode, which is spaced apart from the electron-emitting device by distance H which is between 2 and 8 mm.

Instruments including a pressure gauge and other pieces of equipment necessary for measuring an atmosphere in the vacuum chamber 16 so that the performance of the electron-emitting device or the electron source may be properly tested under desired atmosphere. The vacuum pump 17 may be provided with an ordinary high vacuum system comprising a turbo pump and a rotary pump or the like, and an ultra-high vacuum system comprising an ion pump or the like. The entire vacuum chamber containing an electron source substrate therein can be heated by means of a heater (not shown). While not shown in FIGS. 6 and 7, the measuring system is also provided with a power source for applying a voltage to the electrode for supplying an activating substance so that, whenever necessary, a selected voltage may be applied to the electrode for supplying an activating substance in a coordinated manner as another voltage is applied to the device electrodes from the power source 11. In short, the steps from the energization forming step on can be carried out with the above-described vacuum arrangement.

Figure 7:
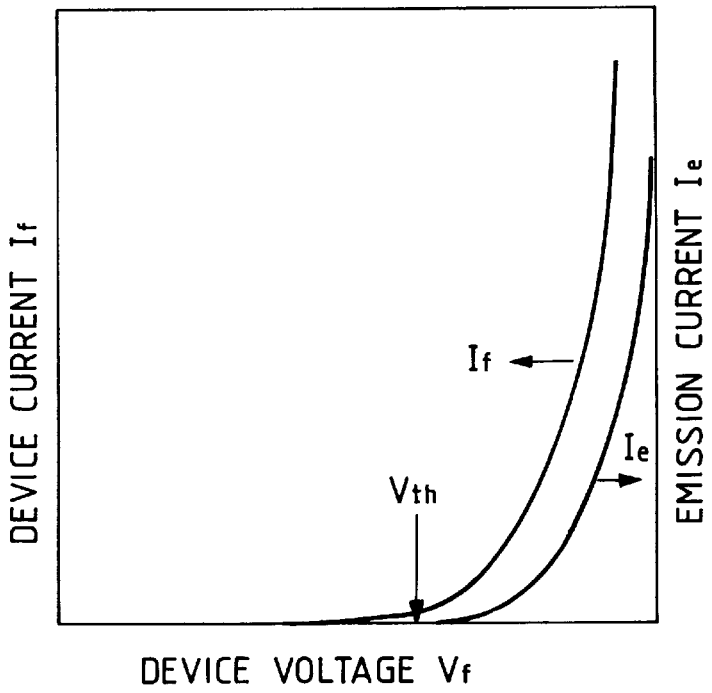
FIG. 7 is a graph showing a typical relationship between the device voltage Vf and the device current If and between the device voltage Vf and the emission current Ie of a surface conduction electron-emitting device or an electron source.

FIG. 7 shows a graph schematically illustrating the relationship between the device voltage Vf and the emission current Ie and the device current If typically observed by the measuring system of FIG. 6. Note that different units are arbitrarily selected for Ie and If in FIG. 7 in view of the fact that Ie has a magnitude by far smaller than that of If. Note that both the vertical and horizontal axes of the graph represent a linear scale.

As seen in FIG. 7, an electron-emitting device that can be used for the purpose of the invention has three remarkable features in terms of emission current Ie, which will be described below.

(i) Firstly, an electron-emitting device according to the invention shows a sudden and sharp increase in the emission current Ie when the voltage applied thereto exceeds a certain level (which is referred to as a threshold voltage hereinafter and indicated by Vth in FIG. 7), whereas the emission current Ie is practically undetectable when the applied voltage is found lower than the threshold value Vth. Differently stated, an electron-emitting device according to the invention is a non-linear device having a clear threshold voltage Vth to the emission current Ie.

(ii) Secondly, since the emission current Ie is highly dependent on the device voltage Vf, the former can be effectively controlled by way of the latter.

(iii) Thirdly, the emitted electric charge captured by the anode 15 is a function of the duration of time of application of the device voltage Vf. In other words, the amount of electric charge captured by the anode 15 can be effectively controlled by way of the time during which the device voltage Vf is applied.

Because of the above remarkable features, it will be understood that the electron-emitting behavior of a surface conduction electron-emitting device that can be used for the purpose of the invention can be controlled as a function of the input signal. Thus, an electron source may be realized by arranging a number of such electron-emitting devices, taking advantage of this controllability, and then such an electron source may be used for an image forming apparatus or some other possible application.

Referring to FIG. 7, the device current If monotonically increases relative to the device voltage Vf (referred to as "MI characteristic" hereinafter). However, it may so change as to show a curve (not shown) specific to a voltage-controlled-negative resistance characteristic (a characteristic referred to as VCNR characteristic" hereinafter). These characteristics of the device current can be controlled by conducting the above steps in a controlled manner. The VCNR characteristic may become apparent when the activating substance is supplied excessively to the electron-emitting region by the means for supplying the activating substance.

A linear or a planar electron source may be realized by arranging a number of surface conduction electron-emitting devices on an insulating substrate and wiring them appropriately. Then, an image forming apparatus may be produced by using such an electron source.

Electron-emitting devices may be arranged on a substrate in a number of different modes.

For instance, a number of electron-emitting devices may be arranged in parallel rows along a direction (hereinafter referred to as row-direction), each device being connected by wires at opposite ends thereof, and driven to operate by control electrodes (hereinafter referred to as grids) arranged in a space above the electron-emitting devices along a direction perpendicular to the row direction (hereinafter referred to as column-direction) to realize a ladder-like arrangement. Alternatively, a plurality of electron-emitting devices may be arranged in rows along an X-direction and columns along a Y-direction to form a matrix, the X- and Y-directions being perpendicular to each other, and the electron-emitting devices on the same row are connected to a common X-directional wire by way of one of the electrodes of each device while the electron-emitting devices on a same column are connected to a common Y-directional wire by way of the other electrode of each device. The latter arrangement is referred to as a simple matrix arrangement. Now, the simple matrix arrangement will be described in detail.

In view of the above-described three basic characteristic features (i) through (iii) of a surface conduction electron-emitting device, to which the invention is applicable, it can be controlled for electron emission by controlling the wave height and the wave width of the pulse voltage applied to the opposite electrodes of the device above the threshold voltage level. On the other hand, the device does not practically emit any electron below the threshold voltage level. Therefore, regardless of the number of electron-emitting devices arranged in an apparatus, desired surface conduction electron-emitting devices can be selected and controlled for electron emission in response to an input signal by applying a pulse voltage to each of the selected devices.

Figure 8:
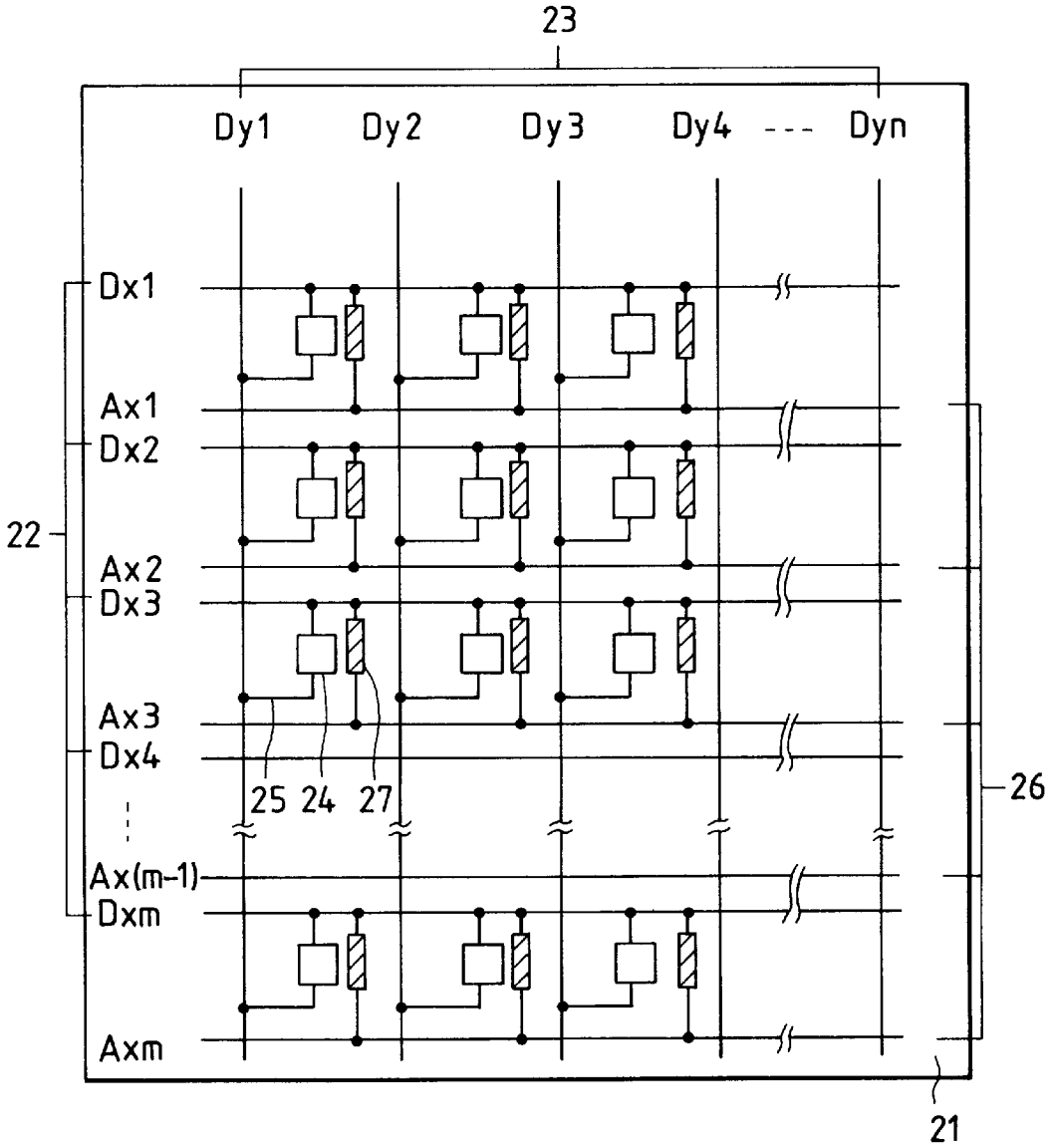
FIG. 8 is a schematic view of an embodiment of an electron source according to the invention.

FIG. 8 is a schematic plan view of the substrate of an electron source realized by arranging a plurality of electron-emitting devices, to which the present invention is applicable, in order to exploit the above characteristic features. In FIG. 8, the electron source comprises a substrate 21, X-directional wires 22, Y-directional wires 23, wires for supplying an activating substance 26, surface conduction electron-emitting devices 24, connecting wires 25 and means for supplying an activating substance 27 consisting of a film resistance heater and an activating substance source. The surface conduction electron-emitting devices 24 may be either of the flat type or of the step type described earlier.

There are provided a total of m X-directional wires 22, which are denoted by Dx1, Dx2, . . . , Dxm respectively and made of an electroconductive metal produced by vacuum evaporation, printing or sputtering. These wires are appropriately designed in terms of material, thickness and width. A total of n Y-directional wires 23 are arranged and denoted by Dy1, Dy2, . . . , Dyn respectively, which are similar to the X-directional wires in terms of material, thickness and width. There are also provided a total of m wires for supplying an activating substance 26, which are denoted by Ax1, Ax2, . . . , Axm respectively and arranged like the X- and Y-directional wires. An interlayer insulation layer (not shown) is disposed between the m X-directional wires 22 and the m wires for supplying an activating substance 26 and the n Y-directional wires to electrically isolate them. (Both m and n are integers.)

The interlayer insulation layer (not shown) is typically made of $SiO_2$ and formed on the entire surface or part of the surface of the insulating substrate carrying the X-directional wires 22 and the wires for supplying an activating substance 26 to show a desired contour by means of vacuum evaporation, printing or sputtering. The thickness, material and manufacturing method of the interlayer insulation layer are so selected as to make it withstand the potential difference between any of the X-directional wires 22 and the wires for supplying an activating substance 26 and any of the Y-directional wires 23 observable at the crossing thereof. Each of the X-directional wires 22, the wires for supplying an activating substance 26 and the Y-directional wires 23 is drawn out to form an external terminal.

The oppositely arranged electrodes (not shown) of each of the surface conduction electron-emitting devices 24 are connected to a related one of the m X-directional wires 22 and a related one of the n Y-directional wires 23 by respective connecting wires 25 which are made of an electroconductive metal.

The electroconductive metal material of the device electrodes and that of the wires 22 and 23 and the connecting wires 25 may be the same or contain a common element as an ingredient. Alternatively, they may be different from each other. These materials may be appropriately selected typically from the candidate materials listed above for the device electrodes. If the device electrodes and the connecting wires are made of a same material, they may be collectively called device electrodes without discriminating the connecting wires.

The X-directional wires 22 are electrically connected to a scan signal application means (not shown) for applying a scan signal to a selected row of surface conduction electron-emitting devices 24. On the other hand, the Y-directional wires 23 are electrically connected to a modulation signal generation means (not shown) for applying a modulation signal to a selected column of surface conduction electron-emitting devices 24 and modulating the selected column according to an input signal. Note that the drive signal to be applied to each surface conduction electron-emitting device is expressed as the voltage difference of the scan signal and the modulation signal applied to the device.

With the above arrangement, each of the devices can be selected and driven to operate independently by means of a simple matrix wire arrangement.

On the other hand, the means for supplying an activating substance can be driven to supply an activating substance on a line-by-line basis as an appropriate voltage is applied between a selected X-directional wire 22 and a corresponding wire for supplying an activating substance 26.

Figure 9A:
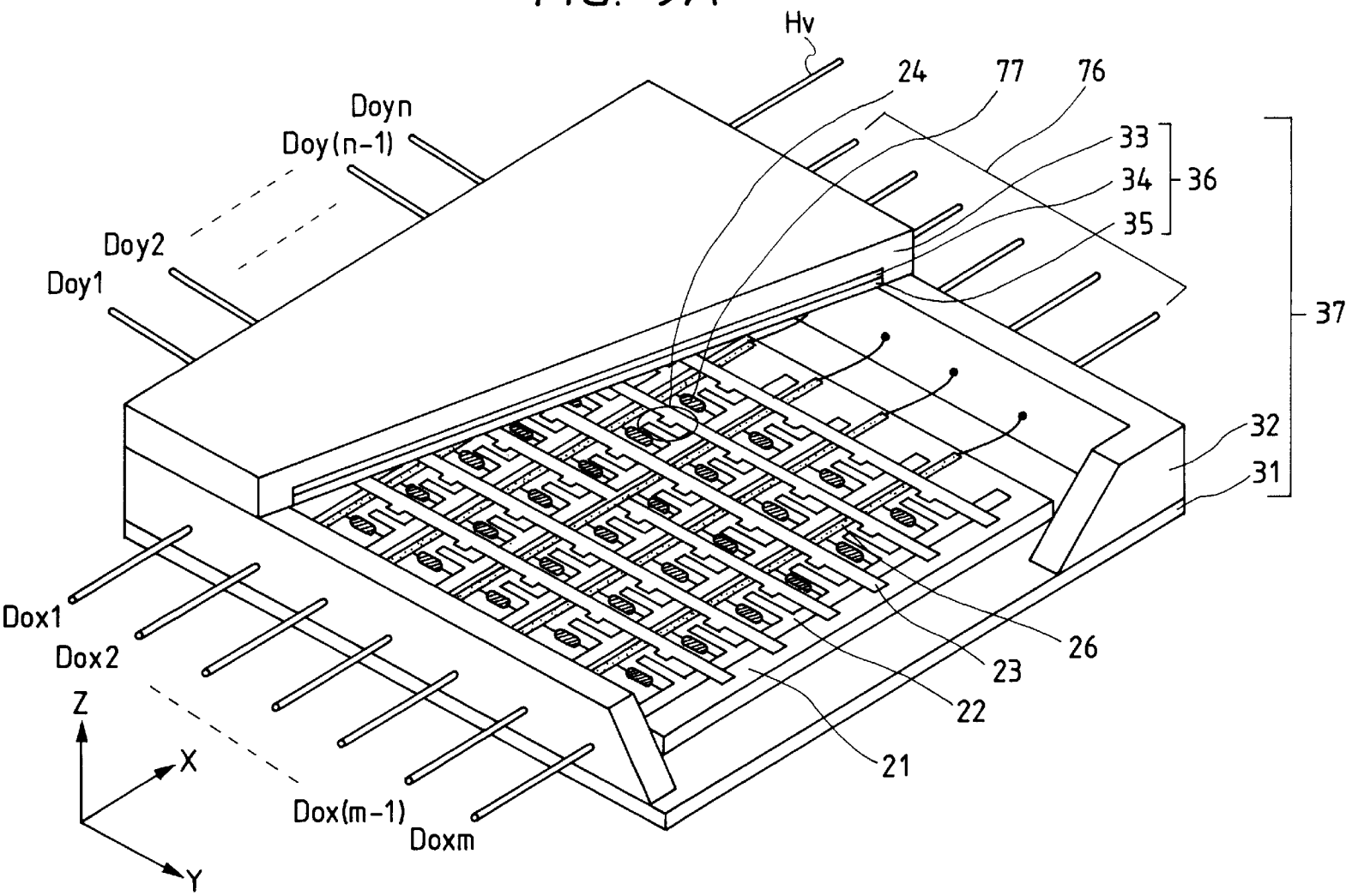
FIG. 9A is a schematic view of an embodiment of an image forming apparatus according to the invention.
Figure 10A:
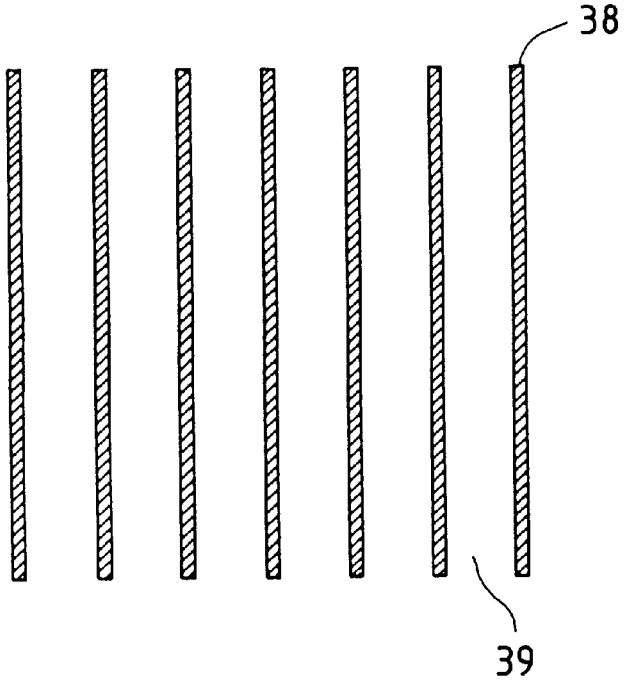
FIG. 10A and 10B are schematic views illustrating two possible configurations of fluorescent film of display panel of an image forming apparatus according to the invention.
Figure 10B:
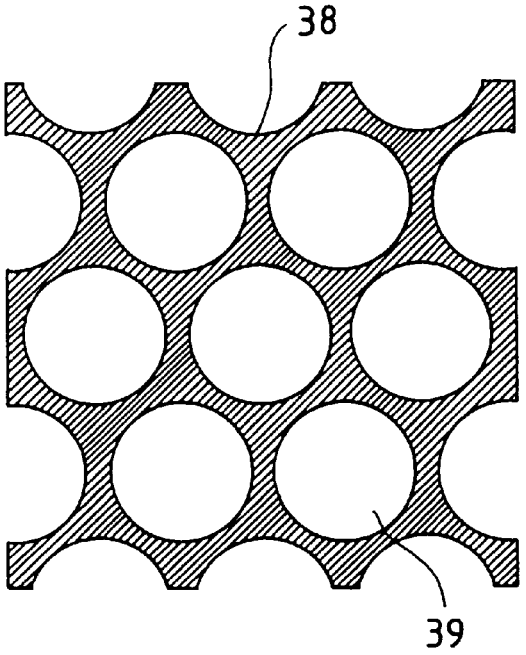
Figure 11:
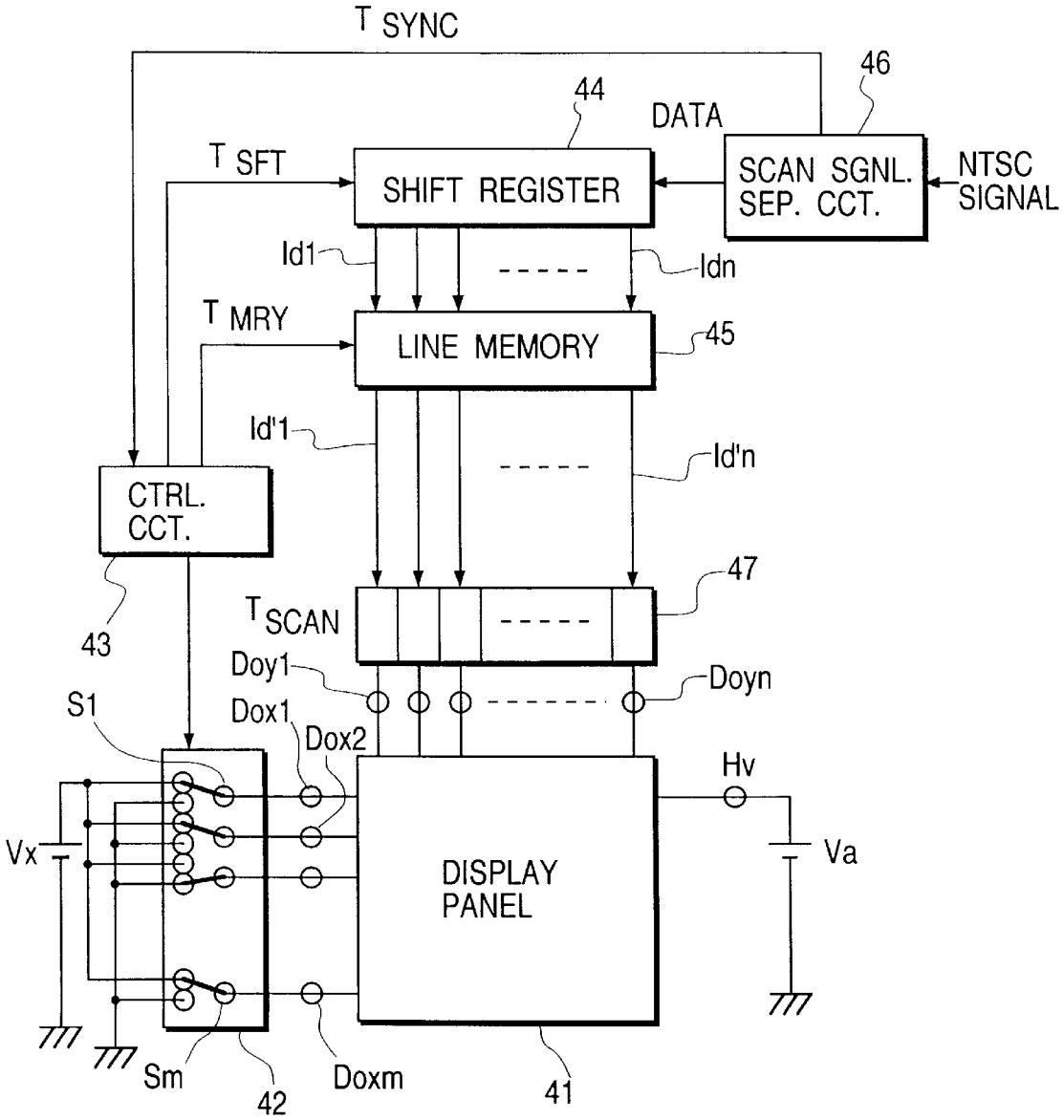
FIG. 11 is a block diagram of a drive circuit of an image forming apparatus for displaying images according to NTSC system television signals.

Now, an image-forming apparatus comprising an electron source having a simple matrix arrangement as described above will be described by referring to FIGS. 9A, 10A, 10B and 11. FIG. 9A is a partially cut-away schematic perspective view of the image forming apparatus and FIGS. 10A and 10B are schematic views, illustrating two possible configurations of a fluorescent film that can be used for the image forming apparatus of FIG. 9A, wehereas FIG. 11 is a block diagram of a drive circuit for the image forming apparatus that operates with NTSC television signals.

Referring firstly to FIG. 9A illustrating the basic configuration of the display panel of the image-forming apparatus, it comprises an electron source substrate 21 of the above-described type carrying thereon a plurality of electron-emitting devices, a rear plate 31 rigidly holding the electron source substrate 21, a face plate 36 prepared by laying a fluorescent film 34 and a metal back 35 on the inner surface of a glass substrate 33 and a support frame 32, to which the rear plate 31 and the face plate 36 are bonded by means of frit glass. Reference numeral 37 denotes an envelope, which is baked to 400 to 500° C. for more than 10 minutes in the atmosphere or in nitrogen and hermetically and airtightly sealed.

In FIG. 9A, reference numeral 24 denotes each of the electron-emitting devices and reference numerals 22 and 23 respectively denote the X-directional wire and the Y-directional wire connected to the respective device electrodes of each of the electron-emitting devices.

While the envelope 37 is formed of the face plate 36, the support frame 32 and the rear plate 31 in the above-described embodiment, the rear plate 31 may be omitted if the substrate 21 is strong enough by itself because the rear plate 31 is provided mainly for reinforcing the substrate 21. If such is the case, an independent rear plate 31 may not be required and the substrate 21 may be directly bonded to the support frame 32 so that the envelope 37 is constituted of a face plate 36, a support frame 32 and a substrate 21.

The overall strength of the envelope 37 may be increased by arranging a number of support members called spacers (not shown) between the face plate 36 and the rear plate 31.

FIGS. 10A and 10B schematically illustrate two possible arrangements of fluorescent film. While the fluorescent film 34 comprises only a single fluorescent body if the display panel is used for showing black and white pictures, it needs to comprise for displaying color pictures black conductive members 38 and fluorescent bodies 39, of which the former are referred to as black stripes or members of a black matrix depending on the arrangement of the fluorescent bodies. Black stripes or members of a black matrix are arranged for a color display panel so that the fluorescent bodies 39 of three different primary colors are made less discriminable and the adverse effect of reducing the contrast of displayed images of external light is weakened by blackening the surrounding areas. While graphite is normally used as a principal ingredient of the black stripes, other conductive materials having low light transmissivity and reflectivity may alternatively be used.

A precipitation or printing technique is suitably used for applying a fluorescent material on the glass substrate regardless of black and white or color display. An ordinary metal back 35 is arranged on the inner surface of the fluorescent film 34. The metal back 35 is provided in order to enhance the luminance of the display panel by causing the rays of light emitted from the fluorescent bodies and directed to the inside of the envelope to turn back toward the face plate 36, to use it as an electrode for applying an accelerating voltage to electron beams and to protect the fluorescent bodies against damages that may be caused when negative ions generated inside the envelope collide with them. It is prepared by smoothing the inner surface of the fluorescent film (in an operation normally called "filming") and forming an Al film thereon by vacuum evaporation after forming the fluorescent film.

A transparent electrode (not shown) may be formed on the face plate 36 facing the outer surface of the fluorescent film 34 in order to raise the conductivity of the fluorescent film 34.

Care should be taken to accurately align each set of color fluorescent bodies and an electron-emitting device, if a color display is involved, before the above-listed components of the envelope are bonded together.

An image forming apparatus as illustrated in FIG. 9A is typically prepared in a manner as described below.

The envelope 37 is evacuated by means of an appropriate vacuum pump such as an ion pump or asorption pump that does not involve the use of oil, while it is being heated as in the case of the above-described stabilization process, until the atmosphere in the inside is reduced to a degree of vacuum of $10^{-5}$ Pa containing an organic substance to a sufficiently low level and then it is hermetically and airtightly sealed. A getter process may be conducted in order to maintain the achieved degree of vacuum in the inside of the envelope 37 after it is sealed. In a getter process, a getter arranged at a predetermined position in the envelope 37 is heated by means of a resistance heater or a high frequency heater to form a film by vapor deposition immediately before or after the envelope 37 is sealed. A getter typically contains Ba as a principal ingredient and can maintain pressure between $1.3\times10^{-4}$ and $1.3\times10^{-5}$ Pa by the adsorption effect of the vapor deposition film. The steps from the energization forming step on to be conducted on the surface conduction electron-emitting devices may be carried out appropriately as described earlier.

Figure 9B:
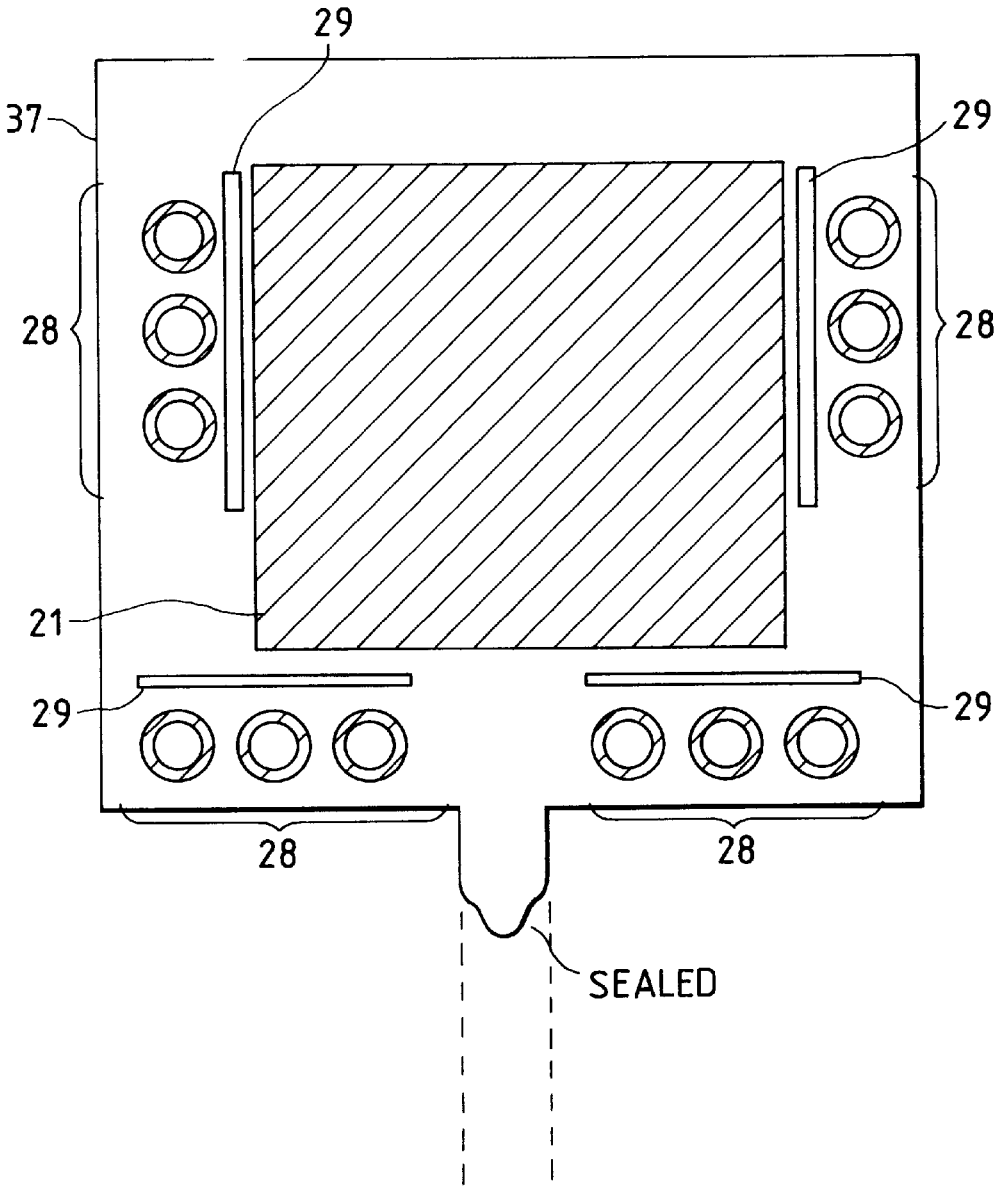
FIG. 9B is a schematic view of a getter arranged within an image forming apparatus according to the invention.

If a getter process is repeated for a number of times as will be described hereinafter, an amount of getter that exceeds the amount to be consumed in this step should be arranged inside the envelope 37. For instance, a getter 28 may be arranged between the envelope 37 and the electron source substrate 21 as schematically illustrated in FIG. 9B. Protecting wall 29 may be arranged to prevent an evaporated getter material from depositing on the electron source substrate to form a getter film there.

Now, a drive circuit for driving a display panel comprising an electron source with a simple matrix arrangement for displaying television images according to NTSC television signals will be described by referring to FIG. 11. In FIG. 11, reference numeral 41 denotes a display panel. Otherwise, the circuit comprises a scan circuit 42, a control circuit 43, a shift register 44, a line memory 45, a synchronizing signal separation circuit 46 and a modulation signal generator 47. Vx and Va in FIG. 11 denote DC voltage sources.

The display panel 41 is connected to external circuits via terminals Dox1 through Doxm, Doy1 through Doyn and high voltage terminal Hv, of which terminals Dox1 through Doxm are designed to receive scan signals for sequentially driving on a one-by-one basis the rows (of N devices) of an electron source in the apparatus comprising a number of surface-conduction type electron-emitting devices arranged in the form of a matrix having M rows and N columns.

On the other hand, terminals Doy1 through Doyn are designed to receive a modulation signal for controlling the output electron beam of each of the surface-conduction type electron-emitting devices of a row selected by a scan signal. High voltage terminal Hv is fed by the DC voltage source Va with a DC voltage of a level typically around 100 kV, which is sufficiently high to energize the fluorescent bodies of the selected surface-conduction type electron-emitting devices.

The scan circuit 42 operates in a manner as follows. The circuit comprises M switching devices (of which only devices S1 and Sm are specifically indicated in FIG. 13), each of which takes either the output voltage of the DC voltage source Vx or 0[V] (the ground potential level) and comes to be connected with one of the terminals Dox1 through Doxm of the display panel 41. Each of the switching devices S1 through Sm operates in accordance with control signal Tscan fed from the control circuit 43 and can be prepared by combining transistors such as FETs.

The DC voltage source Vx of this circuit is designed to output a constant voltage such that any drive voltage applied to devices that are not being scanned due to the performance of the surface conduction electron-emitting devices (or the threshold voltage for electron emission) is reduced to less than threshold voltage.

The control circuit 43 coordinates the operations of related components so that images may be appropriately displayed in accordance with externally fed video signals. It generates control signals Tscan, Tsft and Tmry in response to synchronizing signal Tsync fed from the synchronizing signal separation circuit 46, which will be described below.

The synchronizing signal separation circuit 46 separates the synchronizing signal component and the luminance signal component from an externally fed NTSC television signal and can be easily realized using a popularly known frequency separation (filter) circuit. Although a synchronizing signal extracted from a television signal by the synchronizing signal separation circuit 46 is constituted, as well known, of a vertical synchronizing signal and a horizontal synchronizing signal, it is simply designated as Tsync signal here for convenience sake, disregarding its component signals. On the other hand, a luminance signal drawn from a television signal, which is fed to the shift register 44, is designed as DATA signal.

The shift register 44 carries out for each line a serial/parallel conversion on DATA signals that are serially fed on a time series basis in accordance with control signal Tsft fed from the control circuit 43. (In other words, a control signal Tsft operates as a shift clock for the shift register 44.) A set of data for a line that have undergone a serial/parallel conversion (and correspond to a set of drive data for N electron-emitting devices) are sent out of the shift register 44 as N parallel signals Idl through Idn.

The line memory 45 is a memory for storing a set of data for a line, which are signals Idl through Idn, for a required period of time according to control signal Tmry coming from the control circuit 43. The stored data are sent out as signals I'dl through I'dn to a modulation signal generator 47.

Said modulation signal generator 47 is in fact a signal source that appropriately drives and modulates the operation of each of the surface-conduction type electron-emitting devices according to each of the image data I'dl through I'dn and output signals of this device are fed to the surface-conduction type electron-emitting devices in the display panel 41 via terminals Doyl through Doyn.

As described above, an electron-emitting device, to which the present invention is applicable, is characterized by the following features in terms of emission current Ie. Firstly, there exists a clear threshold voltage Vth and the device emit electrons only a voltage exceeding Vth is applied thereto. Secondly, the level of emission current Ie changes as a function of the change in the applied voltage above the threshold level Vth. More specifically, when a pulse-shaped voltage is applied to an electron-emitting device according to the invention, practically no emission current is generated so far as the applied voltage remains under the threshold level, whereas an electron beam is emitted once the applied voltage rises above the threshold level. It should be noted here that the intensity of an output electron beam can be controlled by changing the peak level Vm of the pulse-shaped voltage. Additionally, the total amount of electric charge of an electron beam can be controlled by varying the pulse width Pw.

Thus, either a voltage modulation method or a pulse width modulation method may be used for modulating an electron-emitting device in response to an input signal. With voltage modulation, a voltage modulation type circuit is used for the modulation signal generator 47 so that the peak level of the pulse-shaped voltage is modulated according to input data, while the pulse width is held constant.

With pulse width modulation, on the other hand, a pulse width modulation type circuit is used for the modulation signal generator 47 so that the pulse width of the applied voltage may be modulated according to input data, while the peak level of the applied voltage is held constant.

Although it is not particularly mentioned above, the shift register 44 and the line memory 45 may be either of digital or of analog signal type so long as serial/parallel conversions and storage of video signals are conducted at a given rate.

If digital signal type devices are used, output signal DATA of the synchronizing signal separation circuit 46 needs to be digitized. However, such conversion can be easily carried out by arranging an A/D converter at the output of the synchronizing signal separation circuit 46. It may be needless to say that different circuits may be used for the modulation signal generator 47 depending on if output signals of the line memory 45 are digital signals or analog signals. If digital signals are used, a D/A converter circuit of a known type may be used for the modulation signal generator 47 and an amplifier circuit may additionally be used, if necessary. As for pulse width modulation, the modulation signal generator 47 can be realized by using a circuit that combines a high speed oscillator, a counter for counting the number of waves generated by said oscillator and a comparator for comparing the output of the counter and that of the memory. If necessary, an amplifier may be added to amplify the voltage of the output signal of the comparator having a modulated pulse width to the level of the drive voltage of a surface-conduction type electron-emitting device according to the invention.

If, on the other hand, analog signals are used with voltage modulation, an amplifier circuit comprising a known operational amplifier may suitably be used for the modulation signal generator 47 and a level shift circuit may be added thereto if necessary. As for pulse width modulation, a known voltage control type oscillation circuit (VCO) may be used with, if necessary, an additional amplifier to be used for voltage amplification up to the drive voltage of the surface-conduction type electron-emitting device.

With an image forming apparatus having a configuration as described above, to which the present invention is applicable, the electron-emitting devices emit electrons as a voltage is applied thereto by way of the external terminals Doxl through Doxm and Doyl through Doyn. Then, the generated electron beams are accelerated by applying a high voltage to the metal back 35 or a transparent electrode (not shown) by way of the high voltage terminal Hv. The accelerated electrons eventually collide with the fluorescent film 34, which in turn glows to produce images.

The above-described configuration of image forming apparatus is only an example to which the present invention is applicable and may be subjected to various modifications. The TV signal system to be used with such an apparatus is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel comprising a large number of pixels.

Now, an electron source comprising a plurality of surface conduction electron-emitting devices arranged in a ladder-like manner on a substrate and an image-forming apparatus comprising such an electron source will be described by referring to FIGS. 12 and 13.

Figure 12:
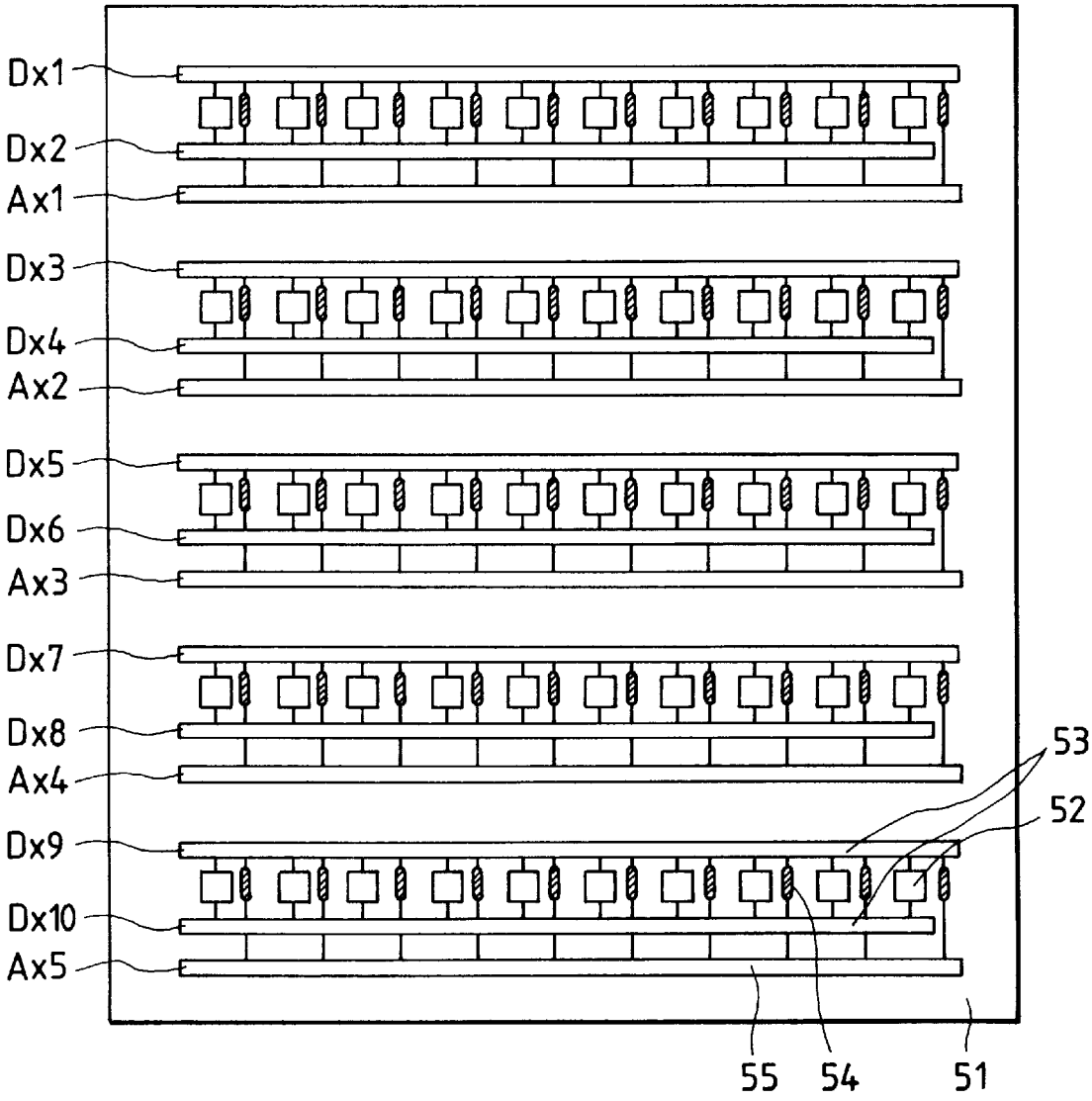
FIG. 12 is a schematic view of another embodiment of an electron source according to the invention.

Firstly referring to FIG. 12, reference numeral 51 denotes an electron source substrate and reference numeral 52 denotes a surface conduction electron-emitting device arranged on the substrate, whereas reference numeral 53 denotes common wires Dx1 through Dx10 for connecting the surface conduction electron-emitting devices 52. The electron-emitting devices 52 are arranged in rows along the X-direction (to be referred to as device rows hereinafter) on the substrate 51 to form an electron source comprising a plurality of device rows, each row having a plurality of devices. The surface conduction electron-emitting devices of each device row are electrically connected in parallel with each other by a pair of common wires so that they can be driven independently by applying an appropriate drive voltage to the pair of common wires. More specifically, a voltage exceeding the electron emission threshold level is applied to the device rows to be driven to emit electrons, whereas a voltage below the electron emission threshold level is applied to the remaining device rows. Alternatively, any two external terminals arranged between two adjacent device rows can share a single common wire. Thus, of the common wires Dx2 through Dx9, Dx2 and Dx3 can share a single common wire instead of two wires.

Reference numeral 54 denotes means for supplying an activating substance typically consisting of a film resistance heater and an activating substance source, each of said means being arranged close to a corresponding electron-emitting device 52. Each of said means for supplying an activating substance 54 is connected to one of the related common wires (Dx1, Dx3, . . . , Dxm) and a related one of the wires for supplying an activating substance 55 (Ax1, Ax2, . . . , Axm) so that the activating substance may be applied to the electron-emitting device as a voltage is applied thereto.

Figure 13:
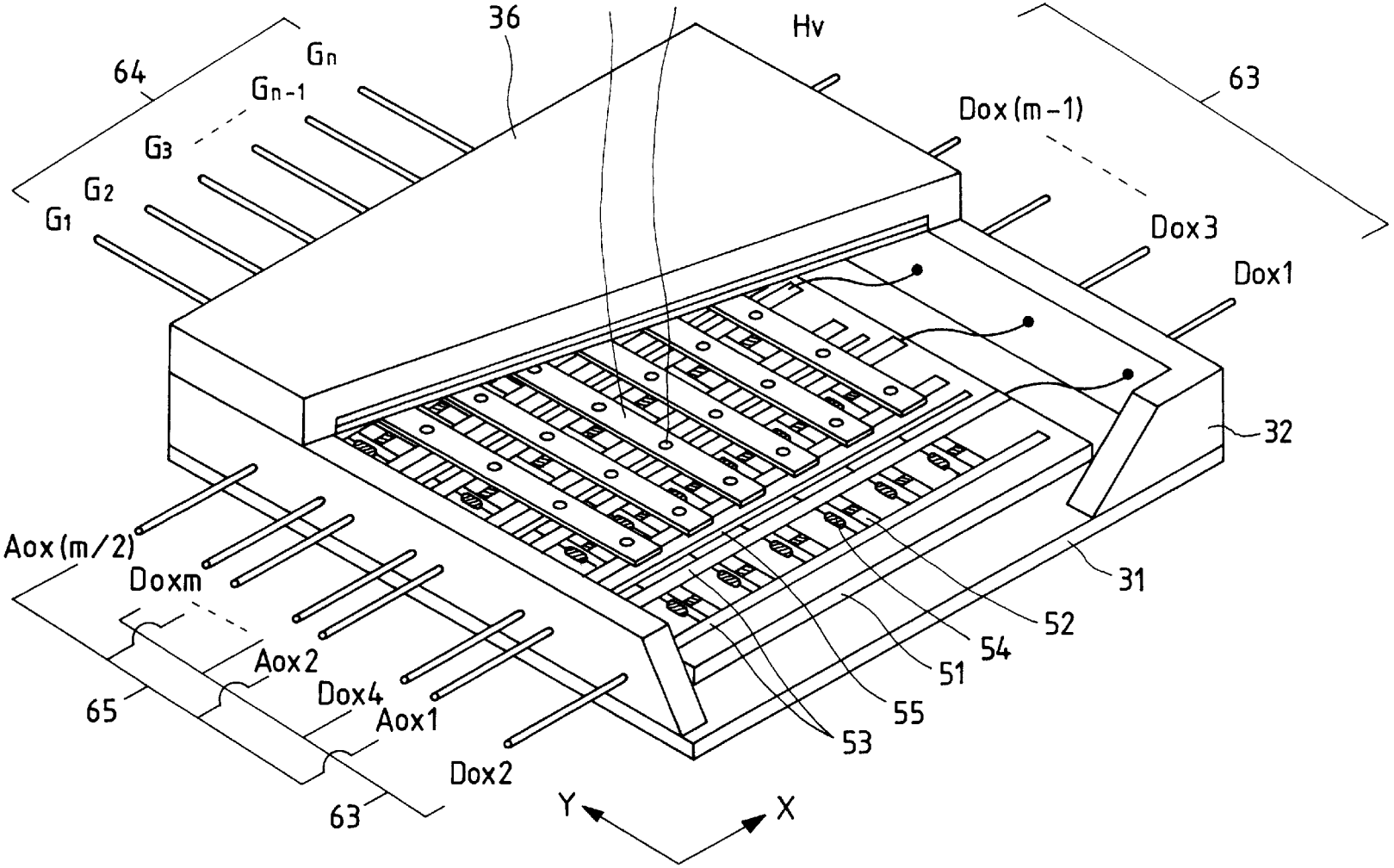
FIG. 13 is a schematic view of another embodiment of an image forming apparatus according to the invention.

FIG. 13 is a schematic perspective view of the display panel of an image-forming apparatus incorporating an electron source having a ladder-like arrangement of electron-emitting devices. In FIG. 13, the display panel comprises grid electrodes 61, each provided with a number of bores 62 for allowing electrons to pass therethrough, a set of external terminals 63 denoted by Dox1, Dox2, . . . , Doxm along with another set of external terminals 64 denoted by G1, G2, . . . , Gn and connected to the respective grid electrodes 61, and external terminals 65 denoted by Aox1, Aox2, . . . , Aox(m/2) for supplying an activating substance. Note that, in FIG. 13, the components the same as those of FIGS. 9A and 12 are denoted respectively by the same reference symbols. The image forming apparatus shown there differs from the image forming apparatus with a simple matrix arrangement of FIG. 9A mainly in that the apparatus of FIG. 13 has grid electrodes 61 arranged between the electron source substrate 51 and the face plate 36.

In FIG. 13, the stripe-shaped grid electrodes 61 are arranged between the substrate 51 and the face plate 36 perpendicularly relative to the ladder-like device rows for modulating electron beams emitted from the surface conduction electron-emitting devices, each provided with through bores 62 in correspondence to respective electron-emitting devices for allowing electron beams to pass therethrough. Note that, however, while stripe-shaped grid electrodes are shown in FIG. 13, the profile and the locations of the electrodes are not limited thereto. For example, they may alternatively be provided with mesh-like openings and arranged around or close to the surface conduction electron-emitting devices.

The external terminals 63 and the external terminals 64 for the grids are electrically connected to a control circuit (not shown).

An image-forming apparatus having a configuration as described above can be operated for electron beam irradiation by simultaneously applying modulation signals to the rows of grid electrodes for a single line of an image in synchronism with the operation of driving (scanning) the electro n-emitting devices on a row-by-row basis so that the image can be displayed on a line-by-line basis.

While each of the electron-emitting devices of the above-described image forming apparatus is provided with means for supplying an activating substance arranged on the insulating substrate and located close to the corresponding electron-emitting device, said means may be replaced or used in combination with other means for supplying an activating substance provided independently from the electron-emitting devices and arranged within the vacuum envelope of the image forming apparatus or outside the envelope and connected thereto.

Regardless of matrix or ladder-like arrangement, the image forming apparatus can be made to operate stably without losing the quality of performance after the end of the stabilization step by repeatedly carrying out a getter process after hermetically sealing the envelope and supplying an activating substance by any of the above-described methods.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an optical printer comprising a photosensitive drum and in many other ways.

EXAMPLES

Now, the present invention will be described by way of examples.

Example 1

FIGS. 14A through 14D schematically illustrate an electron source in this example. As shown in FIGS. 14A through 14D, a surface conduction electron-emitting device o f the electron source of the example is constituted by a pair of device electrodes 2 and 3 and an electroconductive thin film 4 including an electron-emitting region 5, while means for supplying an activating substance is constituted by a pair of electrodes 2 and 6, a film resistance heater 7 and an activating substance source 8. While the arrangement of this example is similar to that of FIGS. 1A through 1C, the former differs from the latter in that a pair of means for supplying an activating substance are arranged along the respective lateral sides of the electron-emitting region.

Figure 14A:
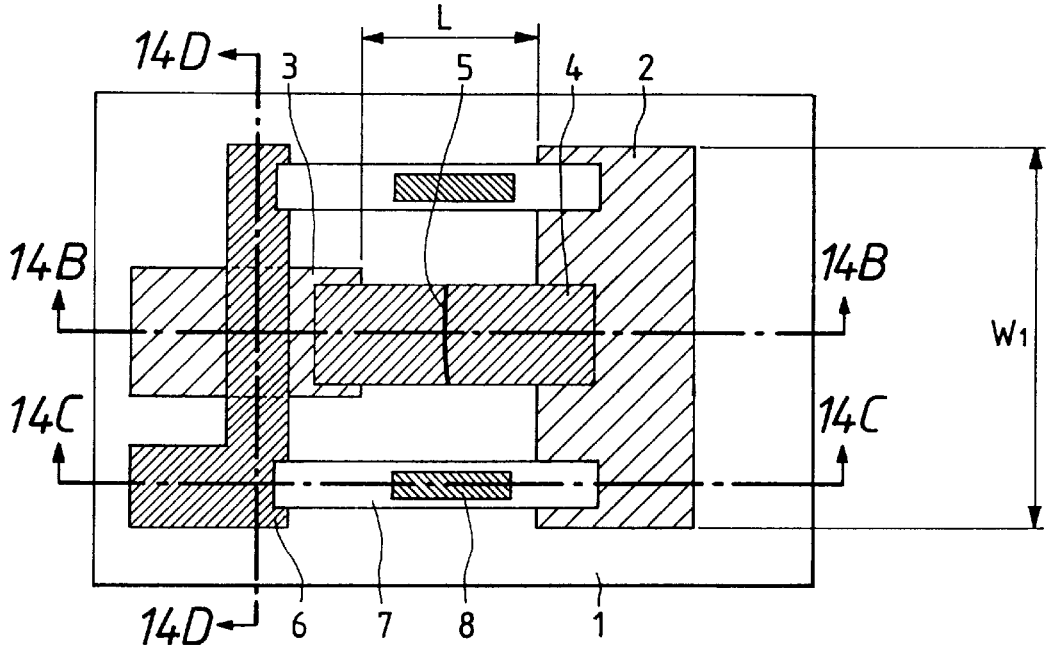
FIGS. 14A through 14D are schematic views of the surface conduction electron-emitting device of Example 1.
Figure 14B:
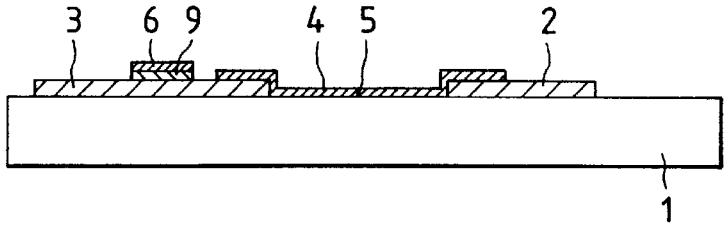
Figure 14C:
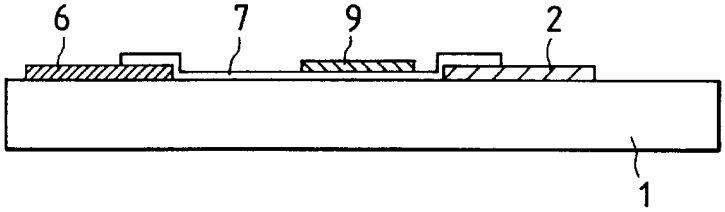
Figure 14D:
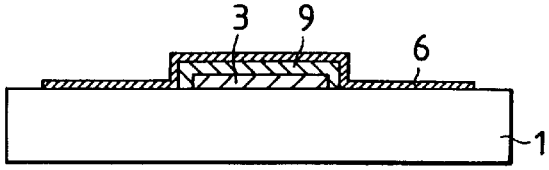

FIG. 14A is a schematic plan view of the arrangement of this example, whereas FIGS. 14B, 14C and 14D are schematic sectional views respectively taken along lines 14B—14B, 14C—14C and 14D—14D. The device electrode 3 and the electrode for supplying an activating substance 6 are electrically isolated from each other by means of an insulation layer 9.

The process employed for manufacturing the electron source of this example will be described by referring to FIGS. 15A through 15J and FIG. 15L.

Figure 15A:
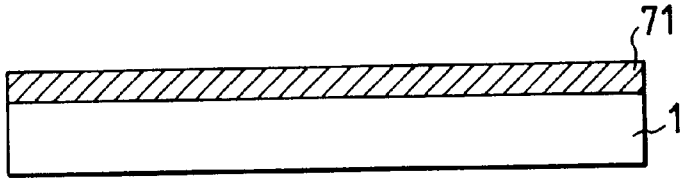
FIGS. 15A through 15J and FIG. 15L are schematic views of the surface conduction electron-emitting device of Example 1 in different manufacturing steps.
Figure 15B:
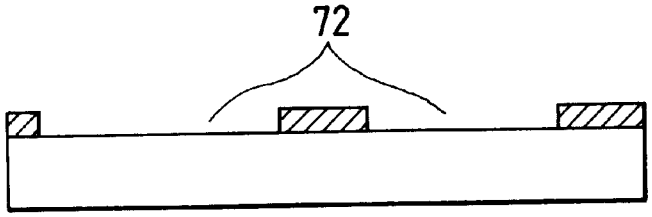
Figure 15C:
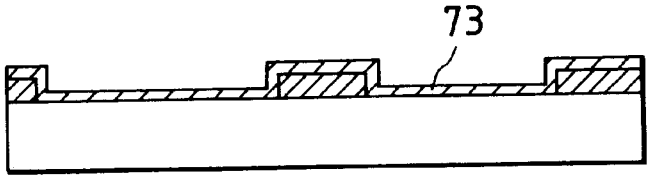
Figure 15D:
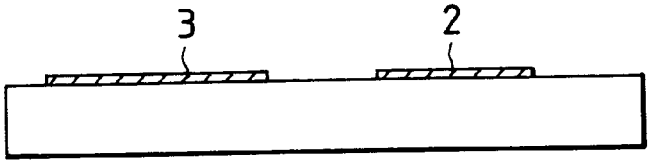

(a) After thoroughly cleansing a quartz substrate 1 and drying it, photoresist (RD-2000N-41: available from Hitachi Chemical Co., Ltd.) was applied thereto by means of a spinner and then subjected to a pre-baking operation at 80° C. for 25 minutes to produce a photoresist layer 71. (FIG. 15A)

(b) The substrate was exposed to light, using a photomask, to form the pattern of the pair of device electrode and the exposed photoresist was photochemically developed. Thereafter, openings 72 having profiles corresponding to those of the device electrodes were formed and the photoresist was subjected to a post-baking operation at 120° C. for 20 minutes. (FIG. 15B or cross section along line 14B—14B in FIG. 14A)

(c) An Ni film 73 was formed by vacuum evaporation to a film thickness of 100 nm. (FIG. 15C or cross section along line 14B—14B in FIG. 14A)

(d) The resist was dissolved into acetone and the device electrodes 2 and 3 were formed by lift-off and cleansed with acetone, isopropylalcohol (IPA) and then butyl acetate. Thereafter, the substrate carrying the formed device electrodes was dried. (FIG. 15D or cross section along line 14B—14B in FIG. 14A)

Figure 15E:
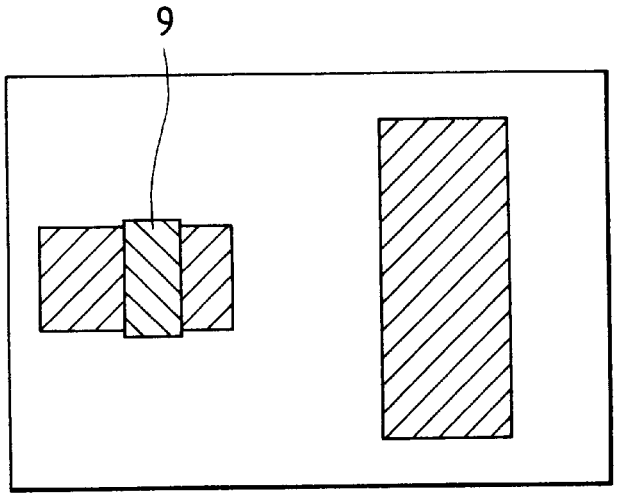

(e) An $SiO_2$ film was formed to a thickness of 600 nm by sputtering and the pattern of the insulating layer 9 was formed with photoresist, which was then etched with $CF_4$ and $H_2$ to produce the insulation layer 9. (FIG. 15E or the plan view)

Figure 15F:
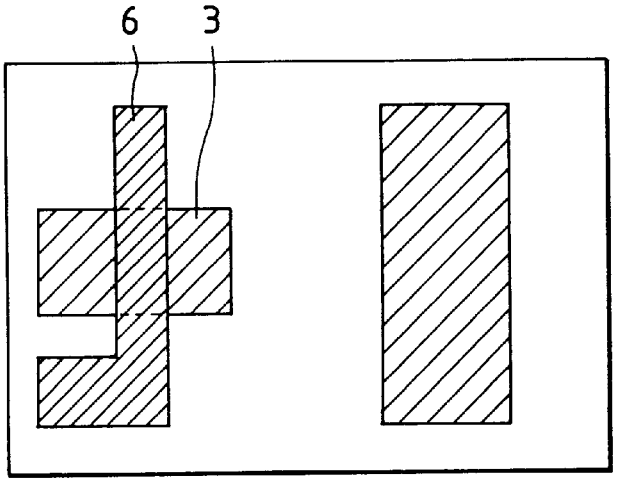

(f) An electrode for supplying an activating substance 6 was formed, following the steps (a) through (d) above. (FIG. 15F or the plan view)

Figure 15G:
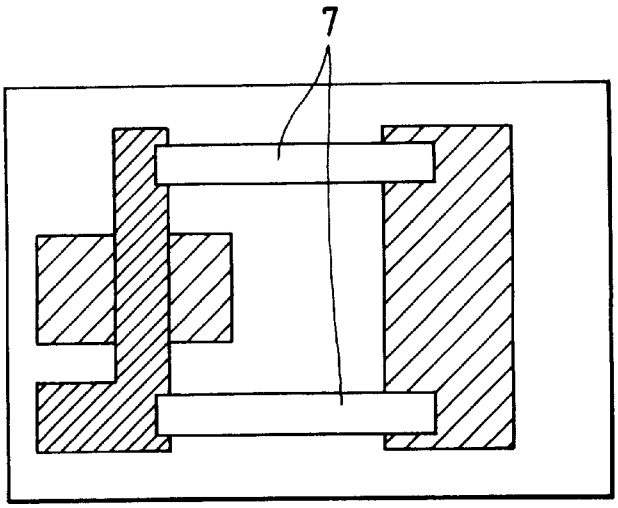
Figure 15H:
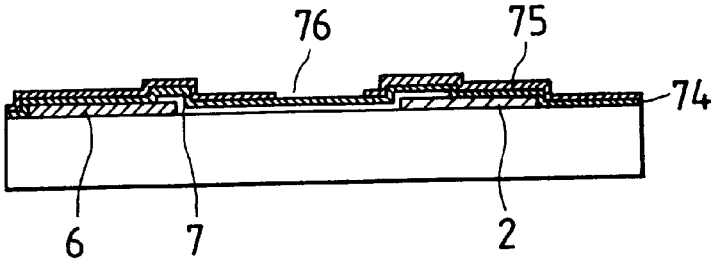
Figure 15I:
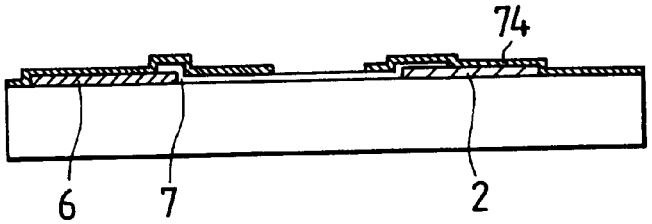
Figure 15J:
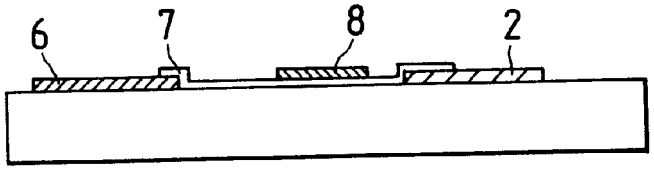
Figure 15L:
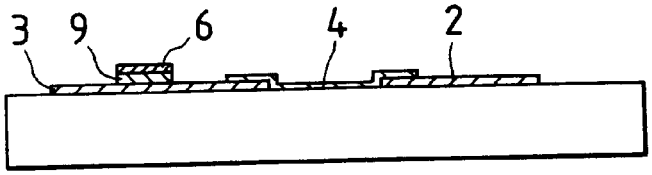

(g) An ITO($In_2O_3$—$SnO_2$) film was formed by sputtering. Photoresist (AZ-1370: available from Hoechst Corporation) was applied thereon by means of a spinner and subjected to a pre-baking operation at 90° C. for 30 minutes. Thereafter, a photomask was used to expose the photoresist to light, which was then photochemically developed and subjected to a post-baking operation at 120° C. for 20 minutes. Then, the photoresist was dry-etched, using the photomask to produce a film resistance heater 7 of ITO. The film showed an electric resistance of Rs≈100 Ω/□. (FIG. 15G or the plan view).

(h) A Cr film 74 having a film thickness of 50 nm was formed by vacuum evaporation. Subsequently, photoresist (AZ-1370) was applied thereto by means of a spinner and subjected to a pre-baking operation as described above to produce a photoresist layer 75, which was then exposed to light, photochemically developed and subjected to a post-baking operation to produce an opening 76 having a profile corresponding to that of the activating substance source to be formed. (FIG. 15H or a cross section along line 14C—14C in FIG. 14A)

(i) The device was then immersed into an etchant for 30 seconds to remove the Cr film under the above opening. The etchant has a composition of $(NH_4)Ce(NO_3)_6/HClO_4/H_2O$= 17 g/5 cc/100 cc. The resist was then dissolved into acetone to form a Cr mask. (FIG. 15I or a cross section along line 14C—14C in FIG. 14A)

(j) A methylethylketone solution containing 3% polyvinylacetate was applied to the device by means of a spinner and heated to dry at 60° C. for 10 minutes. Thereafter, the Cr mask was removed with the above etchant and a polyvinylacetate film was formed for an activating substance source 8 by lift-off. (FIG. 15J or a cross section along line 14C—14C in FIG. 14A)

(k) A Cr mask having an opening with a profile corresponding to that of the electroconductive thin film to be formed there was produced by following the steps (h) through (i) above.

(l) A butylacetate solution of Pd amine complex (ccp4230: available from Okuno Pharmaceutical Co., Ltd.) was applied to the Cr film by means of a spinner and baked at 300° C. for 10 minutes. Then, the Cr film was removed to produce an electroconductive thin film 4 principally made of fine particles containing palladium oxide (PdO) as a principal ingredient and had a film thickness of about 10 nm. The electroconductive thin film showed an electric resistance of Rs=5×104>>Ω/□. (FIG. 15L or a cross section along line 14B—14B in FIG. 14A)

In the above example, the distance separating the device electrodes was L=2 pm, which had a width of W1=500 pm.

(m) The prepared device was then placed in the vacuum chamber of a vacuum system of FIG. 6, which was then evacuated to a pressure level of $2.7\times10^{-5}$ Pa. Then, a pulse voltage was applied to the device electrodes 2 and 3 from a power source 11 to carry out an energization forming operation. In this operation, the electric potential of the electrode for supplying an activating substance 6 as shown in FIG. 14A was made equal to that of the device electrode 2 and no voltage was applied to the film resistance heater 7.

The waveform of the applied pulse voltage was a triangular pulse with a gradually increasing wave height. The pulse width of T1=1 msec. and the pulse interval of T2=10 msec. were used. During the energization forming process, an extra pulse voltage of 0.1V was inserted into intervals of the forming pulse voltage in order to determine the resistance of the electroconductive film and the forming process was terminated when the resistance exceeded 1MΩ. The peak value of the pulse voltage was 5.0V when the forming process was terminated. An electron-emitting region 5 was produced in the electroconductive thin film 4 as a result of this energization forming operation.

(n) Subsequently, the electron source was subjected to an activation process i n the vacuum chamber, introducing acetone into the chamber and maintaining the partial pressure of acetone in the vacuum chamber to about $1.3\times10^{-2}$ Pa. A pulse voltage was then applied to the device electrodes 2 and 3 in the vacuum chamber. No voltage was applied to the film resistance heater 7 shown in FIG. 14A during this operation as in the case of Step(m) above. A rectangular pulse voltage having a pulse width of T1=100 μsec. and a pulse interval of T2=10 msec. was used. The wave height of the pulse voltage was gradually raised from 10V to 14V at a rate of 3.3 mV/sec.

Thereafter, the application of pulse voltage was stopped and the acetone remaining in the inside of the vacuum chamber was removed. As a result of this operation, carbon or a carbon compound was deposited near the electron-emitting region 5.

The performance of the prepared electron source was then tested with the same system. The internal pressure in the vacuum chamber 16 was held below $1.3\times10^{-6}$ Pa and the anode was separated from the device by a distance of H=4 mm. A rectangular pulse voltage having a wave height of 14 V, a pulse width of T1–100 μsec. and a pulse interval of 10 msec. was applied between the device electrodes 2 and 3. Similarly, a rectangular pulse voltage having a wave height of 5V, a pulse width of T1=50 μsec. and a pulse interval of 10 msec. was applied between the device electrode 2 and the electrode for supplying an activating substance 6. The application of the two pulse voltages was so controlled for timing that they might not be turned on simultaneously.

The time of the start of the measuring operation is defined as τ=0 and the device current If(τ) and the emission current Ie(τ) were measured. The reduction ratio of If and that of Ie are defined as follows to evaluate them:

In this example, If(0)=1.8 mA and Ie(0)=0.9 μA. Thus, if η(τ)=Ie(τ)/If(τ), η(0)=0.05%. So, the reduction ratios after an hour were δIf(1 hour)=5% and dIe(1 hour)=5%.

Example 2

An electron source having a configuration as shown in FIGS. 14A through 14D was prepared as in the case of Example 1 and was then tested for performance. The electron source was driven to operate without applying any voltage between the device electrode 2 and the electrode for supplying an activating substance 6. The performance at the start of the operation was equal to that of the electron source of Example 1, although the reduction ratios of If and Ie were respectively δIf(1 hour)=20% and δIe(1 hour)=25%.

Thereafter, while heating the film resistance heater 7 by applying a pulse voltage between the device electrode 2 and the electrode for supplying an activating substance 6 and electrically energizing the film resistance heater 7, another pulse voltage was applied between the device electrodes 2 and 3 to drive the electron source for operation. The pulse voltage applied between the device electrode 2 and the electrode for supplying an activating substance 6 was a rectangular pulse voltage having a wave height of 5V and a pulse width of 200 μsec. The application of the two pulse voltages was so controlled for timing that they might not be turned on simultaneously. After continuing the operation for 3 minutes, the application of the voltages was stopped.

Then, after waiting for 5 minutes in order to cool the activating substance source, the operation of driving the electron source was resumed to obtain values of If=1.5 mA and Ie=0.8 μA, which proved that the electron emitting performance of the electron source was recovered.

Example 3

Figure 16H:
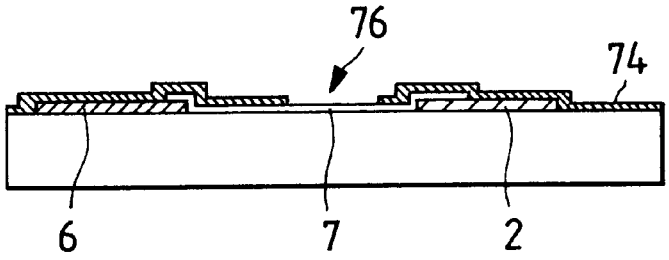
FIGS. 16H, 16J and 16K are schematic views of the surface conduction electron-emitting device of Example 3 in different manufacturing steps.
Figure 16J:
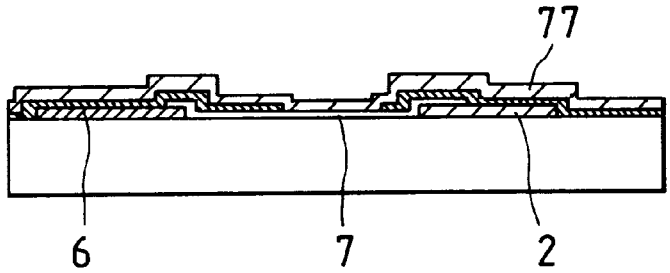
Figure 16K:
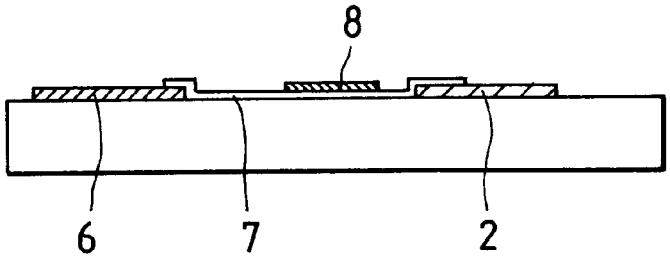

The electron source prepared in this example had a configuration substantially the same as that of the electron source of Example 1. Therefore, only the manufacturing steps that are different from their counterparts of Example 1 will be described below by referring to FIGS. 16H, 16J and 16K.

Steps (a) through (g) of Example 1 were followed. Thereafter, the following steps were carried out:

(h) Photoresist (AZ-1370) was applied thereto by means of a spinner and subjected to a pre-baking operation at 90° C. for 30 minutes to produce a photoresist layer 74, which was then exposed to light, photochemically developed and subjected to a post-baking operation to produce an opening 76 having a profile corresponding to that of the activating substance source to be formed. (FIG. 16H or a cross section along line 14C—14C in FIG. 14A)

(i) An aqueous solution containing 2% palyvinylalcohol (PVA) was applied thereto by means of a spinner and heated to dry at 60° C. for 10 minutes to produce a PVA layer 77. (FIG. 16J or a cross section along line 14C—14C in FIG. 14A)

(j) The photoresist was then dissolved into acetone and the PVA layer was subjected to a patterning operation to produce a desired pattern by means of lift-off, which was then heated and baked at 300° C. to produce an activating substance source 8. (FIG. 16K or a cross section along line 14C—14C in FIG. 14A) Then, Steps (k) through (n) of Example 1 were followed to produce an electroconductive thin film 4 of fine PdO particles, which was then subjected to energization forming and activation processes.

When tested for performance as in the case of Example 1, If(0)=1.7 mA and Ie(0)=1.4 μA were observed at the onset to provide an electron emission efficiency of η(0)=0.085%. The reduction ratios after an hour were δIf(1 hour)=7% and δIe(1 hour)=8%.

Example 4

Figure 17A:
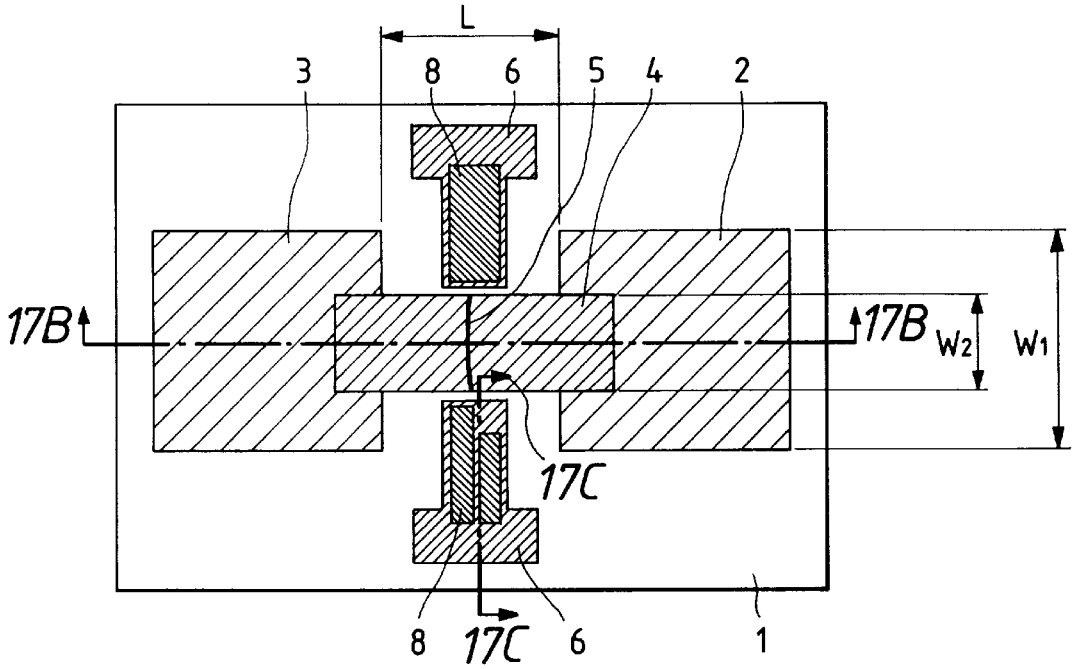
FIGS. 17A through 17C are schematic views of the surface conduction electron-emitting device of Example 4.
Figure 17B:
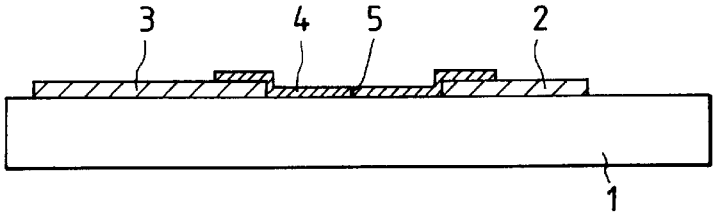
Figure 17C:
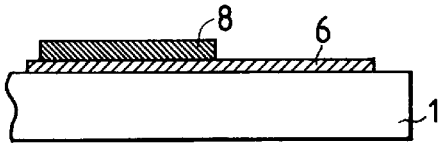

FIG. 17A schematically shows a plan view of the electron source prepared in this example. It comprises a substrate 1, a pair of device electrodes 2 and 3, an ectroconductive thin film 4 of fine PdO particles including an electron-emitting region 5, an electrode for supplying an activating substance 6 and an activating substance source 8 made of polyvinylacetate. In the electron source of this example, a surface conduction electron-emitting device was constituted by the device electrodes 2 and 3 and the electroconductive thin film 4 including the electron-emitting region 5, whereas the means for supplying an activating substance is constituted by the electrode 6 and the activating substance source 8.

In the example, a distance separating the device electrodes of L-10 μm, a width of the device electrodes of W1=300 μm were selected.

The electron source of this example was prepared in a manner as described below.

(a) Steps (a) through (d) of Example 1 were followed to produce a pair of device electrodes 2 and 3 and an electrode for supplying an activating substance 6 on a substrate 1.

(b) Steps (h) through (I) of Example 1 were also followed to produce an activating substance source 8 made of polyvinylacetate on the electrode for supplying an activating substance 6.

(c) Steps (k) through (n) of Example 1 were also followed to produce an electroconductive thin film 4 of fine PdO particles and then an electron-emitting region 5 was produced by an energization forming process. The prepared electron source was subsequently subjected to an activation process.

The prepared electron source was tested for its electron emitting performance by applying a rectangular pulse voltage as shown in FIG. 5C. The pulse wave height was 16V and the pulse width and the pulse interval were respectively T1=100 pμec. and T2–10 msec. The device was separated from the anode by a distance of H=4 mm and the potential difference between them was equal to Va=1 kV.

When tested for performance, If(0)=1.3 mA and Ie(0)=1.1 μA were observed at the onset to provide an electron emission efficiency of $\eta(0)=0.085\%$. The reduction ratios after an hour were $\delta If(1\ hour)=20\%$ and $\delta Ie(1\ hour)=25\%$.

Thereafter, the application of the voltage Va to the anode was stopped and, while a voltage of 100V was being applied to the electrode for supplying an activating substance 6, a pulse voltage as described above was applied between the device electrodes 2 and 3 for 3 minutes. Thereafter, the application of the voltage to the electrode for supplying an activating substance 6 was stopped and the application of the voltage Va=1 kV to the anode was resumed to test the performance of the electron source once again and obtain If=1.1 mA and Ie=1.0 $\mu$A. Thus, it was proved that the electron emitting performance of the electron source was recoverable.

This remarkable feature of a recoverable electron emitting performance on the part of the electron source may be because electrons emitted from the electron-emitting region 5 are partly attracted by the electrode for supplying an activating substance 6 and collide with the activating substance source 8 to impart energy to the latter, molecules of polyvinylacetate are decomposited, resulted materials are released and carbon or a carbon compound is deposited near the electron-emitting region as in the case of an activation process to offset the eroded portion of the deposit of carbon or a carbon compound.

Example 5

In this example, an image forming apparatus comprising an electron source and an image displaying member of a fluorescent material was prepared. The electron source was formed by arranging a plurality of surface conduction electron-emitting devices on a substrate and wiring them in a ladder-like manner. FIGS. 12 and 13 schematically show the electron source and the image forming apparatus of this example respectively.

Now, the steps used for manufacturing the image forming apparatus of the example will be described below by referring to FIGS. 18A through 18F.

Figure 18A:
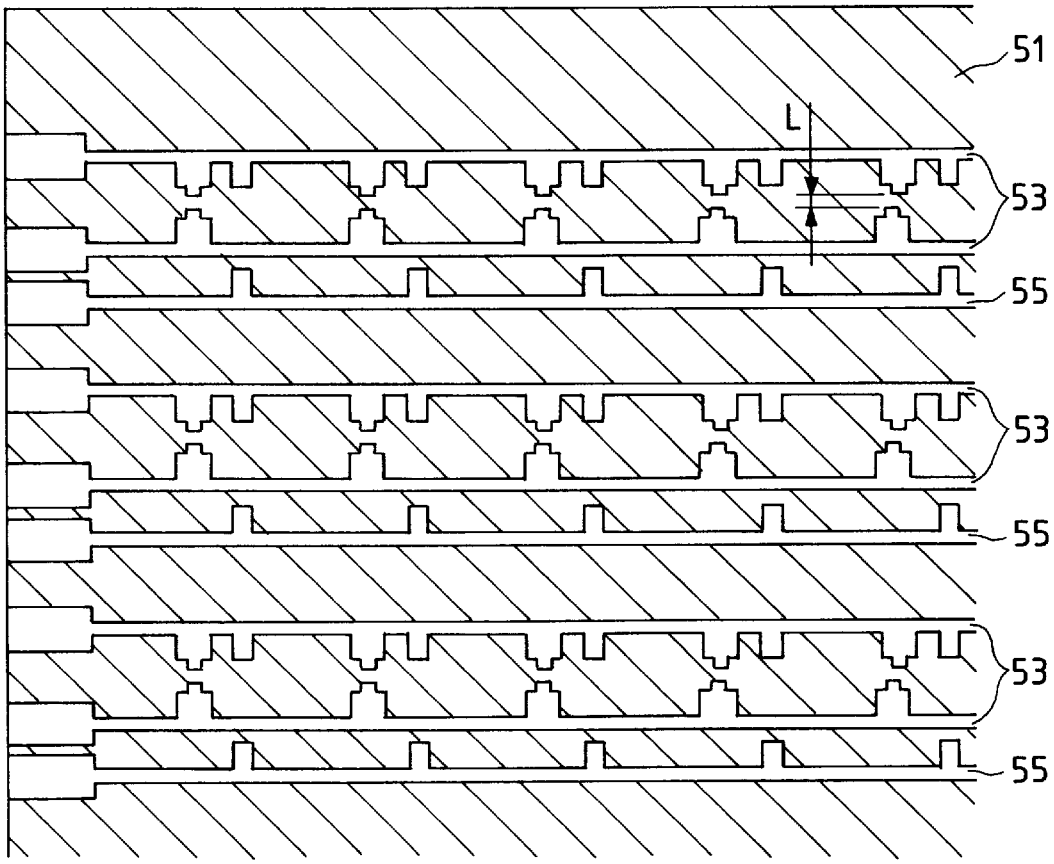
FIGS. 18A through 18F are schematic views of the electron source of Example 5 in different manufacturing steps.

(A) After thoroughly cleansing a soda lime glass plate, a silicon oxide film was formed thereon to a thickness of 0.5 $\mu$m by sputtering to produce a substrate 51, on which a pattern of photoresist (RD-2000N-41: available from Hitachi Chemical Co., Ltd.) was formed, said pattern having openings for common wires 53 that also operated as device electrodes and wires for supplying and activating substance 55 that also operated as electrodes for supplying an activating substance. Then T1 and Ni were sequentially deposited thereon respectively to thicknesses of 5 nm and 100 nm by vacuum evaporation. The photoresist pattern was dissolved by an organic solvent and the N1/Ti deposit film was treated by using a lift-off technique to produce common wires 53 operating as device electrodes 2 and 3 and wires for supplying a substrate 55 operating as electrodes for supplying an activating substance. The distance separating the device electrodes of each electrode pair was L=3 $\mu$m. (FIG. 18A)

Figure 18B:
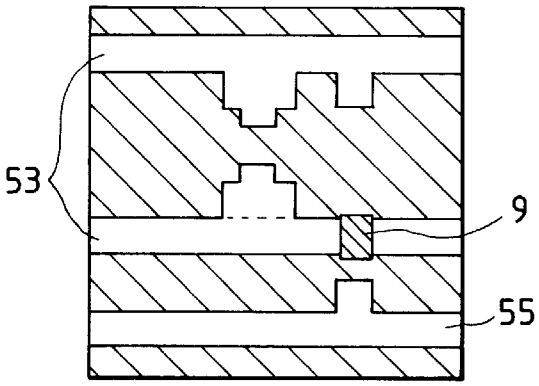

(B) An $SiO_2$ film was formed to a thickness of 600 nm by sputtering and then a pattern was formed on the insulation film by means of photoresist, which was then dry-etched by means of $CF_4$ and $H_2$ to produce an insulation layer 9 for each device. (FIG. 18B)

Figure 18E:
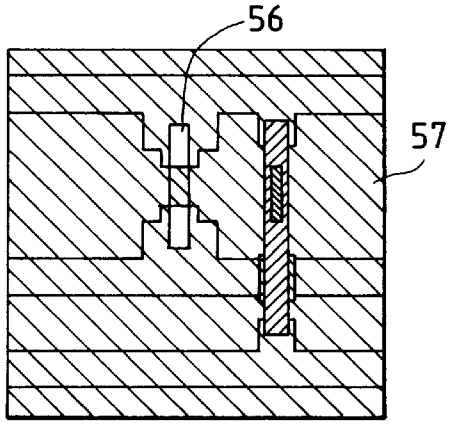
Figure 18C:
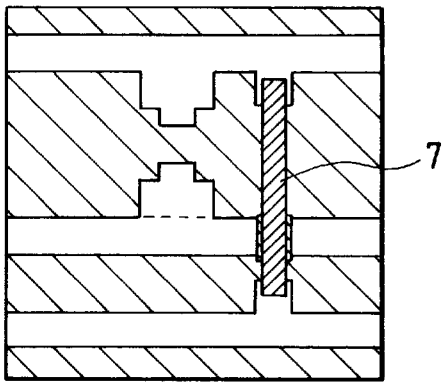

(C) A film resistance heater 7 of ITO was formed for each device as in the case of Step (g) of Example 1. (FIG. 18C)

Figure 18F:
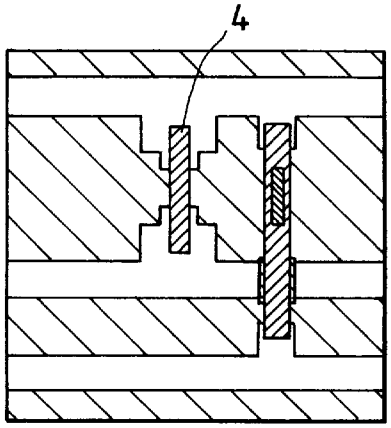
Figure 18D:
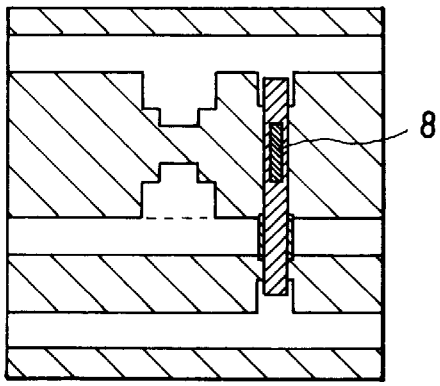

(D) An activating substance source 8 of a film of polyvinylacetate was formed on the film resistance heater 7, following Steps (h) through (j) of Example 1. (FIG. 18D)

(E) A Cr film was formed to a thickness of 300 nm by vacuum evaporation and then an opening 56 corresponding to the pattern of an electroconductive thin film was formed by ordinary photolithography to produce a Cr mask 57. (FIG. 18E)

(F) A solution of Pd amine complex (ccp4230: available from Okuno Pharmaceutical Co., Ltd.) was applied to the Cr film by means of a spinner, and baked at 300° C. for 12 minutes in the air. As a result, an electroconductive film of fine particles containing PdO as a principal ingredient was produced and had a film thickness of 7 nm (FIG. 18F).

The Cr mask was then wet-etched to be removed and the PdO film was lifted-off to produce an electroconductive thin film 4 having a desired pattern. The electric resistance of the electroconductive thin film was $Rs=2\times10^4\ \Omega/\square$.

By using an electron source manufactured in a manner as described above, an image forming apparatus was prepared. This will be described by referring to FIG. 13. After securing the electron source substrate 51 onto a rear plate 31, a face plate 36 (carrying a fluorescent film 34 and a metal back 35 on the inner surface of a glass substrate 33) was arranged above the substrate 51 with a support frame 32 disposed therebetween to form an envelope and, subsequently, frit glass was applied to the contact areas of the face plate 36, the support frame 32 and rear plate 31 and baked at 400° C. for 10 minutes in a nitrogen atmosphere to hermetically seal the envelope. The substrate 51 was also secured to the rear plate 31 by means of frit glass.

While the fluorescent film 34 is consisted only of a fluorescent material if the apparatus is for black and white images, the fluorescent film 34 of this example was prepared by forming black stripes and filling the gaps with stripe-shaped fluorescent members of red, green and blue. The black stripes were made of a popular material containing graphite as a principal ingredient. A slurry technique was used for applying fluorescent materials onto the glass substrate 33.

An ordinary metal back 35 was arranged on the inner surface of the fluorescent film 34. After preparing the fluorescent film, the metal back was prepared by carrying out a smoothing operation (normally referred to as "filming") on the inner surface of the fluorescent film and thereafter forming thereon an aluminum layer by vacuum evaporation.

While a transparent electrode (not shown) might be arranged on the outer surface of the fluorescent film 34 in order to enhance its electroconductivity, it was not used in this example because the fluorescent film showed a sufficient degree of electroconductivity by using only a metal back.

For the above bonding operation, the fluorescent members of the primary colors and the corresponding electron-emitting device were accurately aligned. As shown in FIG. 13, the electron source substrate 51, the rear plate 31, the face plate 36 and the grid electrodes 61 were carefully combined and the external terminals 63, the external grid electrode terminals 64 and the terminals for the electrodes for supplying an activating substance 65 were electrically connected. Reference numeral 62 denotes a hole for allowing electrons to pass therethrough.

Figure 19:
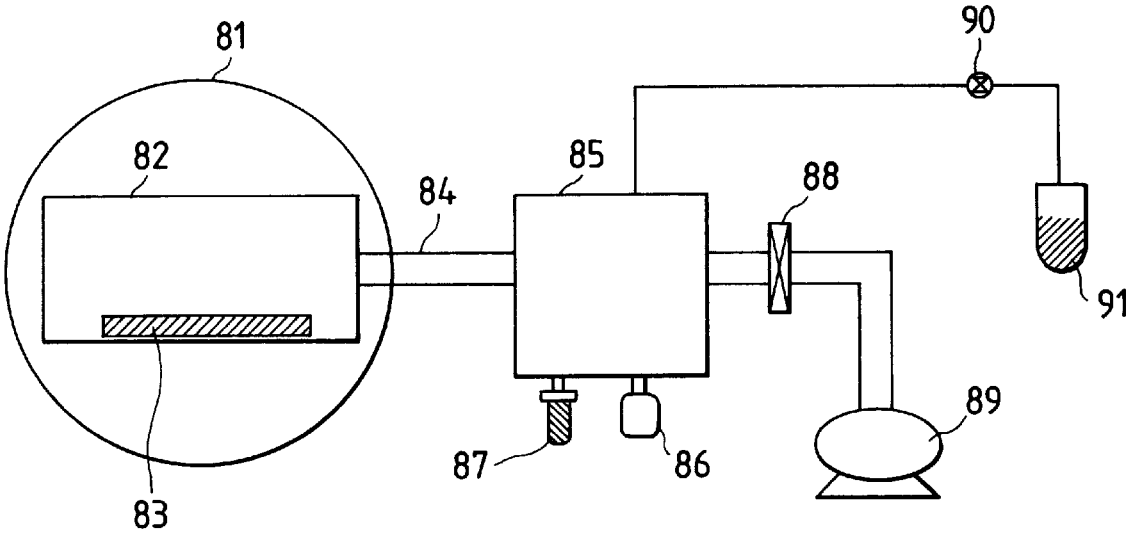
FIG. 19 is a schematic block diagram of a processing apparatus that can be used for manufacturing the image forming apparatus of Example 5.

The subsequent manufacturing steps and a measuring operation were carried out in a vacuum system as illustrated in FIG. 19.

The vacuum container (envelope) 82 of the image forming apparatus 81 was connected to the vacuum chamber 85 of the vacuum system by way of an exhaust pipe 84. The vacuum chamber 85 was evacuated by means of a vacuum pump unit 89 by way of a gate valve 88 and the atmosphere in the inside of the vacuum container 82 was monitored by a pressure gauge 86 arranged in the vacuum chamber 85. A quadrupole mass (Q-mass) spectrometer 87 was also arranged within the vacuum chamber 85 to measure the partial pressures of the gases within the chamber.

After evacuating the inside of the vacuum container 82 to a reading of the pressure gauge 86 less than $1.3\times10^{-4}$ Pa, an energization forming operation was carried out on the electron-emitting devices of the electron source by applying a pulse voltage to each device by way of an electric circuit (not shown) as in the case of Example 1. The pulse voltage was applied by connecting the anode and the cathode of each device to a power source by way of the external terminals 63. No voltage was applied to the film resistance heater 7 of the device.

Subsequently, the image forming apparatus was subjected to an activation process. The vacuum chamber 85 was also connected to an ampule containing an activating substrate by way of a valve 90 for introducing gas of the activating substance. In this example, acetone was used for the activating substance. Acetone was introduced into the vacuum chamber 85 by controlling the valve 90 and the gate valve 88 until the reading of the pressure gauge became equal to $1.3\times10^{-2}$ Pa. Thereafter, a pulse voltage was applied to the image forming apparatus on a row-by-row basis to carry out an energization forming process. The pulse had a waveform as that of the pulse used in Example 1.

After the completion of the activation process, the supply of acetone was stopped and the gate valve 88 was made full open to evacuate the inside of the vacuum container 82, maintaining the temperature of the vacuum container 82 to about 200° C. After 5 hours, the internal pressure reached $1.3\times10^{-4}$ Pa and it was confirmed by Q-mass 87 that no acetone was remaining inside the chamber.

Then, the heater was turned off to cool the image forming apparatus. Thereafter, the electron source 83 was made to emit electrons until the entire surface of the image displaying member (fluorescent film) glowed to prove that the image forming apparatus was operating normally before the exhaust pipe 84 was sealed off by means of a burner. Finally, the getter arranged within the image forming apparatus 81 was heated by means of high frequency heating to produce a vapor deposition film. The getter contained Ba as a principal ingredient and was designed to maintain the vacuum inside the vacuum container 82 by the adsorption effect of the vapor deposition film of getter material.

For displaying an image on the image forming apparatus of this example, a voltage was applied from a power source to the device rows on a row-by-row basis to "select a row" and cause all the devices of the row to emit electron beams. The emission of electron beam of each device was made on and off by controlling the potentials of the grid electrodes running perpendicularly relative to the device rows so that desired pixels may be irradiated by electron beams to emit light.

In a measuring operation for determining the performance of the image forming apparatus, no voltage was applied to the grid electrodes because electron beams did not have to be made on and off and, therefore, a voltage was applied only to the device rows on a row-by-row basis. The voltage applied to each device was a rectangular pulse voltage as shown in FIG. 5C, having a wave height of 14V, a pulse width of 100 μsec. and a pulse interval of 10 msec. The timing of the pulse voltage applied to each device row was so controlled that the on period of the pulse voltage being applied to a device row did not coincide with the on period of the pulse voltage being applied to any other row.

A rectangular pulse voltage was also applied to each means for supplying an activating substrate comprising a film resistance heater and an activating substance source of the image forming apparatus. The voltage applied to each means for supplying an activating substrate was also a rectangular pulse voltage, having a wave height of 5V, a pulse width of 50 sec. and a pulse interval of 10 msec. The two pulses were so arranged for timing that they were displaced from each other by a half period. The electron emitting performance of the devices would be modified undesirable if a too large pulse width is used mainly because the activating substrate is supplied excessively. Therefore, the pulse width and other critical factors have to be rigorously selected in order to supply the activating substrate at an appropriate rate if the design of the image forming apparatus is modified.

When tested for performance, as average values per one device, If(0)=1.8 mA and Ie(0)=2.4 μA were observed at the onset to provide an electron emission efficiency of η(0)=0.013%. The reduction ratios after an hour of operation were δIf(1 hour)=5% and δIe(1 hour)=7%.

Example 6

An image forming apparatus was prepared as in the case of Example 5 and driven to operate without applying a voltage to the means for supplying an activating substrate and the performance of the apparatus was evaluated. Otherwise, the operating conditions were same as those of Example 5. An excessive amount of getter was arranged and not used at the time of sealing the exhaust pipe.

When tested for performance, both If(0) and Ie(0) observed at the onset were substantially the same as their counterparts of Example 5. The reduction ratios after an hour of operation were dIf(1 hour)=22% and dIe(1 hour)=24%.

Thereafter, the voltage Hv applied to the face plate was removed and the devices were driven to operate, applying a pulse voltage to the means for supplying an activating substrate. The voltage applied to the devices was the same as that of the performance test and a rectangular pulse voltage having a wave height of SV, a pulse width of 200 μsec. and a pulse interval of 10 msec. was applied to the means for supplying an activating substrate. The two pulses were so arranged for timing that they were displaced from each other by a half period. This operation of voltage application was conducted for 3 minutes and then the remaining getter was partly heated by high frequency heating for another getter operation before the image forming apparatus was tested once again for performance. The If=1.6 mA and Ie=2.2 .usec. were obtained to prove a recovery of the performance of the devices.

Example 7

In this example, an image forming apparatus comprising an electron source realized by arranging a plurality of surface conduction electron-emitting devices on a substrate and wiring them to form a matrix wiring arrangement and an image forming member of a fluorescent body housed in a glass vacuum container. The electron source had 100 devices in each row and each column along the X- and Y-directions respectively.

The image forming apparatus of the examples was prepared in a manner as described below by referring to FIGS. 20 through 22G.

Figure 20:
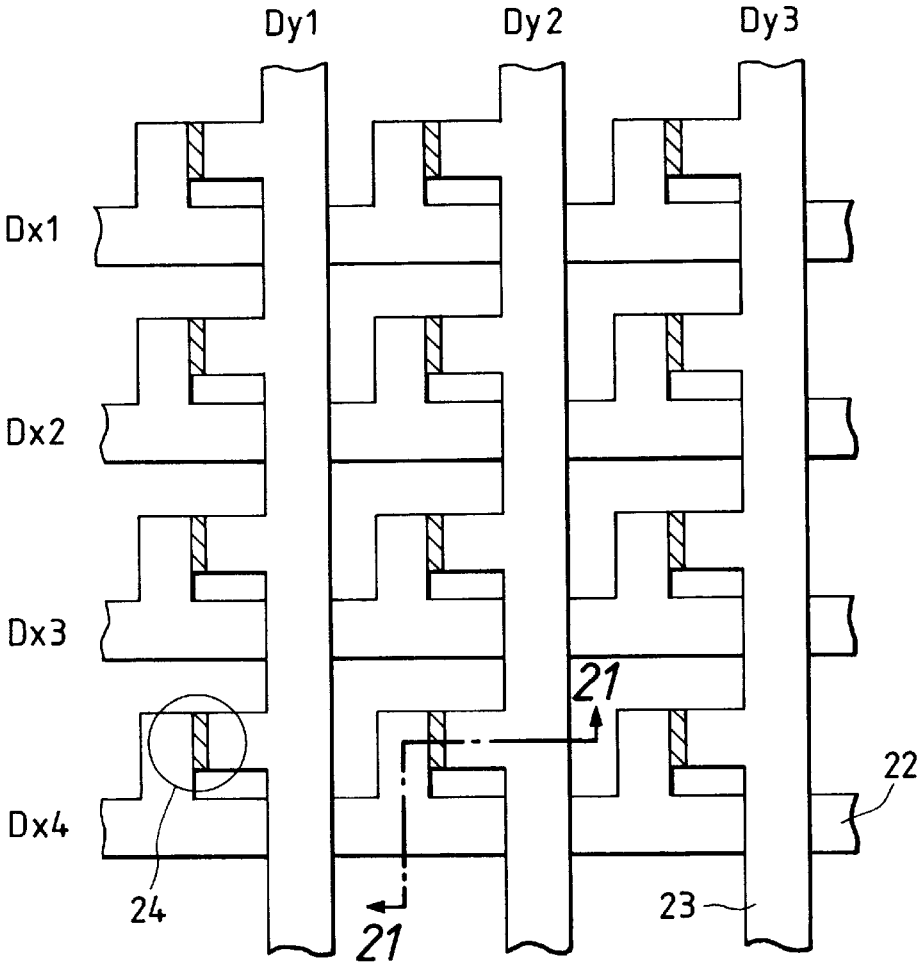
FIG. 20 is a schematic partial view of the electron source of Example 7.
Figure 21:
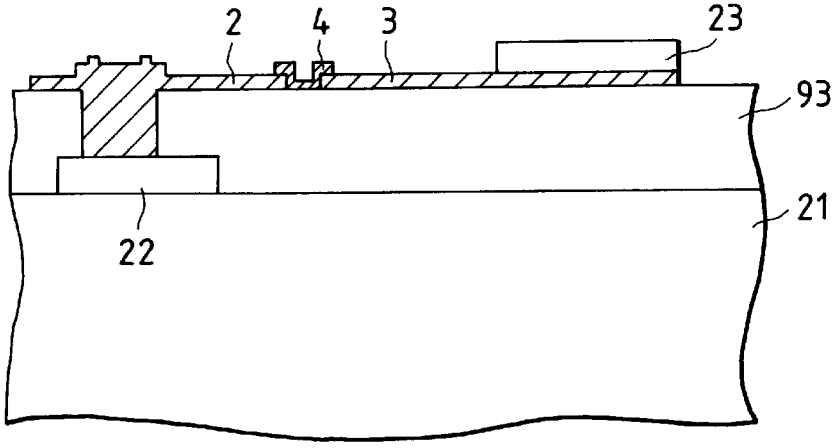
FIG. 21 is a schematic partial view of the electron source of Example 7.

FIG. 20 is an enlarged schematic plan view of part of the electron source of this example. FIG. 21 is a schematic sectional view of the electron source taken along line 21—21 in FIG. 20. In these figures, reference numeral 24 denotes a surface conduction electron-emitting device comprising a pair of device electrodes and an electroconductive thin film including an electron-emitting region. Reference numerals 22 and 23 respectively denote a lower wire (X-directional wire) and an upper wire (Y-directional wire).

Figure 22A:
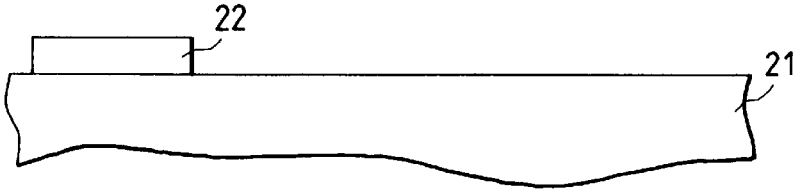
FIGS. 22A through 22G are schematic views of the electron source of Example 7 in different manufacturing steps.

(A) After thoroughly cleansing a soda lime glass plate, a silicon oxide film was formed thereon to a thickness of 0.5 μm by sputtering to produce a substrate 21, on which Cr and Au were sequentially laid to thicknesses of 5 nm and 600 nm, respectively, and then a photoresist (AZ1370: available from Hoechst Corporation) was formed thereon by means of a spinner, while rotating the film, and baked. Thereafter, a photo-mask image was exposed to light and photochemically developed to produce a resist pattern for a lower wire 22 and then the deposited Au/Cr film was wet-etched to produce a lower wire 22. (FIG. 22A).

Figure 22B:
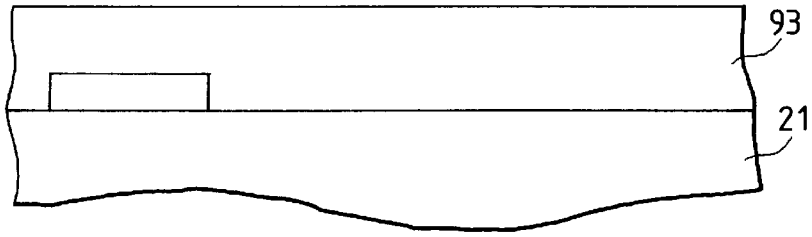

(B) A silicon oxide film was formed as an interlayer insulation layer 93 to a thickness of 1.0 μm by RF sputtering. (FIG. 22B).

Figure 22C:
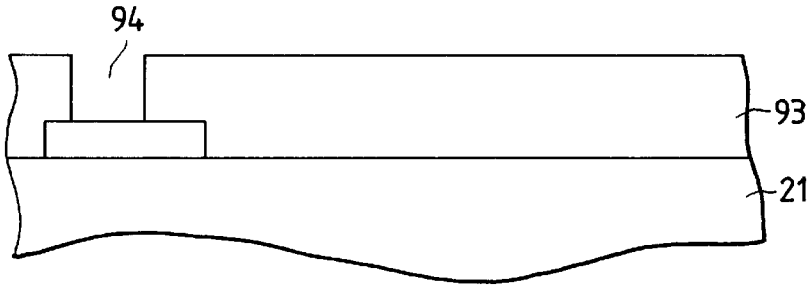

(C) A photoresist pattern was prepared for producing a contact hole 94 in the silicon oxide film deposited in Step B, which contact hole 94 was then actually formed by etching the interlayer insulation layer 93, using the photoresist pattern for a mask. A technique of RIE (Reactive Ion Etching) using $CF_4$ and $H^2$ gas was employed for the etching operation. (FIG. 22C)

Figure 22D:
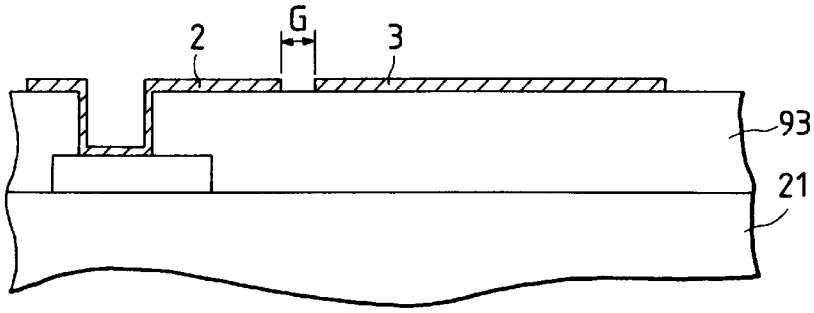

(D) Thereafter, a pattern of photoresist (RD-2000N-41: available from Hitachi Chemical Co., Ltd.) was formed for a pair of device electrodes 2 and 3 and a gap G separating the electrodes and then Ti and Ni were sequentially deposited thereon, respectively, to thicknesses of 5 nm and 100 nm by vacuum evaporation. The photoresist pattern was dissolved into an organic solvent and the Ni/Ti deposit film was treated by using a lift-off technique to produce a pair of device electrodes 2 and 3 having a width of 300 μm and separated from each other by a distance G of 3 μm. (FIG. 22D).

Figure 22E:
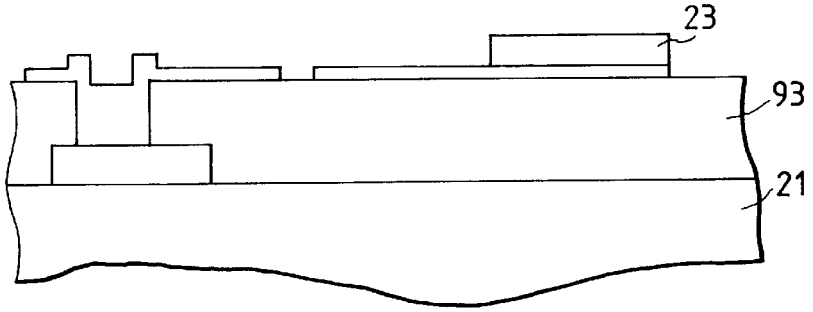

(E) After forming a photoresist pattern on the device electrodes 2, 3 for an upper wire 23, Ti and Au were sequentially deposited by vacuum evaporation to respective thicknesses of 5 nm and 500 nm and then unnecessary areas were removed by means of a lift-off technique to produce an upper wire 23 having a desired profile. (FIG. 22E).

Figure 22F:
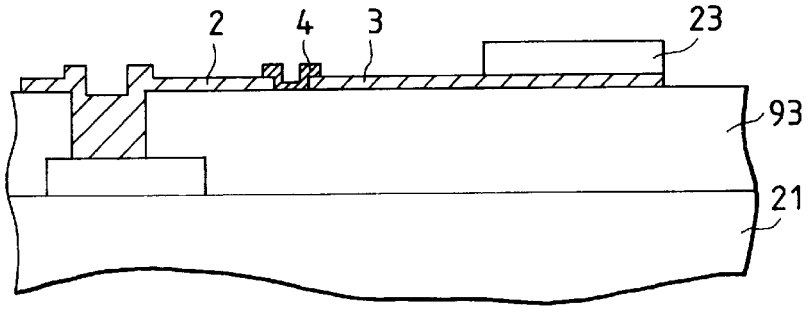
Figure 22G:
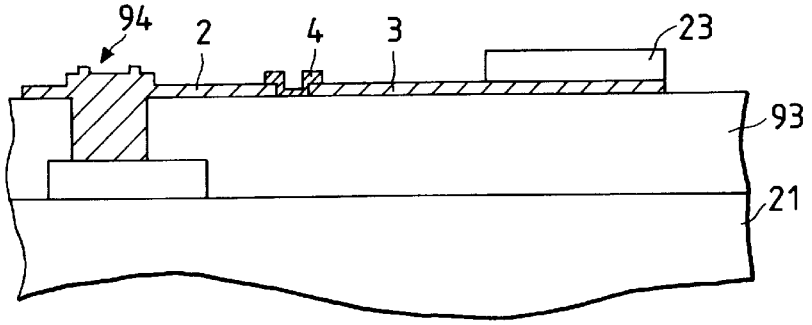

(F) Then, an electroconductive thin film 4 was formed as in the case of (k) of Example 1. (FIG. 22F)

(G) Then, a pattern for applying photoresist to the entire surface area except the contact hole 94 was prepared and Ti and Au were sequentially deposited by vacuum evaporation to respective thicknesses of 5 nm and 500 nm. Any unnecessary areas were removed by means of a lift-off technique to consequently bury the contact hole 94.

Figure 23A:
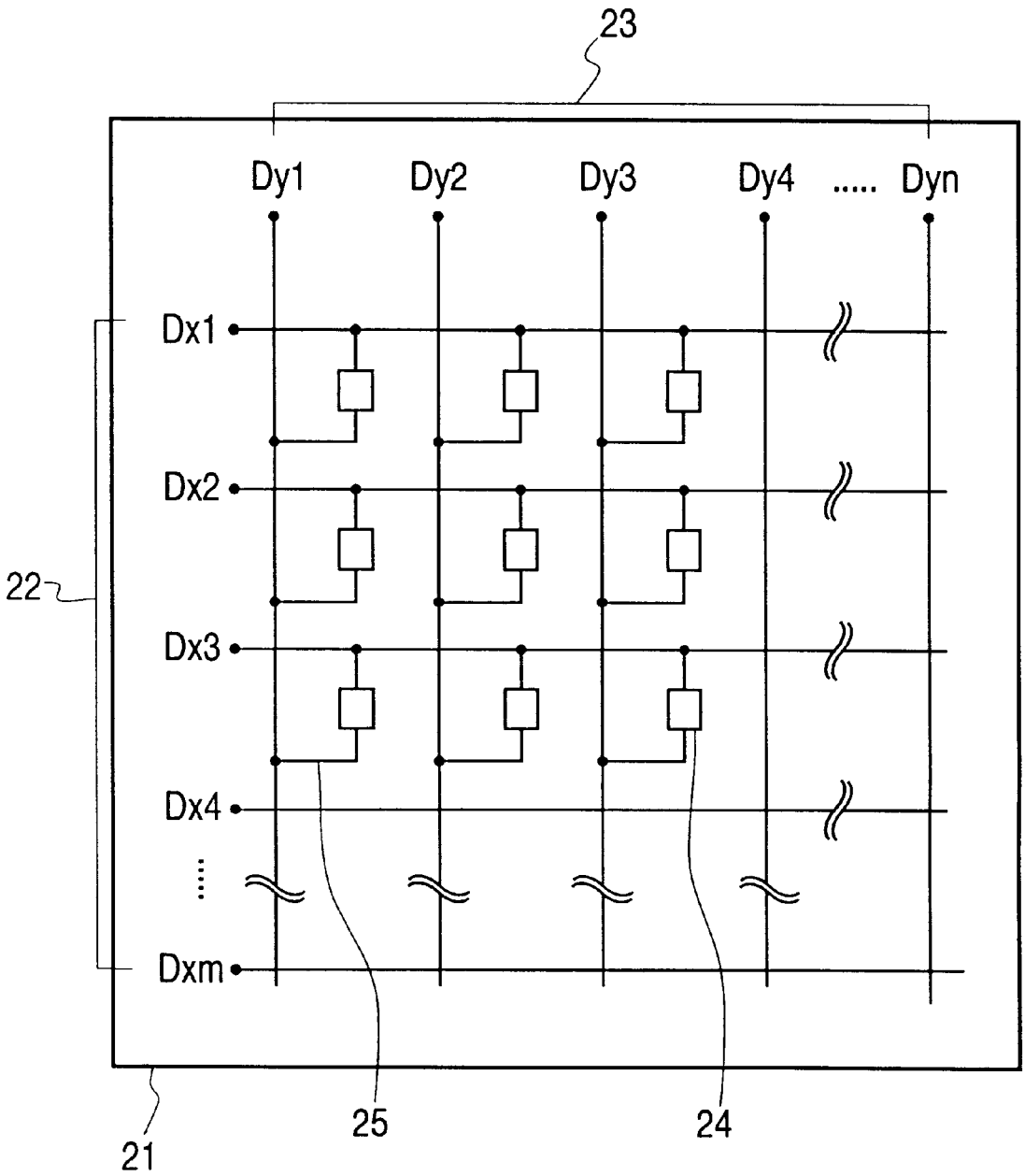
FIGS. 23A and 23B are schematic views of the electron source and the image forming apparatus of Example 7.
Figure 23B:
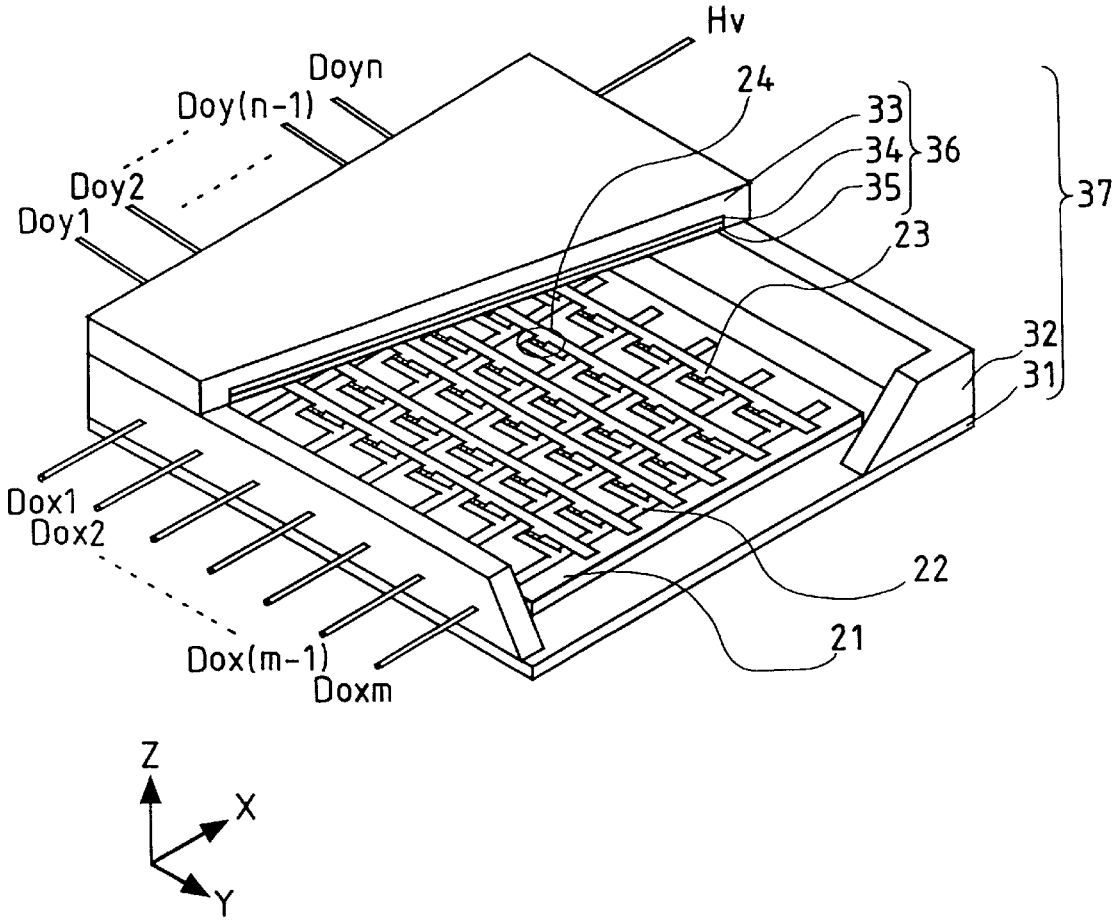

By using an electron source prepared in a manner as described above, an image forming apparatus we. prepared. This will be described by referring to FIGS. 23A and 23B.

(H) After securing an electron source substrate 21 onto a rear plate 31, a face plate 36 (carrying a fluorescent film 34 and a metal back 35 on the inner surface of a glass substrate 33) was arranged 5mm above the substrate 21 with a support frame disposed therebetween and, subsequently, frit glass was applied to the contact areas of the face plate 36, the support frame 32 and rear plate 31 and baked at 400° C. in a nitrogen atmosphere for more than 10 minutes to hermetically seal the container. The substrate 21 was also secured to the rear plate 31 by means of frit glass.

While the fluorescent film is consisted only of a fluorescent body if the apparatus is for black and white images, the fluorescent film of this example was prepared by forming black stripes and filling the gaps with stripe-shaped fluorescent members of primary colors. The black stripes were made of a popular material containing graphite as a principal ingredient. A slurry technique was used for applying fluorescent materials onto the glass substrate 33.

A metal back 35 is arranged on the inner surface of the fluorescent film 34. After preparing the fluorescent film, the metal back was prepared by carrying out a smoothing operation (normally referred to as "filming") on the inner surface of the fluorescent film and thereafter forming thereon an aluminum layer by vacuum evaporation.

While a transparent electrode (not shown) might be arranged on the outer surface of the fluorescent film 34 of the face plate 36 in order to enhance its electroconductivity, it was not used in this example because the fluorescent film showed a sufficient degree of electroconductivity by using only a metal back.

For the above bonding operation, the components were carefully aligned in order to ensure an accurate positional correspondence between the color fluorescent members and the electron-emitting devices.

Figure 25:
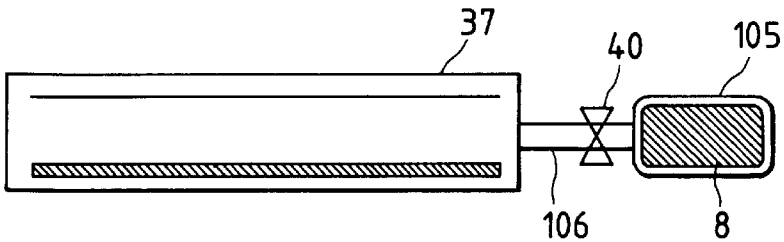
FIG. 25 is a schematic view of the image forming apparatus of Example 7.

As shown in FIG. 25, the envelope (vacuum container) 37 was provided with a glass container 105 by way of a connector pipe 106 and an activating substance source 8 was arranged within the glass container 105. In this example, the activating substance source 8 was made of a molecular sieve of the type popularly used for an adsorption agent of a sorption pump, to which n-dodecane was adsorbed. The connecting pipe 106 is provided with a valve 40 that can be opened and closed appropriately.

Figure 24:
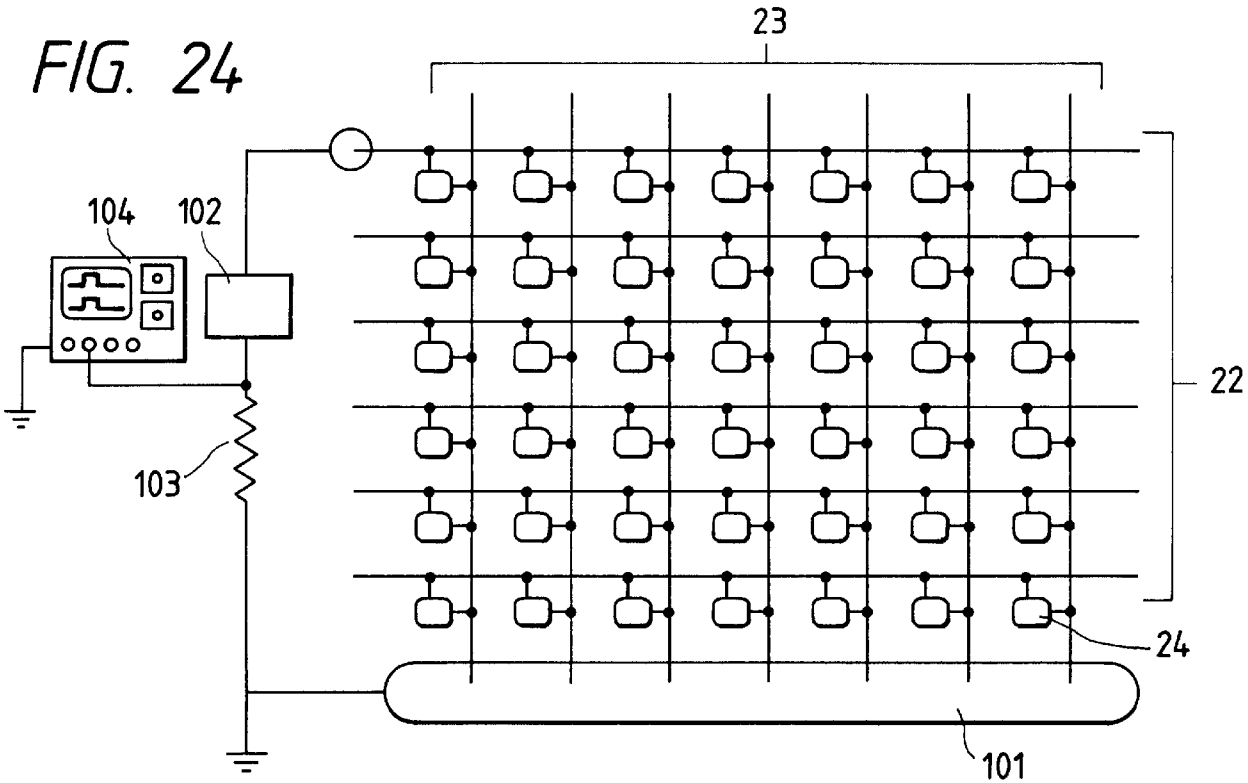
FIG. 24 is a schematic view of an electron source according to the invention and having a matrix arrangement, illustrating how it is wired for the steps of energization forming and activation and an operation of gauging its performance.

(I) The image forming apparatus was then evacuated by means of a vacuum system shown in FIG. 19 as in the case of Example 5. As illustrated in FIG. 24, the Y-directional wires 23 were connected to a common wire so that an energization forming operation was carried out on a row-by-row basis. In FIG. 24, reference numeral 101 denotes a common electrode for commonly connecting the Y-directional wires 23 and reference numeral 102 denotes a power source, while reference numeral 103 denotes a resistor for determining the electric current and reference numeral 104 denotes an oscilloscope for monitoring the electric current.

A pulse voltage having a wave form the same as that of the pulse voltage of Example 1 was used for the energization forming operation. During the energization forming process, an extra pulse voltage of 0.1V was inserted into intervals of the forming pulse voltage in order to determine the resistance of the electron-emitting region and the energization forming process was terminated when the resistance exceeded 10 kΩ.

(J) Subsequently, an activation process was carried out. The activating substance was supplied by opening the valve 40 and heating the glass container 105 through irradiation of He-Ne laser in order to cause the activating substance source to release n-dodecane into the vacuum container 37. The voltage was applied to the devices on a row-by-row basis as in the case of Step (I) above. The remaining conditions for the operation were the same as those of Example 5.

(K) After the end of the activation process, the valve 40 was closed and the inside of the vacuum container was evacuated as in the case of Example 5. Then, the operation of the image forming apparatus was checked again and the exhaust pipe was sealed. At the very end, a getter operation was conducted for the image forming apparatus.

The image forming apparatus of this example was then tested for performance. In a measuring operation for determining the performance of the image forming apparatus, a voltage was applied only to the device rows on a row-by-row basis by so connecting the wires as in the case of the energization forming and activation processes, although the simple matrix arrangement was to be utilized to drive each electron-emitting device independently for electron emission if images were to be displayed on the screen.

A rectangular pulse voltage as shown in FIG. 5C was applied to the X-directional wires. The pulse voltage had a wave height of 14V, a pulse width of 100 μsec. and a pulse interval of 10 msec. The phases of the pulse voltages applied to any adjacently located X-directional wires were shifted by 100 μsec. or a value equal to the pulse width.

A voltage of 4kV was applied between the electron source and the metal back of the face plate in order to accelerate electron beams.

With the image forming apparatus of this example, no large and bulky arrangement is required for introducing an activating substance into the vacuum system so that a simple manufacturing apparatus and a simplified manufacturing method could be used.

Example 8

The steps up to the activation step of Example 7 were followed. The pipe 106 connecting the vacuum container 37 and the glass container 105 was provided with a valve 40 in order to open and close the pipe. After evacuating the inside of the vacuum container 37, closing the valve 40, the exhaust pipe (84 in FIG. 19) was sealed off by means of a burner. Subsequently, a getter operation was carried out by means of high frequency heating, although an excessive amount of getter was left inside and was not used in the getter operation.

The image forming apparatus was driven to operate and a degradation in the electron emitting performance was confirmed as in the case of Example 6. Then, the performance of the apparatus was recovered by opening the valve 40 on the connecting pipe 106, irradiating the glass container with laser to heat it as in the case of an activation process, supplying n-dodecane into the vacuum container again and applying a voltage to the electron-emitting devices also as in the cane of an activation process, the remaining getter was partly heated by high frequency heating for another getter operation before the image forming apparatus was tested once again for performance. When tented again for performance, it was found that the image forming apparatus recovered its original performance.

Example 9

An image forming apparatus was prepared as in the case of Example 8 except that the glass container 105 was made to contain $W(CO)_6$. After carrying out an activation process as in the case of the above examples, the valve 40 was closed and the inside of the vacuum container 37 was evacuated, heating the container to 200° C. Under this condition, the vacuum container 106 was evacuated, blowing nitrogen gas onto the glass container 105 in order to prevent it from being heated.

When the evacuation was over, the exhaust pipe was sealed off by means of a burner and then a getter operation was carried out.

The prepared image forming apparatus was tested for performance as in the case of Example 7. At the onset of the measuring operation, If(0)=1.8 mA and Ie(0)=2.0 μA were observed to prove η(0)=0.11%.

Thereafter, however, the performance of the image forming apparatus showed a change that was different from that of its counterpart that had a deposit of a carbon compound. While both If and Ie were observed to be decreasing in the first 30 minutes after the onset of the operation, the rate of decrease was reduced remarkably thereafter if compared with that of the apparatus of Example 8.

This may be because, while a device comprising a deposit of carbon or a carbon compound loses the deposit quickly as it is heated and evaporates as a result of electron emission to eventually deform the electroconductive thin film such that it can no longer emit electrons, each of the devices of this example comprised a deposit of tungsten (W) that had a high melting point and hence would not be lost nor deformed easily. The degradation of performance observed in the initial stages may prove that $H_2$ and CO existing within the vacuum container of the image forming apparatus were adsorbed by the surface of the film of the W deposit to deter electron emission.

When the initial decreasing in the electron emitting performance came to an end, the high voltage source for applying a voltage between the face plate and the metal back was turned off. Then, the valve 40 was opened and the glass container 105 was heated before a pulse voltage was applied to the devices for 30 seconds as in the case of an activation process. Subsequently, the valve was closed again and a getter operation was repeated.

Thereafter, the performance of the apparatus was tested again to prove that it had been considerably recovered and that the initial decreasing in the electron emitting performance was almost half of one in the first measurement. This may be because the clean surface of the W deposit was formed again. While the cause of the reduction of decreasing in the performance is not clear, it may be because only a very small amount of gas was remaining in the container of the image forming apparatus thanks to the adsorption.

This example proved that the present invention is effective if a metal compound is used as an activating substance. With the image forming apparatus of this example again, no large and bulky arrangement is required for introducing an activating substance into the vacuum system so that a simple manufacturing apparatus and a simplified manufacturing method could be used.

Figure 26:
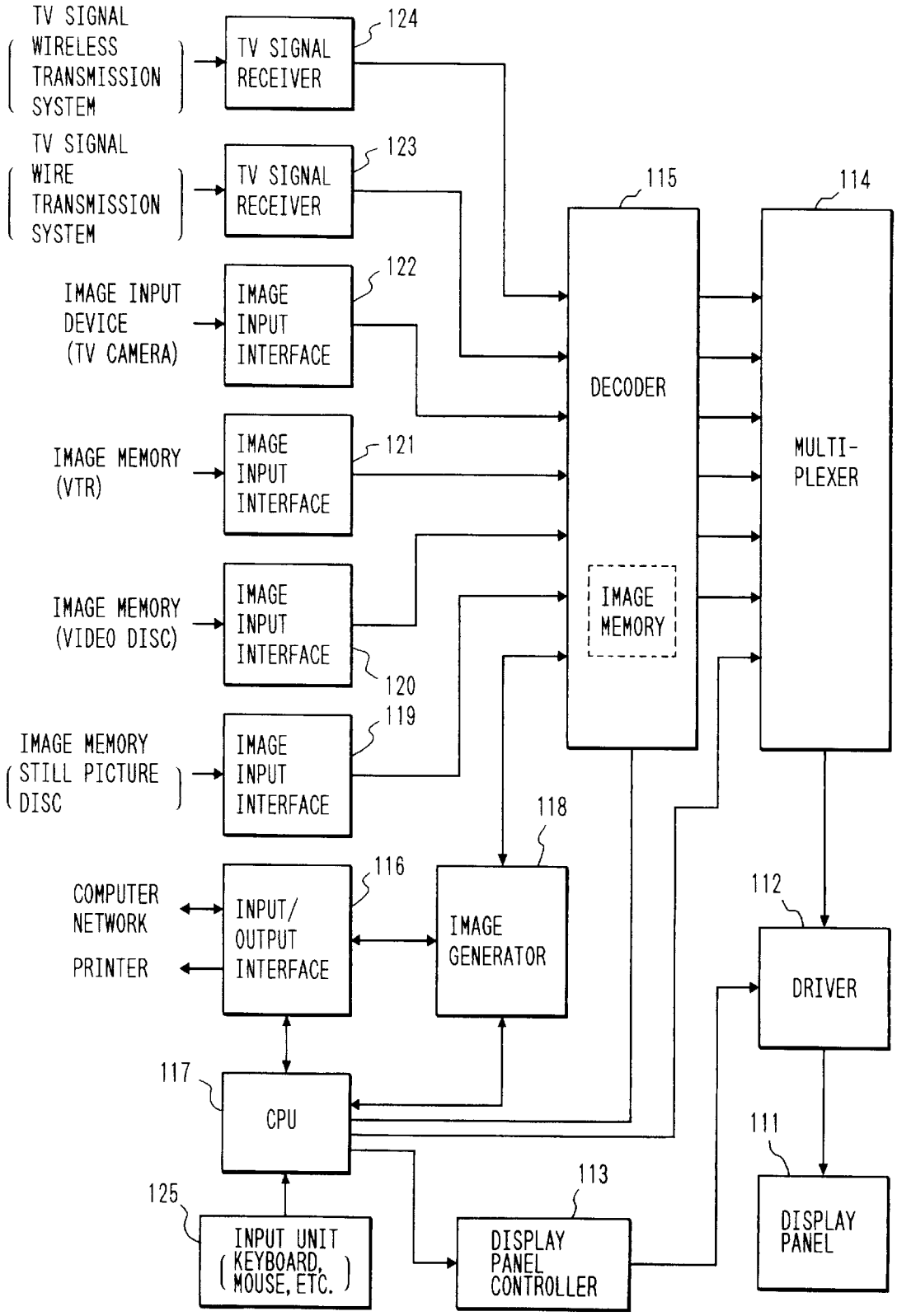
FIG. 26 is a block diagram illustrating an application using the image-forming apparatus of Example 9.
Figure 27:
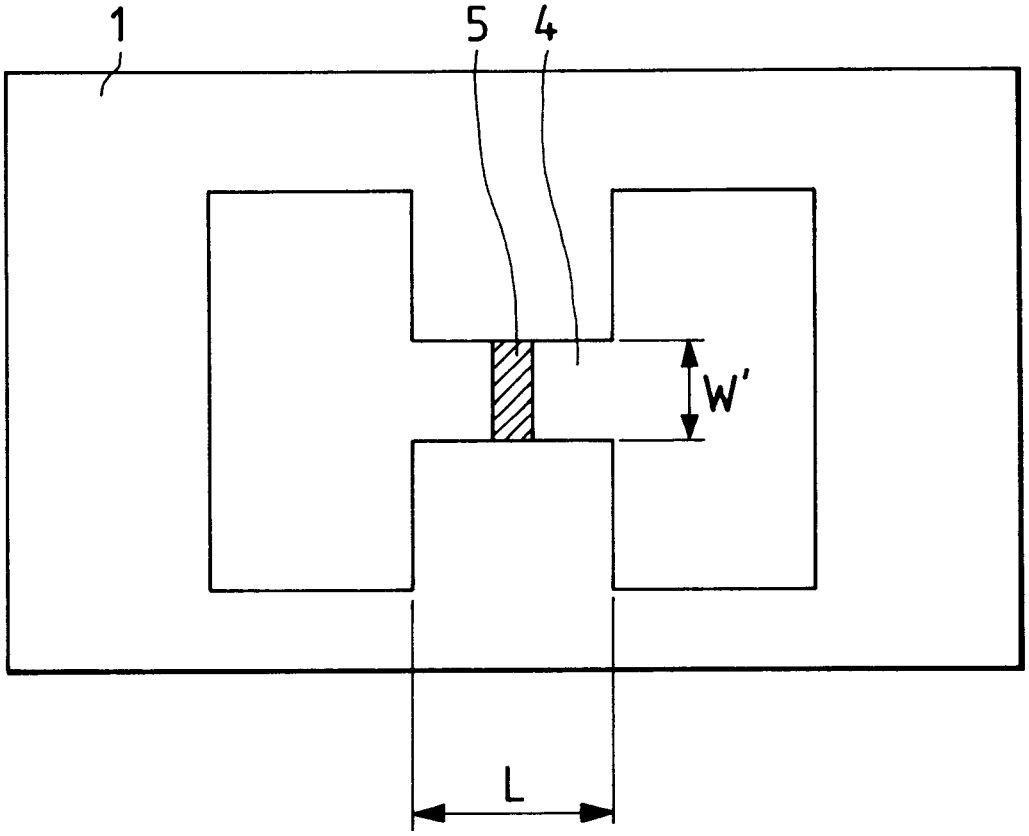
FIG. 27 is a schematic view of a known surface conduction electron-emitting device.

FIG. 26 is a block diagram of a display apparatus realized by using the image forming apparatus of Example 9 and designed to display a variety of visual data as well as pictures of television transmission in accordance with input signals coming from different signal sources. Referring to FIG. 26, it comprises the image forming apparatus or the display panel 111, a display panel drive circuit 112, a display controller 113, a multiplexer 114, a decoder 115, an input/output interface circuit 116, a CPU 117, an image generation circuit 118, image memory interface circuits 119, 120 and 121, an image input interface circuit 122, TV signal receiving circuits 123 and 124 and an input section 125. (If the display apparatus is used for receiving television signals that are constituted by video and audio signals, circuits, speakers and other devices are required for receiving, separating, reproducing, processing and storing audio signals along with the circuits shown in the drawing. However, such circuits and devices are omitted here in view of the scope of the present invention.)

Now, the components of the apparatus will be described, following the flow of image signals therethrough.

Firstly, the TV signal reception circuit 124 is a circuit for receiving TV image signals transmitted via a wireless transmission system using electromagnetic waves and/or spatial optical telecommunication networks. The TV signal system to be used is not limited to a particular one and any system such as NTSC, PAL or SECAM may feasibly be used with it. It is particularly suited for TV signals involving a larger number of scanning lines (typically of a high definition TV system such as the MUSE system) because it can be used for a large display panel comprising a large number of pixels. The TV signals received by the TV signal reception circuit 124 are forwarded to the decoder 115.

Secondly, the TV signal reception circuit 123 is a circuit for receiving TV image signals transmitted via a wired transmission system using coaxial cables and/or optical fibers. Like the TV signal reception circuit 124, the TV signal system to be used is not limited to a particular one and the TV signals received by the circuit are forwarded to the decoder 115.

The image input interface circuit 122 is a circuit for receiving image signals forwarded from an image input device such as a TV camera or an image pick-up scanner. It also forwards the received image signals to the decoder 115.

The image memory interface circuit 121 is a circuit for retrieving image signals stored in a video tape recorder (hereinafter referred to as VTR) and the retrieved image signals are also forwarded to the decoder 115.

The image memory interface circuit 120 is a circuit for retrieving image signals stored in a video disc and the retrieved image signals are also forwarded to the decoder 115.

The image memory interface circuit 119 is a circuit for retrieving image signals stored in a device for storing still image data such as the so-called still disc and the retrieved image signals are also forwarded to the decoder 115.

The input/output interface circuit 116 is a circuit for connecting the display apparatus and an external output signal source such as a computer, a computer network or a printer. It carries out input/output operations for image data and data on characters and graphics and, if appropriate, for control signals and numerical data between the CPU 117 of the display apparatus and an external output signal source.

The image generation circuit 118 is a circuit for generating image data to be displayed on the display screen on the basis of the image data and the data on characters and graphics input from an external output signal source via the input/output interface circuit 116 or those coming from the CPU 117. The circuit comprises relatable memories for storing image data and data on characters and graphics, read-only memories for storing image patterns corresponding to given character codes, a processor for processing image data and other circuit components necessary for the generation of screen images.

Image data generated by the image generation circuit 118 for display are sent to the decoder 115 and, if appropriate, they may also be sent to an external circuit such as a computer network or a printer via the input/output interface circuit 116.

The CPU 117 controls the display apparatus and carries out the operation of generating, selecting and editing images to be displayed on the display screen.

For example, the CPU 117 sends control signals to the multiplexer 114 and appropriately selects or combines signals for images to be displayed on the display screen. At the same time it generates control signals for the display panel controller 113 and controls the operation of the display apparatus in terms of image display frequency, scanning method (e.g., interlaced scanning or non-interlaced scanning), the number of scanning lines per frame and so on.

The CPU 117 also sends out image data and data on characters and graphics directly to the image generation circuit 118 and accesses external computers and memories via the input/output interface circuit 116 to obtain external image data and data on characters and graphics. The CPU 117 may additionally be so designed as to participate in other operations of the display apparatus including the operation of generating and processing data like the CPU of a personal computer or a word processor. The CPU 117 may also be connected to an external computer network via the input/output interface circuit 116 to carry out computations and other operations, cooperating therewith.

The input section 125 is used for forwarding the instructions, programs and data given to it by the operator to the CPU 117. As a matter of fact, it may be selected from a variety of input devices such as keyboards, mice, joysticks, bar code readers and voice recognition devices as well as any combinations thereof.

The decoder 115 is a circuit for converting various image signals input via said circuits 118 through 124 back into signals for three primary colors, luminance signals and I and Q signals. Preferably, the decoder 115 comprises image memories as indicated by a dotted line in FIG. 26 for dealing with television signals such as those of the MUSE system that require image memories for signal conversion. The provision of image memories additionally facilitates the display of still images as well as such operations as thinning out, interpolating, enlarging, reducing, synthesizing and editing frames to be optionally carried out by the decoder 115 in cooperation with the image generation circuit 118 and the CPU 117.

The multiplexer 114 is used to appropriately select images to be displayed on the display screen according to control signals given by the CPU 117. In other words, the multiplexer 114 selects certain converted image signals coming from the decoder 115 and sends them to the drive circuit 112. It can also divide the display screen in a plurality of frames to display different images simultaneously by switching from a set of image signals to a different set of image signals within the time period for displaying a single frame.

The display panel controller 113 is a circuit for controlling the operation of the drive circuit 112 according to control signals transmitted from the CPU 117.

Among others, it operates to transmit signals to the drive circuit 112 for controlling the sequence of operations of the power source (not shown) for driving the display panel in order to define the basic operation of the display panel. It also transmits signals to the drive circuit 112 for controlling the image display frequency and the scanning method (e.g., interlaced scanning or non-interlaced scanning) in order to define the mode of driving the display panel.

If appropriate, it also transmits signals to the drive circuit 112 for controlling the quality of the images to be displayed on the display screen in terms of luminance, contrast, color tone and sharpness.

The drive circuit 112 is a circuit for generating drive signals to be applied to the display panel. It operates according to image signals coming from said multiplexer 114 and control signals coming from the display panel controller 113.

A display apparatus according to the invention and having a configuration as described above and illustrated in FIG. 26 can display on the display panel various images given from a variety of image data sources. More specifically, image signals such as television image signals are converted back by the decoder 115 and then selected by the multiplexer 114 before being sent to the drive circuit 112. On the other hand, the display controller 113 generates control signals for controlling the operation of the drive circuit 112 according to the image signals for the images to be displayed on the display panel. The drive circuit 112 then applies drive signals to the display panel according to the image signals and the control signals. Thus, images are displayed on the display panel. All the above-described operations are controlled by the CPU 117 in a coordinated manner.

The above-described display apparatus can not only select and display particular images out of a number of images given to it but also carry out various image processing operations including those for enlarging, reducing, rotating, emphasizing edges of, thinning out, interpolating, changing colors of and modifying the aspect ratio of images and editing operations including those for synthesizing, erasing, connecting, replacing and inserting images as the image memories incorporated in the decoder 115, the image generation circuit 118 and the CPU 117 participate in such operations. Although not described with respect to the above embodiment, it is possible to provide it with additional circuits exclusively dedicated to audio signal processing and editing operations.

Thus, a display apparatus according to the invention and having a configuration as described above can have a wide variety of industrial and commercial applications because it can operate as a display apparatus for television broadcasting, as a terminal apparatus for video teleconferencing, as an editing apparatus for still and movie pictures, as a terminal apparatus for a computer system, as an OA apparatus such as a word processor, as a game machine and in many other ways.

It may be needless to say that FIG. 26 shows only an example of possible configuration of a display apparatus comprising a display panel provided with an electron source prepared by arranging a number of surface conduction electron-emitting devices and the present invention is not limited thereto. For example, some of the circuit components of FIG. 26 may be omitted or additional components may be arranged there depending on the application. For instance, if a display apparatus according to the invention is used for visual telephone, it may be appropriately made to comprise additional components such as a television camera, a microphone, lighting equipment and transmission/reception circuits including a modem.

[Advantage of the Invention]

With the present invention, the degradation of performance of an electron-emitting device can be effectively suppressed or the original performance of an electron-emitting device can be recovered to prolong the service life of an image forming apparatus comprising such electron-emitting devices.

Additionally, no large and bulky arrangement is required for introducing an activating substance into the vacuum system used for manufacturing an image forming apparatus so that a simple manufacturing apparatus and a simplified manufacturing method could be used.

What is claimed is:

1. An electron source comprising one or more than one electron-emitting devices comprising an electro-conductive thin film including an electron-emitting region between a pair of electrodes, wherein said electron source is provided with means for supplying an activating substance to the electron-emitting device or devices, said means for supplying an activating substance comprising an activating substance source holding the activating substance, wherein said activating substance is a substance capable of changing to a second substance which increases the emission current (Ie) and device current (If) of said one or more than one electron-emitting devices when deposited at least on said electron-emitting region of said electron-emitting device or devices.

2. An electron source according to claim 1, wherein said means for supplying the activating substance is arranged on the substrate where said electron-emitting device or each of said devices is disposed.

3. An electron source according to claim 1, wherein said means for supplying the activating substance further comprises means for gasifying the activating substance from said activating substance source.

4. An electron according to claim 3, wherein said activating substance source is a porous material carrying said activating substance absorbed thereon.

5. An electron source according to claim 3, wherein said means for gasifying the activating substance comprises means for heating said activating substance source.

6. An electron source according to claim 5, wherein said means for heating said activating substance source comprises a resistor disposed close to said activating substance source and means for passing electric current through said resistor.

7. An electron source according to claim 3, wherein said means for gasifying the activating substance comprises means for causing electrons to collide with said activating substance source.

8. An electron source according to claim 1, wherein said electron source comprises a plurality of electron-emitting devices.

9. An electron source according to claim 1, wherein the activating substance is an organic substance.

10. An electron source according to claim 1, wherein said electron-emitting device or each of said electron-emitting devices is a surface conduction electron-emitting device.

11. An image-forming apparatus comprising an electron source by turn comprising one or more than one electron emitting devices comprising an electroconductive thin film including an electron-emitting region between a pair of electrodes, an image-forming member to be irradiated with electron beams from said electron source to form images thereon, and means for supplying an activating substance to the electron-emitting device or devices, said means for supplying the activating substance comprising an activating substance source holding the activating substance, and wherein the activating substance is a substance capable of changing to a second substance which increases the emission current (Ie) and device current (If) of said one or more than one electron-emitting devices when deposited at least on said electron-emitting region of said electron-emitting device or devices.

12. An image forming apparatus according to claim 11, wherein said means for supplying an activating substance is arranged on the substrate where said electron-emitting device or each of said devices is disposed.

13. An image forming apparatus according to claim 11, where said means for supplying the activating substance is fitted to an envelope containing said electron source and said image-forming member.

14. An image forming apparatus according to claim 11, wherein said means for supplying the activating substance further comprises means for gasifying the activating substance from said activating substance source.

15. An image forming apparatus according to claim 14, wherein said activating substance source is a porous material carrying said activating substance adsorbed thereon.

16. An image forming apparatus according to claim 14, wherein said means for gasifying the activating substance comprises means for heating said activating substance source.

17. An image forming apparatus according to claim 16, wherein said means for heating said activating substance source comprises a resistor disposed close to said activating substance source and means for passing electric current through said resistor.

18. An image forming apparatus according to claim 14, wherein said means for gasifying the activating substance comprises means for causing electrons to collide with said activating substance source.

19. An image forming apparatus according to claim 11, further comprising a getter.

20. An image forming apparatus according to claim 11, wherein said image forming apparatus comprises a plurality of electron-emitting devices.

21. An image forming apparatus according to claim 11, wherein said electron-emitting device or each of said electron-emitting devices is a surface conduction electron-emitting device.

22. An image forming apparatus according to claim 11, wherein said image forming member is a fluorescent body.

23. A method of activating an electron source comprising one or more than one electron-emitting devices comprising an electro-conductive thin film including an electron-emitting region between a pair of electrodes and an activating substance source, wherein the electron source is provided with means for supplying an activating substance to the electron-emitting device or devices, the means for supplying an activating substance comprising an activating substance source holding the activating substance, wherein the activating substance is a substance capable of changing to a second substance which increases the emission current (Ie) and device current (If) of the one or more than one electron-emitting devices when deposited at least on the electron-emitting region of the electron-emitting device or devices, and wherein said method comprises the step of gasifying the activating substance from the activating substance source and applying it to the electron-emitting device or devices.

24. A method of activating an electron source according to claim 23, wherein said step of gasifying an activating substance comprises heating the activating substance source.

25. A method of activating an electron source according to claim 24, wherein said step of heating the activating substance source comprises passing electric current through a resistor arranged close to the activating substance source.

26. A method of activating an electron source according to claim 24, wherein said step of heating the activating substance source comprises irradiating the activating substance source with light.

27. A method of activating an electron source according to claim 23, wherein said step of gasifying an activating substance comprises causing electrons to collide with the activating substance source.

28. A method of activating an electron source according to claim 23, wherein the electron source comprises a plurality of electron-emitting devices.

29. A method of activating an electron source according to claim 23, wherein the electron-emitting device or each of the electron-emitting devices is a surface conduction electron-emitting device.

30. A method of activating an electron source according to any of claims 23 through 28 and 29, wherein said step of applying an activating substance to said electron-emitting device or devices is conducted, while driving said electron source.

31. A method of activating an electron source according to any of claims 23 through 28 and 29, wherein said step of applying an activating substance to said electron-emitting device or devices is conducted whenever the performance of the device or devices is degraded.

32. A method of activating an image forming an apparatus comprising an electron source by turn comprising one or more than one electron-emitting devices comprising an electro-conductive thin film including an electron-emitting region between a pair of electrodes, an image forming member to be irradiated with electron beams from the electron source to form images thereon, and means for supplying an activating substance to the electron-emitting device or devices, the means for supplying the activating substance comprising an activating substance source holding the activating substance, and wherein the activating substance is a substance capable of changing to a second substance which increases the emission current (Ie) and device current (If) of the one or more than one electron-emitting devices when deposited at least on the electron-emitting region of the electron-emitting device or devices, and said method comprising the step of gasifying the activating substance from the activating substance source and applying the activating substance to the electron-emitting device or devices.

33. A method of activating an image forming apparatus according to claim 32, wherein said step of gasifying an activating substance comprises heating the activating substance source.

34. A method of activating an image forming apparatus according to claim 33, wherein said step of heating the activating substance source comprises passing electric current through a resistor arranged close to the activating substance source.

35. A method of activating an image forming apparatus according to claim 33, wherein said step of heating the activating substance source comprises irradiating the activating substance source with light.

36. A method of activating an image forming apparatus according to claim 32, wherein said step of gasifying an activating substance comprises causing electrons to collide with the activating substance source.

37. A method of activating an image forming apparatus according to claim 32, further comprising the step of activating a getter to be carried out after said step of applying an activating substance to the electron-emitting device or devices.

38. A method of activating an image forming apparatus according to claim 32, wherein the image forming apparatus comprises a plurality of electron-emitting devices.

39. A method of activating an image forming apparatus according to claim 32, wherein the electron-emitting device is or each of the electron-emitting devices is a surface conduction electron-emitting device.

40. A method of activating an image forming apparatus according to any of claims 32 and 33 through 39, wherein said step of applying an activating substance to said electron-emitting device or devices is conducted, while driving said electron source.

41. A method of activating an image forming apparatus according to any of claims 32 and 33 through 39, wherein said step of applying an activ ating substance to said electron-emitting device or devices is conducted whenever the performance of the device or devices is degraded.

42. An image forming apparatus according to claim 11, wherein the activating substance is an organic substance.

43. A method according to claim 23, wherein the activating substance is an organic substance.

44. A method according to claim 32, wherein the activating substance is an organic substance.

45. An electron source according to claim 1, wherein the activating substance is a metal compound.

46. An image forming apparatus according to claim 11, wherein the activating substance is a metal compound.

47. A method according to claim 23, wherein the activating substance is a metal compound.

48. A method according to claim 32, wherein the activating substance is a metal compound.

49. An electron source according to claim 1, wherein the activating substance is a high-molecular compound or a baked compound thereof.

50. An image forming apparatus according to claim 11, wherein the activating substance is a high-molecular compound or a baked compound thereof.

51. A method according to claim 23, wherein the activating substance is a high-molecular compound or a baked compound thereof.

52. A method according to claim 32, wherein the activating substance is a high-molecular compound or a baked compound thereof.

53. An electron source according to claim 1, wherein said means for supplying an activating substance is capable of preventing the degradation in performance or recovering the degraded performance of said one or more than one electron-emitting devices.

54. An image forming apparatus according to claim 11, wherein said means for supplying an activating substance is capable of preventing the degradation in performance or recovering the degraded performance of said one or more than one electron-emitting devices.

55. A method according to claim 23, wherein the means for supplying an activating substance is cap able of preventing the degradation in performance or recovering the degraded performance of the one or more than one electron-emitting devices.

56. A method according to claim 32, wherein the means for supplying an activating substance is capable of preventing the degradation in performance or recovering the degraded performance of the one or more than one electron-emitting devices.

57. An electron source according to claim 1, wherein said electron-emitting device or each of said the group consisting of carbon, a carbon compound, a metal and a metal compound at least at the electron-emitting region thereof, and wherein said means for supplying the activating substance is capable of supplying a substance selected from said group at least to the electron-emitting region of said electron-emitting device or each of said electron-emitting devices.

58. An image forming apparatus according to claim 11, wherein said electron-emitting device or each of said electron-emitting devices includes a substance selected from the group consisting of carbon, a carbon compound, a metal and a metal compound at least at the electron-emitting region thereof, and wherein said means for supplying the activating substance is capable of supplying a substance selected from said group at least to the electron-emitting region of said electron-emitting device or each of said electron-emitting devices.

59. A method according to claim 23, wherein the electron-emitting device or each of the electron-emitting devices includes a substance selected from the group consisting of carbon, a carbon compound, a metal and a metal compound at least at the electron-emitting region thereof, and wherein the means for supplying the activating substance is capable of supplying a substance selected from said group at least to the electron-emitting region of the electron-emitting device or each of said electron-emitting devices.

60. A method according to claim 32, wherein the electron-emitting device or each of the electron-emitting devices includes a substance selected from the group consisting of carbon, a carbon compound, a metal and a metal compound at least at the electron-emitting region thereof, and wherein the means for supplying the activating substance is capable of supplying a substance selected from said group at least to the electron-emitting region of the electron-emitting device or each of said electron-emitting devices.

61. An electron source according to claim 45, wherein the metal component of said metal compound is selected from the group consisting of Nb, Os, Re, Ta and W.

62. An image forming apparatus according to claim 46, wherein the metal component of said metal compound is selected from the group consisting of Nb, Os, Re, Ta and W.

63. A method according to claim 47, wherein the metal component of said metal compound is selected from the group consisting of Nb, Os, Re, Ta and W.

64. A method according to claim 48, wherein the metal component of said metal compound is selected from the group consisting of Nb, Os, Re, Ta and W.

65. A method according to claim 23, wherein said activating substance source is a porous material carrying said activating substance adsorbed thereon.

66. A method according to claim 32, wherein said activating substance source is a porous material carrying said activating substance adsorbed thereon.

67. A method according to claim 23, wherein the means for supplying the activating substance is arranged on the substrate where the electron-emitting device or each of the devices is disposed.

68. A method according to claim 32, wherein the means for supplying the activating substance is arranged on the substrate where the electron-emitting device or each of the devices is disposed.

69. A method according to claim 32, wherein the means for supplying the activating substance is fitted to an envelope containing the electron source and the image forming member.

70. An electron source comprising one or more than one electron-emitting devices comprising an electro-conductive thin film including an electron-emitting region between a pair of electrodes, wherein said electron source is provided with means for supplying an activating substance to the electron-emitting device or devices, said means for supplying an activating substance comprising an activating substance source holding the activating substance, wherein said activating substance is a substance capable of changing to a second substance which includes a carbon or a metal having a melting point higher than a constituent material of the electro-conductive thin film.

71. An image-forming apparatus comprising an electron source which in turn comprises one or more than one electron-emitting devices comprising an electro-conductive thin film including an electron-emitting region between a pair of electrodes, an image-forming member to be irradiated with electron beams from said electron source to form images thereon, and means for supplying an activating substance to the electron-emitting device or devices, said means for supplying the activating substance comprising an activating substance source holding the activating substance, and wherein the activating substance is a substance capable of changing to a second substance which includes a carbon or a metal having a melting point higher than a constituent material of the electro-conductive thin film.

72. A method of activating an electron source comprising one or more than one electron-emitting devices comprising an electro-conductive thin film including an electron-emitting region between a pair of electrodes and an activating substance source, wherein the electron source is provided with means for supplying an activating substance to the electron-emitting device or devices, the means for supplying an activating substance comprising an activating substance source holding the activating substance, wherein the activating substance is a substance capable of changing to a second substance which includes a carbon or a metal having a melting point higher than a constituent material of the electro-conductive thin film, and wherein said method comprises the step of gasifying the activating substance from the activating substance source and applying it to the electron-emitting device or devices.

73. A method of activating an image forming apparatus comprising an electron source which in turn comprises one or more than one electron-emitting devices comprising an electro-conductive thin film including an electron-emitting region between a pair of electrodes, an image forming member to be irradiated with electron beams from the electron source to form images thereon, and means for supplying an activating substance to the electron-emitting device or devices, the means for supplying the activating substance comprising an activating substance source holding the activating substance, and wherein the activating substance is a substance capable of changing to a second substance which includes a carbon or a metal having a melting point higher than a constituent material of the electro-conductive thin film, said method comprising the step of gasifying the activating substance from the activating substance source and applying the activating substance to the electron-emitting device or devices.

74. A method for fabricating an electron source provided with a plurality of electron-emitting devices on a substrate, comprising the steps of:

forming a plurality of electro-conductive films in predetermined regions on the substrate;

passing electric current through each of the conductive films; and heating films including carbon disposed in the vicinity of the electro-conductive films to thereby deposit carbon on the electro-conductive films.

75. A method for fabricating an electron source provided with a plurality of electron-emitting devices on a substrate which are wired in matrix form by a plurality of wirings in row direction and plurality of wirings in column direction, comprising the steps of:

forming a plurality of electro-conductive films in predetermined regions on the substrate, the plurality of electro-conductive films being wired in matrix form by the plurality of wirings in row direction and the plurality of wirings in column direction;

passing electric current through each of the electro-conductive films via the wirings in row direction and the wirings in column direction; and heating films including carbon disposed in the vicinity of the electro-conductive films to thereby deposit carbon on the electro-conductive films.

76. The method according to claim 74 or 75, wherein the films including carbon are films consisting of organic material.

77. The method according to claim 74 or 75, wherein the films including carbon comprise high molecular compound.

78. The method according to claim 74 or 75, wherein the step of heating the film including carbon has a step of passing electric current through resistant substances disposed closely to the respective films including carbon.

79. A method for fabricating an image-forming apparatus having an electron source provided with a plurality of electron-emitting devices on a substrate and an image-forming member for forming an image upon irradiation of electron-beams from the electron source, comprising the steps of:

forming a plurality of electro-conductive films in predetermined regions on the substrate;

disposing in a container the plurality of electro-conductive films and the image-forming member for forming an image upon the irradiation of electron beams;

passing electric current through each of the electro-conductive films; and heating the films including carbon disposed in the vicinity of the electro-conductive films to thereby deposit carbon on the electro-conductive films.

80. A method for fabricating an image-forming apparatus having an electron source provided with a plurality of electron-emitting devices on a substrate and an image-forming member for forming an image upon irradiation of electron beams from the electron source, the plurality of electron-emitting devices being wired in matrix form by a plurality of wirings in row direction, comprising the steps of:

forming in predetermined regions on the substrate a plurality of electro-conductive films wired in matrix form by the plurality of wirings in row direction and the plurality of wirings in column direction;

disposing in a container the plurality of electro-conductive films and the image-forming member for forming the image upon the irradiation of electron beams;

passing electric current through each of the electro-conductive films via the wirings in row direction and the wirings in column direction; and heating the films including carbon disposed in the vicinity of the electro-conductive films to thereby deposit carbon on the electro-conductive films.

81. The method according to claim 79 or 80, wherein the films including carbon are films consisting of organic material.

82. The method according to claim 79 or 80, wherein the films including carbon comprise high molecular compound.

83. The method according to claim 79 or 80, wherein the step of heating the films including carbon has a step of passing electric current through resistant substances disposed closely to the films including carbon.

* * * * *

UNITED STATES PATENT AND TRADEMARK OFFICE

CERTIFICATE OF CORRECTION

PATENT NO. : 6,160,347
APPLICATION NO. : 08/543897
DATED : December 12, 2000
INVENTOR(S) : Tatsuya Iwasaki et al.

It is certified that error appears in the above-identified patent and that said Letters Patent is hereby corrected as shown below:

ON TITLE PAGE AT [56] REFERENCES CITED, FOREIGN PATENT DOCUMENTS

| | | |
|---|---|---|
| "2946189 | 7/1999 | Japan |
| 2-257551 | 10/1999 | Japan" |
| | should read | |
| --2-257551 | 10/1990 | Japan--. |

ON TITLE PAGE AT [56] REFERENCES CITED, OTHER PUBLICATIONS

After "W.P. Dyke, et al.", "Emissions::," should read --Emissions:--;
After "Scanning Tunnelling", "Diodes", to should read --Diodes,"--; and
"1009-1010 (1990)" should read --25-32 (1990)--.

COLUMN 1

Line 19, "device:" should read --devices:--;
Line 25, "tho se" should read --those--;
Line 27, "thinfilm" should read --thin-film--.

COLUMN 2

Line 61, "pr event" should read --prevent--;
Line 64, "above identified" should read --above-identified--.

COLUMN 3

Line 10, "complicate d" should read --complicated--;
Line 62, "of a" should read --of--.

COLUMN 4

Line 19, "FIG. 10A" should read --FIGS. 10A--.

COLUMN 5

Line 55, "i nvention" should read --invention--.

UNITED STATES PATENT AND TRADEMARK OFFICE

CERTIFICATE OF CORRECTION

PATENT NO. : 6,160,347
APPLICATION NO. : 08/543897
DATED : December 12, 2000
INVENTOR(S) : Tatsuya Iwasaki et al.

It is certified that error appears in the above-identified patent and that said Letters Patent is hereby corrected as shown below:

COLUMN 6

Line 23, “i” should be deleted;
Line 38, “manometer” should read --nanometer--;
Line 53, “describes” should read --describes it--.

COLUMN 7

Line 49, “electronemitting” should read --electron-emitting--.

COLUMN 9

Line 13, “nique.” should read --niques.--;
Line 34, “b e” should read --be--.

COLUMN 10

Line 62, “$x10^{-8}$ Pa,” should read --$1x10^{-8}$ PA,--.

COLUMN 12

Line 26, “on” should be deleted.

COLUMN 13

Line 12, “application.” should read --applications.--.

COLUMN 15

Line 8, “wehereas” should read --whereas--;
Line 21, “to 400” should read --from 400°C--.

COLUMN 16

Line 35, “step on” should read --step--.

COLUMN 17

Line 66, “device” should read --devices--;
Line 67, “only” should read --as--.

UNITED STATES PATENT AND TRADEMARK OFFICE

CERTIFICATE OF CORRECTION

PATENT NO. : 6,160,347
APPLICATION NO. : 08/543897
DATED : December 12, 2000
INVENTOR(S) : Tatsuya Iwasaki et al.

It is certified that error appears in the above-identified patent and that said Letters Patent is hereby corrected as shown below:

COLUMN 20

Line 26, “electro n-emitting” should read --electron-emitting--;
Line 63, “o f” should read --of--.

COLUMN 21

Line 58, “Rs ≈ 100Ω□.” should read --Rs ≅ 100Ω□.--.

COLUMN 22

Line 55, “i n” should read --in--.

COLUMN 23

Line 9, “T1-100 μsec.” should read --T1-100 μsec.--;
Line 23, “dIe(1 hour)=5%” should read --δIe(1 hour)=5%--.

COLUMN 24

Line 41, “L-10 μm” should read --L=10 μm--;
Line 62, “T1=100 pμsec. and T2=10 msec.” should read --T1=100 μsec. and T2=10 msec.--.

COLUMN 26

Line 27, “is consisted” should read --consists--.

COLUMN 28

Line 28, “same” should read --the same--;
Line 34, “dIf(1 hour)=22% and dIe(1 hour)=” should read --δIf(1 hour)=22% and δIe(1 hour)=--;
Line 50, “Ie=2.2 .usec.” should read --Ie=2.2 μsec.--.

COLUMN 29

Line 56, “we.” should read --was--.

UNITED STATES PATENT AND TRADEMARK OFFICE

CERTIFICATE OF CORRECTION

PATENT NO. : 6,160,347
APPLICATION NO. : 08/543897
DATED : December 12, 2000
INVENTOR(S) : Tatsuya Iwasaki et al.

It is certified that error appears in the above-identified patent and that said Letters Patent is hereby corrected as shown below:

COLUMN 30

Line 1, "is consisted" should read --consists--.

COLUMN 31

Line 45, "cane" should read --case--;
Line 48, "tented" should read --tested--.

COLUMN 38

Line 11, "an apparatus" should read --apparatus--;
Line 58, "is or" should read --or--;
Line 67, "activ ating" should read --activating--.

COLUMN 39

Line 49, "said the" should read --said electron-emitting devices includes a substance selected from the--.

Signed and Sealed this

Nineteenth Day of February, 2008

JON W. DUDAS
*Director of the United States Patent and Trademark Office*